US007841459B2

(12) United States Patent
Isobe et al.

(10) Patent No.: US 7,841,459 B2
(45) Date of Patent: Nov. 30, 2010

(54) PAPER SHEET HANDLING APPARATUS

(75) Inventors: Atsushi Isobe, Sagamihara (JP); Taichi Sato, Sagamihara (JP); Koji Kuroiwa, Sagamihara (JP)

(73) Assignee: Japan Cash Machine Co., Ltd. (JP)

( * ) Notice: Subject to any disclaimer, the term of this patent is extended or adjusted under 35 U.S.C. 154(b) by 514 days.

(21) Appl. No.: 10/490,653

(22) PCT Filed: Sep. 27, 2002

(86) PCT No.: PCT/JP02/10125

§ 371 (c)(1),
(2), (4) Date: Mar. 25, 2004

(87) PCT Pub. No.: WO03/032263

PCT Pub. Date: Apr. 17, 2003

(65) Prior Publication Data

US 2004/0217536 A1 Nov. 4, 2004

(30) Foreign Application Priority Data

Sep. 28, 2001 (JP) ..... 2001-300169

(51) Int. Cl.
*G07F 7/04* (2006.01)

(52) U.S. Cl. ..... 194/206; 271/298

(58) Field of Classification Search ..... 194/206, 194/207; 209/534; 271/298
See application file for complete search history.

(56) References Cited

U.S. PATENT DOCUMENTS 4,113,117 A * 9/1978 Douglas et al. ..... 414/797
5,105,364 A * 4/1992 Kawamura et al. ..... 700/219
5,832,556 A * 11/1998 Eyler ..... 15/104.93
5,855,268 A * 1/1999 Zoladz, Jr. ..... 194/207
5,918,720 A * 7/1999 Robinson et al. ..... 194/206
6,157,895 A * 12/2000 Nakajima et al. ..... 702/82

(Continued)

FOREIGN PATENT DOCUMENTS

EP 0 907 152 A2 4/1999

(Continued)

*Primary Examiner*—Jeffrey A Shapiro
(74) *Attorney, Agent, or Firm*—Gerald E. Hespos; Michael J. Porco

(57) ABSTRACT

A paper sheet handling apparatus, includes: an identifying unit 20 which forwards and identifies a paper sheet A that is inserted from an opening portion 22 formed in its front plane; a collecting unit 30 which stores the identified paper sheet A; a paying-out unit 40 which stores a paying-out paper sheet B to be paid out to the opening portion 22 in a certain case; a forwarding unit 50 which forwards the paper sheet A and the paying-out paper sheet B, between each of the identifying unit 20, the collecting unit 30 and the paying-out unit 40; an outer frame 10 which holds each unit of the identifying unit 20 disposed on its front side, the forwarding unit 50 disposed on the inner side from it, the collecting unit 30 disposed below these identifying unit 20 and forwarding unit 50 and on the front side, and the paying-out unit 40 disposed on the inner side from the collecting unit 30, in which to the outer frame 10, at least the collecting unit 30 and the paying-out unit 40 are detachably attached from its front side.

20 Claims, 31 Drawing Sheets

U.S. PATENT DOCUMENTS

| | | | | |
|---|---|---|---|---|
| 6,170,822 | B1 | 1/2001 | Kato et al. | |
| 6,318,714 | B1 | 11/2001 | Beskitt et al. | |
| 6,378,683 | B2 * | 4/2002 | Mennie | 194/207 |
| 6,731,785 | B1 * | 5/2004 | Mennie et al. | 382/135 |
| 7,152,744 | B2 * | 12/2006 | Kunz et al. | 209/534 |
| 2001/0015309 | A1 * | 8/2001 | Ikuta | 194/206 |
| 2002/0162775 | A1 * | 11/2002 | Saltsov et al. | 209/534 |
| 2004/0182677 | A1 * | 9/2004 | Katou et al. | 194/206 |

FOREIGN PATENT DOCUMENTS

| | | |
|---|---|---|
| GB | 2 225 662 A | 6/1990 |
| JP | 11-175804 | 7/1999 |
| JP | 2002-145462 | 5/2002 |
| WO | WO 99/28223 | 6/1999 |

* cited by examiner

PAPER SHEET HANDLING APPARATUS

TECHNICAL FIELD

This invention relates to a paper sheet handling apparatus, which is housed inside of, for example, a vending machine, a money changer, recreational equipment for amusements, or the like, has the function of receiving a paper sheet, such as a bank note, from its inlet, and as the case may be, the function of paying out a paper sheet of the same type or another type to the inlet.

BACKGROUND ART

As a conventional paper sheet handling apparatus as mentioned above, there is known a bank-note handling apparatus shown in FIG. 29 (Japanese Patent Laid-Open No. 8-153230). This bank-note handling apparatus includes a bank-note receipt portion 200 in which a bank note 201 is cast from a bank-note inlet 208 located almost in its middle in the directions of its height. Then, it is judged at an identifying portion 204 whether the bank note 201 is genuine or not and what type it is. Next, the large-domination bank note 201 which has been judged genuine is sent to a large-domination bank-note storage portion 203 through a forwarding line 211, and it is stored therein. On the other hand, the small-domination bank note 201 is sent through a forwarding line 212 to a small-domination bank-note storage portion 206 which is placed below the bank-note inlet 208, and it is stored therein. The bank note 201 which has not been judged genuine is returned to the side of the bank-note inlet 208 by the reversal of a driving unit. In the bank-note receipt portion 200, a bank-note paying-out portion 205 is provided between the bank-note inlet 208 and the small-domination bank-note storage portion 206 located below it. It sends and pays out the bank note which has been forwarded from the small-domination bank-note storage portion 206, to a bank-note outlet 209, if a paying-out request is made.

Accordingly, the conventional bank-note handling apparatus is configured such that the bank-note outlet 209 is provided below and separately from the bank-note inlet 208. Thus, the bank-note receipt portion 200 and the bank-note paying-out portion 205 are piled in the up-and-down directions, thereby making it tall.

If the conventional bank-note handling apparatus as mentioned above is housed in equipment with a sufficiently large space inside of it, for example, an ATM (or automatic teller machine) or the like, that does not constitute any obstacles. However, there has been a disadvantage in that if it is housed in equipment which has a small inside-space and thus is subject to limitations on the height measurement of its housing space, for example, a vending machine, a money changer, recreational equipment for amusements, or the like, then the housing may be difficult to conduct.

Aiming at resolving such a disadvantage of the prior art, it is an object of the present invention to provide a paper sheet handling apparatus which is capable of receiving and paying out a paper sheet, and which can be small-sized so that the housing is conducted even though there are limitations on the height measurement of housing space.

In the conventional bank-note handling apparatus as mentioned above, the forwarding line 211, the forwarding line 212, and the like, are configured to supply a bank note to the large-domination bank-note storage portion 203 and the small-domination bank-note storage portion 206, in the horizontal direction from the rear-plane side. This makes its measurements longer even in the front-and-rear directions, and thus, it becomes very large-sized. Hence, equipment which has a small inside-space and thus is subject to limitations on the depth measurement of its housing space, for example, a vending machine, a money changer, recreational equipment for amusements, or the like, then not only limitations on the height measurement but also limitations on the depth measurement may make the housing difficult to conduct.

This will be described below, as an example, using recreational equipment 220 for amusements shown in FIG. 30.

In the amusement recreational equipment 220, a CRT 221 which makes a display is placed in the height position that corresponds to the eyes of a player from a human-engineering viewpoint. This frequently imposes limitations on its height measurement. Besides, a coin inlet portion 222 which is used with high frequency is placed on the right-hand side below the CRT 221 to make it easy to handle. On its right side is placed a bank-note inlet 223. In a further lower part, there is placed a coin receipt portion 224. In addition, a coin identifying unit (not shown) is placed inside of a case 225 provided with the coin inlet portion 222, and a bank-note handling apparatus 226 is placed inside of the bank-note inlet 223, respectively. Thereby, the bank-note handling apparatus 226 is subject to limitations not only on its width measurement in the right-and-left directions, but also on its front-and-rear measurement according to the depth measurement of the CRT 221. This may make the bank-note handling apparatus 226 more difficult to mount.

Therefore, it is another object of the present invention to provide a paper sheet handling apparatus which can be small-sized so that the housing is conducted, even though there are limitations on the depth measurement of housing space.

DISCLOSURE OF THE INVENTION

A paper sheet handling apparatus according to the present invention, characterized by including: an identifying unit which forwards and identifies a paper sheet inserted from an opening portion formed in the front plane thereof; a collecting unit which stores the identified paper sheet; a paying-out unit which stores a paying-out paper sheet to be paid out to the opening portion in a certain case; a forwarding unit which forwards the identified paper sheet and the paying-out paper sheet, between each of the identifying unit, the collecting unit and the paying-out unit; and an outer frame which holds each unit of the identifying unit disposed on the front side thereof, the forwarding unit disposed on the inner side therefrom, the collecting unit disposed below these identifying unit and forwarding unit and on the front side, and the paying-out unit disposed at least on the inner side from the collecting unit, in that to the outer frame, at least the collecting unit and the paying-out unit are attached from the front side thereof so as to be attachable and detachable.

With this paper sheet handling apparatus, the identifying unit and the forwarding unit are disposed in the front-and-rear directions. Below these, the collecting unit is disposed, and the paying-out unit is disposed at least on the inner side from the collecting unit. This allows its height measurement (or up-and-down measurement) to become shorter. Besides, the paying-out paper sheet that has been paid out from the paying-out unit is paid out from the opening portion which is used for inserting a paper sheet in the identifying unit. This also makes the up-and-down measurement shorter. In addition, the identifying unit and the forwarding unit are disposed in the front-and-rear directions, and the identifying unit forwards and identifies a paper sheet. This saves the identifying unit from having to include more than an identifying mechanism. Thus, no obstacle can be constituted, even if the front end of a paper sheet is located inside of the forwarding unit when an identification is executed. This allows its front-and-rear measurement to become shorter, even though the housing space is limited in the front-and-rear directions, to that limited measurement. Therefore, even if there are some limitations on the housing space in the front-and-rear directions, the front-and-rear measurements of the identifying unit and the forwarding unit can be shortened to the limited measurement.

Moreover, to the outer frame, the collecting unit and the paying-out unit are attached from its front side so as to be attachable and detachable. Thereby, regardless of the disposition of other units around the place where the paper sheet handling apparatus is housed, the identified paper sheet that has been stored in the collecting unit can be collected. In addition, the paying-out paper sheet can be supplied to the paying-out unit, thereby making it possible to receive and pay out a paper sheet.

In the paper sheet handling apparatus according to the present invention, the paying-out paper sheet is one, or two or more, of a bank note, a cut-sheet which undergoes printing when paid out, a continuous form which undergoes printing when paid out, and a card which undergoes printing or magnetic recording when paid out.

With this configuration, the paying-out paper sheet can be paid out according to the type of housing equipment which houses the paper sheet handling apparatus. In addition, the usage of the paying-out paper sheet which has been paid out can be made various types.

In the paper sheet handling apparatus according to the present invention, the directions in which a paper sheet is forwarded between the collecting unit and the forwarding unit and between the paying-out unit and the forwarding unit are set to the up-and-down directions.

With this configuration, the direction in which a paper sheet is forwarded between the collecting unit and the forwarding unit is set to the up-and-down directions. Thereby, the front-and-rear measurement of the collecting unit can be made as short as possible. This presents ample space on the inner side from the collecting unit. In that ample space, the paying-out unit can be placed whose front-and-rear measurement is made shorter by setting the paper sheet forwarding direction between it and the forwarding unit to the up-and-down directions. Therefore, even though the housing space is limited in the front-and-rear directions, the front-and-rear measurements of the collecting unit and the paying-out unit can be made shorter to their limited measurements.

In the paper sheet handling apparatus according to the present invention, the collecting unit or the paying-out unit, or these two, include a sorting and storage portion which sorts and stores two types of paper sheets according to their types.

With this configuration, even if the necessity occurs of storing two types of paper sheets, there is no need for new storage space for the collecting unit or the paying-out unit, or these two. This makes it possible to omit the space for essential storage space, and thus, to store each paper sheet, with the whole paper sheet handling apparatus keeping its measurements at a small space.

In the paper sheet handling apparatus according to the present invention, the outer frame is provided with a second paying-out unit at the upper part thereof, this second paying-out unit stores the paying-out paper sheet so that it is inserted into and extracted from the front side of the outer frame.

With this configuration, if the paying-out paper sheet (such as a cut-sheet on which printing is conducted at the time of paying-out) is treated to which an administrator has access more frequently than to the paper sheet stored in the collecting unit, the second paying-out unit is configured so that the paying-out paper sheet can be inserted into and extracted from the front side of the outer frame. Therefore, the administrator can easily supply or take out the paying-out paper sheet from the second paying-out unit, without removing the collecting unit from the outer frame. In other words, this configuration allows the supply or extraction of the paying-out paper sheet which has high access frequency to be simply operated, with the paper sheet handling apparatus maintaining its front-and-rear measurement as much as possible.

In the paper sheet handling apparatus according to the present invention, the second paying-out unit is provided with an identifying device which identifies the type or the like of the paying-out paper sheet which is forwarded from the second paying-out unit to the opening portion; this identifying device is configured to identify a printing level or a magnetic-recording level of the paying-out paper sheet; and if each level of the paying-out paper sheet which is identified by this identifying device is identified as lower than a predetermined level, the paying-out paper sheet is forwarded to the collecting unit by the forwarding unit.

With this configuration, if a printing level or a magnetic-recording level of the paying-out paper sheet to be paid out from the second paying-out unit to the opening portion is a level at which identification could not be conducted later (e.g., in the case of a light print, a magnetic fault or the like), the paying-out paper sheet is forwarded to the collecting unit by the forwarding unit. In that case, another paying-out paper sheet is issued again, thereby preventing the one that could not be identified from being issued.

In the paper sheet handling apparatus according to the present invention, the paying-out unit includes a plurality of paying-out portions which store, as the paying-out paper sheet, a plurality of types of paper sheets according to their types; and each of these plurality of paying-out portions is individually detachably attached from the front side of the outer frame.

With this configuration, a plurality of types of paying-out paper sheets can be paid out. This allows various types of housing equipment to be used, thus increasing the types of housing equipment applicable to the paper sheet handling apparatus. With respect to each paying-out portion, the paying-out paper sheets can be supplied to the paying-out portion at their inmost part, if they are detached one after another from the forefront.

In the paper sheet handling apparatus according to the present invention, the plurality of paying-out portions include at least two paying-out portions which are disposed below the identifying unit and the forwarding unit; those paying-out portions are inside of the outer frame, and are united and housed in an inside frame which is detachably attached below the identifying unit and the forwarding unit; and the inside frame is provided with an opening portion or an open-and-close portion through which the paying-out paper sheet is fed to a paying-out portion located in the inner part.

With this configuration, the plurality of paying-out portions are united and housed in the inside frame. If the inside frame is detached forward from the outer frame, the paying-out paper sheets can be supplied to a paying-out portion located at their inner part, through the opening portion or the open-and-close portion. Thus, there is no need to remove paying-out portions one by one which are placed ahead of the paying-out portion located in the inner part, thereby making it convenient.

In the paper sheet handling apparatus according to the present invention, the identifying unit is configured to identify a damage level of a paper sheet which is inserted from the opening portion, and a printing level or a magnetic-recording level of the paying-out paper sheet to be paid out to the opening portion; and if each level of the paper sheet which is identified by this identifying unit is identified as lower than a predetermined level, the paper sheet is forwarded to the collecting unit by the forwarding unit.

With this configuration, if the damage level of a paper sheet which has been inserted from the opening portion is a level at which it can be identified as genuine or counterfeit by the identifying unit, but a level at which its forwarding by the forwarding unit may have a harmful influence (which corresponds to the damage level of, for example, a bent or ripped paper sheet), then the paper sheet is forwarded to the collecting unit by the forwarding unit. This prevents the paper sheet from being forwarded to the paying-out unit at all, thereby avoiding the trouble at the time of forwarding which may be caused when it is paid out later. In the same way, if the printing level or magnetic-storage level of the paying-out paper sheet to be paid out to the opening portion is a level at which it could not be identified later, then the paying-out paper sheet is forwarded to the collecting unit by the forwarding unit. In that case, another paying-out paper sheet is issued again, thereby preventing the one, as described above, that could not be identified from being issued.

In the paper sheet handling apparatus according to the present invention, the identifying unit is configured to identify the insertion direction of a paper sheet which is inserted from the opening portion; and the paper sheet which is identified as a specific insertion direction by this identifying unit is forwarded to the paying-out unit by the forwarding unit.

With this configuration, the insertion direction (or the front-and-rear direction and the obverse-and-reverse direction) of a paper sheet which has been inserted from the opening portion by the identifying is identified. As a result, the paper sheet which has been identified as a specific insertion direction is forwarded to the paying-out unit. This unifies the storage direction of the paper sheet to be stored in the paying-out unit. Therefore, the direction in which a paper sheet is paid out to a user can be unified for each paying-out operation.

In the paper sheet handling apparatus according to the present invention, the forwarding unit is configured to forward the paying-out paper sheet which is stored in the paying-out unit to the collecting unit, according to an external request.

With this configuration, the forwarding unit forwards the paying-out paper sheet which has been stored in the paying-out unit to the collecting unit, according to an external request. Thus, if there is the need to collect the paper sheets which have been stored in both the paying-out unit and the collecting unit, then an administrator once forwards the paper sheet in the paying-out unit to the collecting unit. Thereafter, the administrator can collect the paper sheets in a lump from the collecting unit. Herein, "the external request" is realized by a predetermined starting operation. As this kind of starting operation, operation can be used, such as the operation of a predetermined switch provided in the paper sheet handling apparatus, and the operation of allowing the identifying unit to read a magnetic card which stores a command for starting in advance, or a coupon ticket on which a command for starting is printed as bar-code information beforehand.

In the paper sheet handling apparatus according to the present invention, the identifying unit is detachably attached to the forwarding unit, and is replaced and used according to the paper sheet to be identified.

With this configuration, the identifying unit is replaced and used, thereby making it possible to identify the paper sheet to be identified, even though it is varied.

In the paper sheet handling apparatus according to the present invention, the opening portion of the identifying unit is used both for inserting and paying out a paper sheet.

With this configuration, there is no need to separately provide an opening portion for paying-out, or a forwarding line which leads to it. This shortens its height measurement and decreases the number of parts.

In the paper sheet handling apparatus according to the present invention, the paying-out paper sheet includes a reference reading paper sheet which is used for adjusting identification precision of the identifying unit; and the precision of the identifying unit is adjusted so that an actual measurement value by the identifying unit which identifies this reference reading paper sheet becomes a value that is preset for the reference reading paper sheet.

With this configuration, the precision of the identifying unit can be adjusted by allowing it to identify the reference reading paper sheet. Hence, if this reference reading paper sheet is stored in the paying-out unit, the precision of the identifying unit can be easily adjusted.

In the paper sheet handling apparatus according to the present invention, the paying-out paper sheet includes a cleaning paper sheet which is used for cleaning the identifying unit; and the identifying unit is cleaned when identifying the cleaning paper sheet.

With this configuration, cleaning of the identifying unit can be conducted by allowing it to identify the cleaning paper sheet. Hence, if this cleaning paper sheet is stored in the paying-out unit, cleaning of the identifying unit can be easily conducted.

In the paper sheet handling apparatus according to the present invention, the identifying unit is configured to identify whether the paying-out paper sheet in the paying-out unit which is supplied by an administrator, is a predetermined one, or not.

With this configuration, the identifying unit is configured to identify whether the paying-out paper sheet in the paying-out unit which has been supplied by an administrator, is a predetermined one, or not. Thus, the administrator can certainly supply the paying-out paper sheet into the paying-out unit.

BRIEF DESCRIPTION OF THE DRAWINGS

FIG. 18 is a plan, partially sectional view of a collecting unit in FIG. 17.

BEST MODE FOR CARRYING OUT THE INVENTION

Hereinafter, a paper sheet handling apparatus embodying the present invention will be specifically described.

First Embodiment

Figure 1:
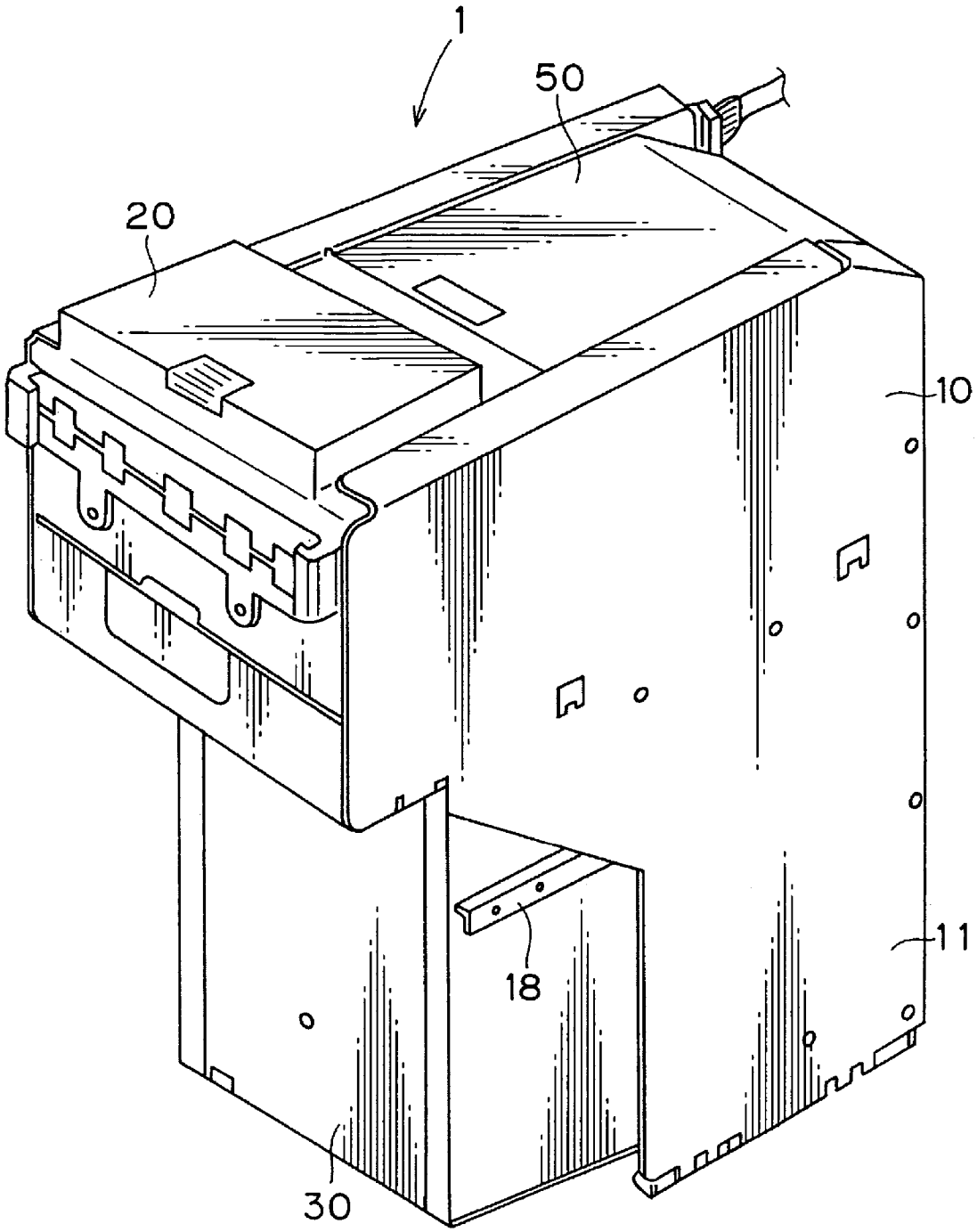
FIG. 1 is a perspective view of the exterior appearance of a paper sheet handling apparatus according to a first embodiment of the present invention.
Figure 2:
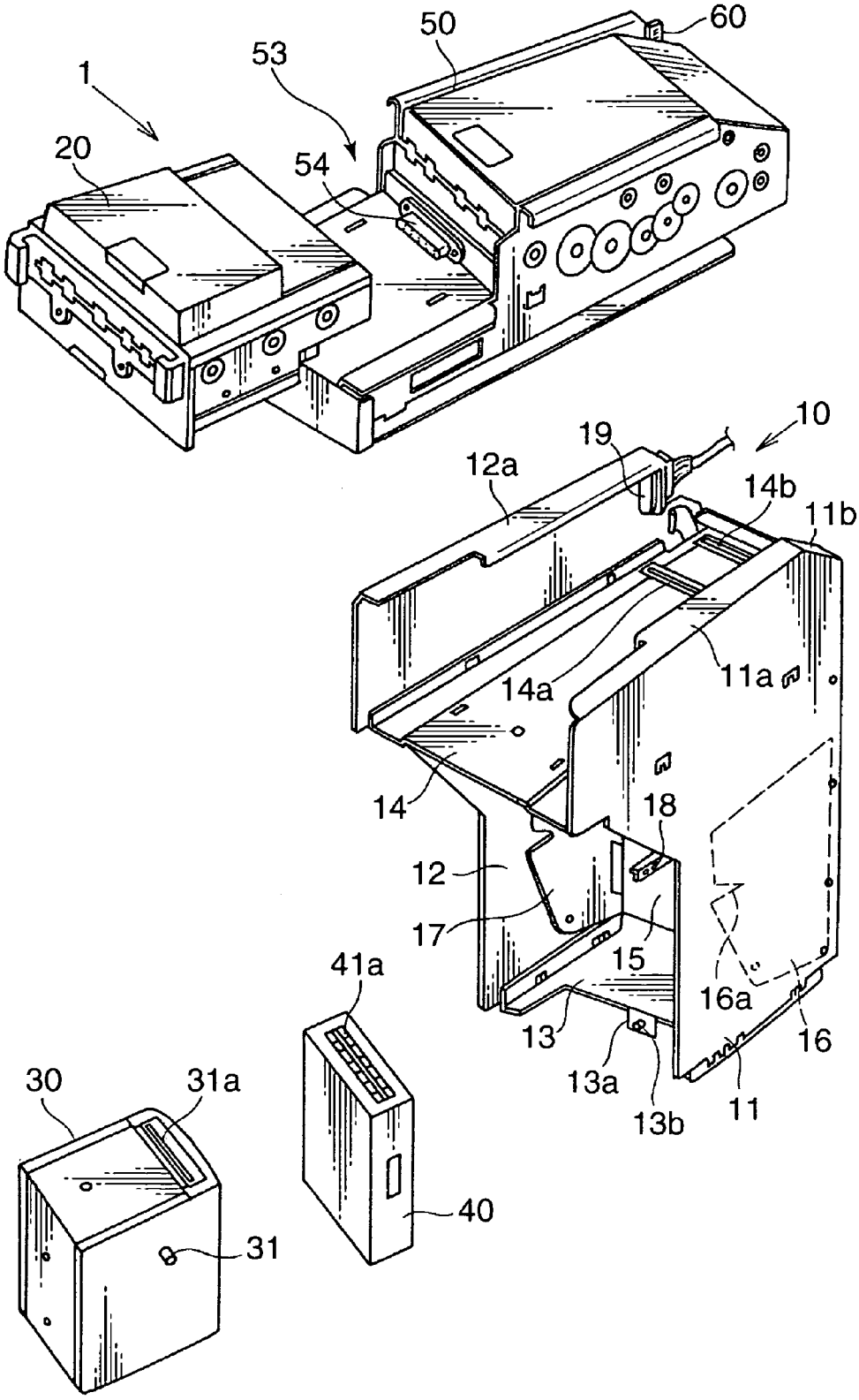
FIG. 2 is a perspective exploded view of the paper sheet handling apparatus according to the first embodiment.
Figure 3:
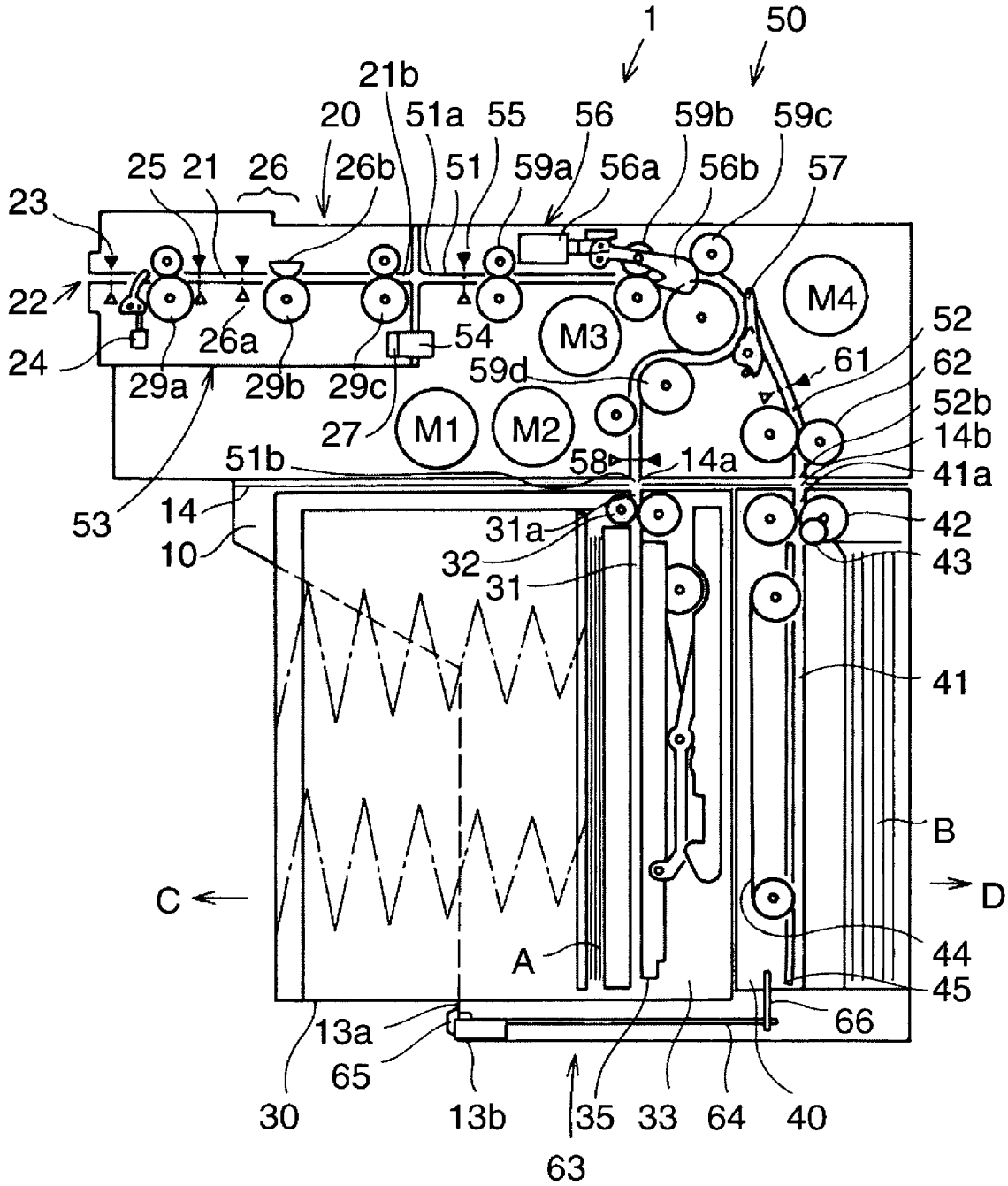
FIG. 3 is a right-side sectional view of the paper sheet handling apparatus according to the first embodiment.

FIG. 1 is a perspective view of the exterior appearance of a paper sheet handling apparatus according to this embodiment FIG. 2 is a perspective exploded view of that paper sheet handling apparatus. FIG. 3 is a right-side sectional view of the paper sheet handling apparatus.

This paper sheet handling apparatus 1 includes an outer frame 10, an identifying unit 20, a collecting unit 30, a paying-out unit 40, and a forwarding unit 50. It has a basic configuration in which a paper sheet A identified by the identifying unit 20 is sent to the collecting unit 30 through a first paper sheet forwarding line 51 of the forwarding unit 50, and a paper sheet B identified by the identifying unit 20 is sent to the paying-out unit 40 through a second paper sheet forwarding line 52 of the forwarding unit 50. Herein, the paper sheets A and B denote every paper sheet, including a bank note, a card, a coupon ticket, or the like. Reference characters A, B mean that they are a different type of paper sheet from each other when identified by the identifying unit 20. If a paper sheet is mentioned which needs to be distinguished from these paper sheets A, B, then a description will be given using a reference character, as described later. However, with respect to how the paper sheets A, B are forwarded, such forwarding as mentioned later is also conducted, in addition to the above described basic configuration.

The outer frame 10 includes: two side plates 11, 12 which are placed a certain distance apart from each other; a bottom plate 13 which is placed between both side plates 11 and 12 and at its bottom; a shelf plate 14 which is placed above the bottom plate 13, in a lower position than the upper end and between both side plates 11 and 12; and a rear plate 15 which is placed between the shelf plate 14 and the bottom plate 13 and between both side plates 11 and 12. To the right-hand side plate 11, a support member 16 is attached on its inside, and to the left-hand side plate 11, a support member 17 is attached on its inside. The right-hand support member 16 is provided with a lever 18.

Figure 4A:
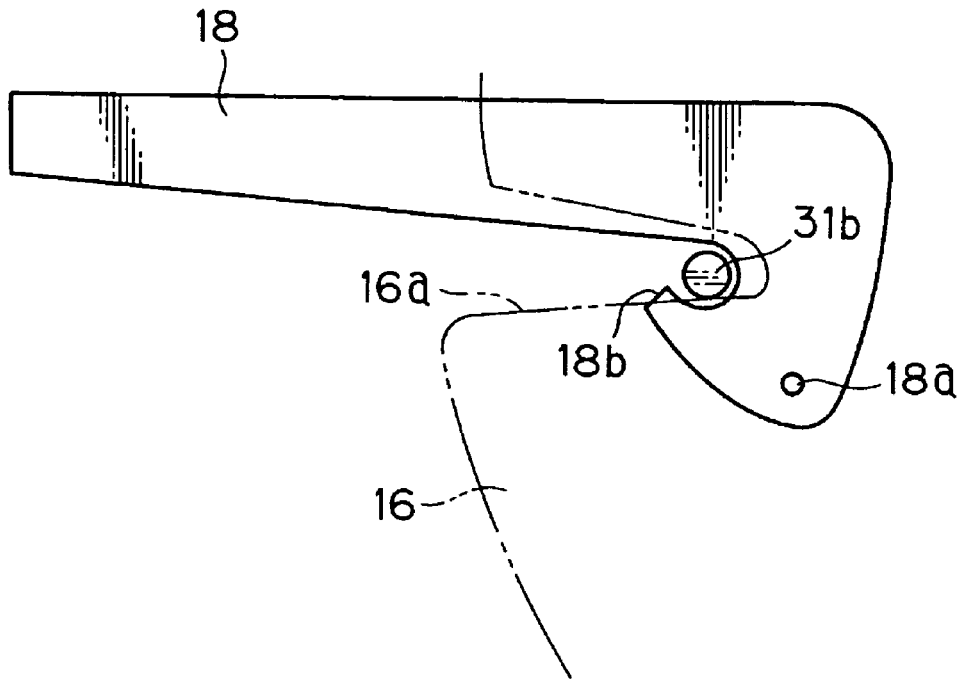
FIG. 4 is an explanatory view of a hooking device for hooking a collecting unit provided in the paper sheet handling apparatus according to the first embodiment.
Figure 4B:
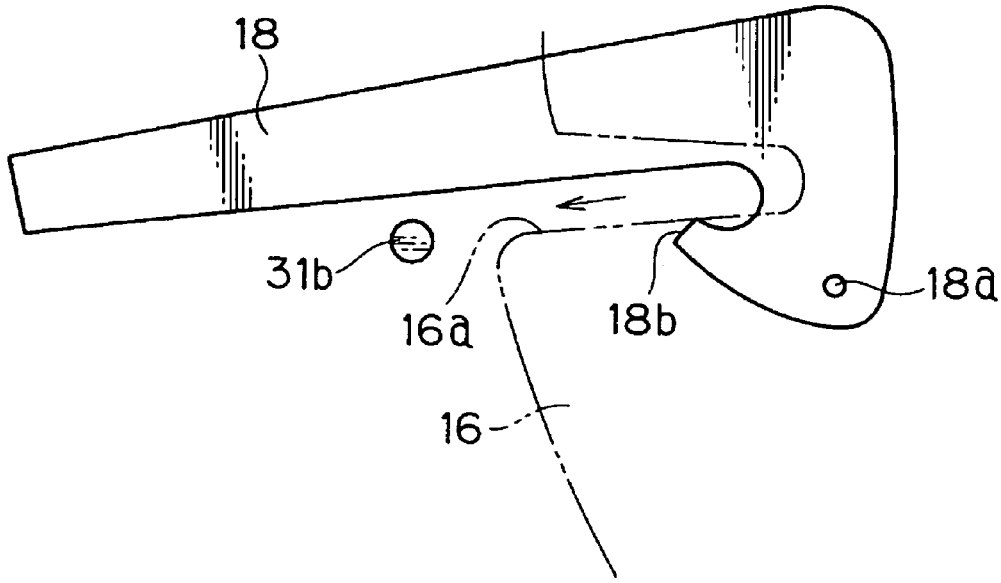

The above described lever 18, as shown in FIG. 4A, is supported with the right-hand support member 16, so as to turn around a horizontal shaft 18*a* provided in its inner part. It can swing from the horizontal position, as shown in FIG. 4B, to a position in which its tip inclines downward. Even if an operation is conducted so that it comes to the inclined position, the lever 18 is configured to return to the horizontal position by the tensile force of a helical extension spring (not shown). Near the horizontal shaft 18*a*, a hook portion 18*b* is formed which protrudes upward from the lower side. When the lever 18 is in the horizontal position, the hook portion 18*b* protrudes upward from an inclined portion 16*a* (refer to FIG. 2 and FIG. 4) formed in the support member 16. On the other hand, when the lever 18 is in the inclined position, it is at the same height as, or lower than, the inclined portion 16*a*.

Therefore, as shown in FIG. 4B, the lever 18 is pushed down against the tensile force of the helical extension spring, and in this state, a hook pin 31*b* provided in the side plane of the collecting unit 30 is brought onto the inner side from the hook portion 18*b*. Thereafter, when the lever 18 is released, as shown in FIG. 4A, the tip of the hook portion 18*b* protrudes upward from the inclined portion 16*a*, and the hook pin 31*b* is hooked. Thus, the collecting unit 30 is attached between the shelf plate 14 and the bottom plate 13 of the outer frame 10, with keeping a space from the rear plate 15. If its reverse operation is conducted, the collecting unit 30 can be collected from the outer frame 10. When the collecting unit 30 is kept attached to the outer frame 10, an inlet 31*a* (refer to FIG. 2 and FIG. 3) of a paper sheet forwarding line 31, which is placed in the up-and-down directions inside of the collecting unit 30, corresponds to an opening 14*a* formed in the shelf plate 14.

The above described space is large enough to house the paying-out unit 40. Inside of the space, the paying-out unit 40 is inserted and attached from the front side of the outer frame 10. In this attachment state, an inlet 41*a* (refer to FIG. 2 and FIG. 3) of a paper sheet forwarding line 41, which is placed in the up-and-down directions inside of the paying-out unit 40, corresponds to an opening 14*b* formed in the shelf plate 14.

Figure 5:
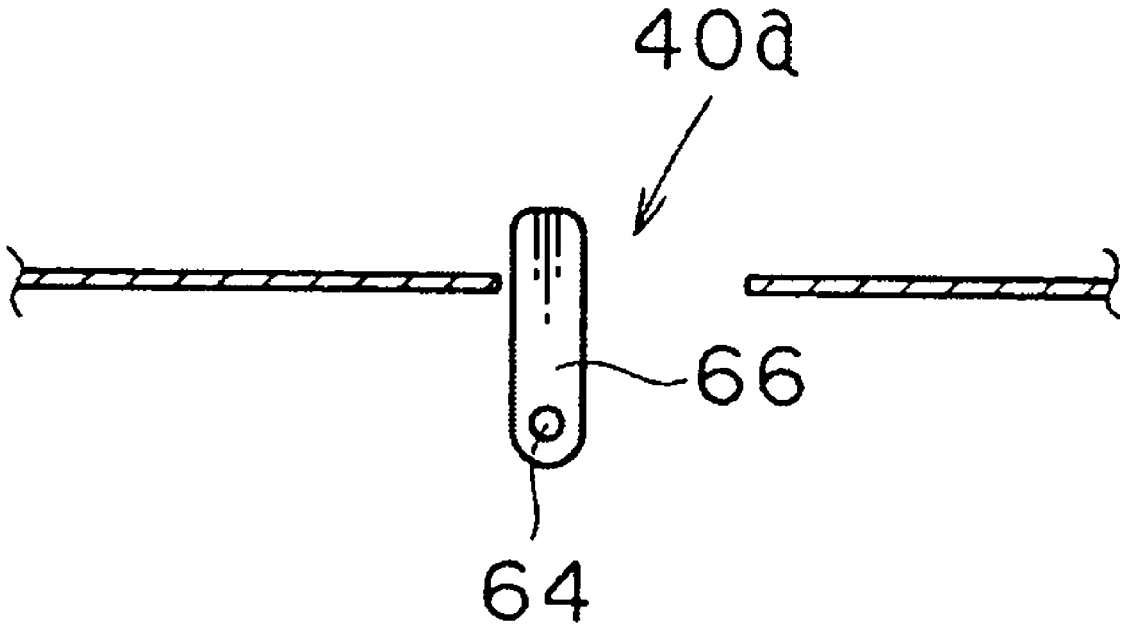
FIG. 5 is an explanatory view showing the engagement between a locking device and the collecting unit which are provided in the paper sheet handling apparatus according to the first embodiment.

In the bottom plate 13, a locking device 63 is provided which prevents the paying-out unit 40 from being detached. This locking device 63 includes: a rod 64 which passes through a penetrating hole 13*b* formed in a hanging strip 13*a* that is bent downward at the front plane part of the bottom plate 13; a key portion 65 which is fixed ahead of the penetrating hole 13*b* of the rod 64; and a rectangular lock strip 66 which is fixed on the rear end of the rod 64. This lock strip 66 turns the key portion 65, using a key (not shown), in a predetermined direction. As shown in FIG. 5, therefore, it goes into a long hole 40*a* formed at the bottom of the paying-out unit 40, thereby preventing the paying-out unit 40 from being detached. If it is turned in the opposite direction, it comes out of the long hole 40*a*, thus allowing the paying-out unit 40 to be detached.

To the shelf plate 14 of the outer frame 10, the forwarding unit 50 is attached thereon. The identifying unit 20 is attached to a cutoff portion 53 formed in the front upper part of this forwarding unit 50.

The forwarding unit 50 is attached to the outer frame 10 by sliding the forwarding unit 50 from front to back on the shelf plate 14. The forwarding unit 50 is prevented from coming off upward, using bent portions 11*a*, 12*a* which are formed by bending inside the upper edges of both side plates 11, 12. On the other hand, using an inclined portion 11*b* provided in the rear-end part of the right-hand side plate 11, it is prevented from coming off backward. At this time, a connector 60 provided on the rear-plane side of the forwarding unit 50 is connected to a connector 19 provided in the left-hand side plate 12. In addition, an outlet 51*b* (refer to FIG. 3), which is formed inside of the forwarding unit 50 and is placed downward in the first paper sheet forwarding line 51 that supplies the paper sheet A to the collecting unit 30, corresponds to the opening 14*a* of the shelf plate 14. Thus, the first paper sheet forwarding line 51 leads to the paper sheet forwarding line 31 of the collecting unit 30. Moreover, an outlet 52*b* (refer to FIG. 3), which is formed inside of the forwarding unit 50 and is placed downward in the second paper sheet forwarding line 52 that branches off from a midway part of the first paper sheet forwarding line 51 that supplies the paper sheet B to the paying-out unit 40, corresponds to the opening 14*b* of the shelf plate 14. Thus, the second paper sheet forwarding line 52 leads to the paper sheet forwarding line 41 of the paying-out unit 40. Oppositely, if the forwarding unit 50 is removed from the outer frame 10, the connectors 60 and 19 become unconnected.

The identifying unit 20 is attached to the outer frame 10 by sliding the identifying unit 20 from front to back on the cutoff portion 53 of the forwarding unit 50. The identifying unit 20 is prevented from coming off upward, using the above described bent portions 11*a*, 12*a*. At this time, a connector 27 (refer to FIG. 3) provided on the rear-plane side of the identifying unit 20 is connected to a connector 54 provided in the cutoff portion 53. In addition, an outlet 51*b* (refer to FIG. 3), which is formed inside of the identifying unit 20 and is provided in a paper sheet forwarding line 21 that supplies the paper sheet A to the forwarding unit 50, corresponds to an inlet 51*a* of the first paper sheet forwarding line 51 of the forwarding unit 50. Thus, the paper sheet forwarding line 21 leads to the paper sheet forwarding line 51 of the forwarding unit 50. Oppositely, if the identifying unit 20 is removed from the outer frame 10, the connectors 54 and 27 becomes unconnected.

As described above, in the outer frame 10, as shown in FIG. 3, the identifying unit 20 is housed on its upper-front side; the forwarding unit 50, in the upper part; the collecting unit 30, on the lower-front side; and the paying-out unit 40, on the lower-rear side. In addition, the paper sheet forwarding line 21 of the identifying unit 20, the first paper sheet forwarding line 51 of the forwarding unit 50, and the paper sheet forwarding line 31 of the collecting unit 30, are connected. And the paper sheet forwarding line 21, the second paper sheet forwarding line 52 of the forwarding unit 50, and the paper sheet forwarding line 41 of the paying-out unit 40, are connected.

Next, a function of the paper sheet handling apparatus 1 configured in this way will be described.

This paper sheet handling apparatus 1 is configured so that the paper sheet A which has been brought in from an opening portion 22 for insertion and paying-out that is formed in its front plane is identified by the identifying unit 20. If the identified paper sheet A is a regular paper sheet and is not the paper sheet B, it is stored in the collecting unit 30 for its collection; if it is the regular paper sheet B, in the paying-out unit 40 for the paying-out. If the identified paper sheet A is a counterfeit paper sheet, it is returned to the opening portion 22 and the paying-out paper sheet B is paid out to the opening portion 22 from the paying-out unit 40 when paid out; or if the paying-out paper sheet B is not a predetermined amount, it is collected for its collection by the collecting unit 30. Herein, the opening portion 22 is used both for inserting and paying out a paper sheet.

Hereinafter, the configuration of each part of the paper sheet handling apparatus 1 will be specifically described.

The identifying unit 20 is well shorter than the shortest one of a plurality of paper sheets which belongs to the paper sheet A. For example, it has about half the length of the shortest paper sheet. When identified, the front end of the paper sheet A is located inside of the forwarding unit 50. The identifying unit 20 is provided with: an inlet sensor 23 which detects the paper sheet A being cast into the opening portion 22 that is an inlet, along the paper sheet forwarding line 21; an inlet shutter 24 which prevents the paper sheet A from being continuously inserted and also prevents the paying-out paper sheet B from being heedlessly paid out; a passage sensor 25; and an identification sensor portion 26. The passage sensor 25 detects the paper sheet A reaching the identification sensor portion 26. The identification sensor portion 26 is provided with a passage sensor 26*a* and an identification sensor 26*b*. The passage sensor 26*a* detects the front end of the paper sheet A to operate the identification sensor 26*b*. Then, it detects the paper sheet A passing to complete the detection of the identification sensor 26*b*. The identification sensor 26*b* identifies the money type and genuineness of the inserted paper sheet A. In addition, this identification sensor 26*b* identifies the paying-out paper sheet B which is paid out to the opening portion 22 from the paying-out unit 40. With respect to how the identification sensor 26*b* identifies a paper sheet, various methods can be used.

The forwarding unit 50 is provided with: a feed-in sensor 55 which detects the paper sheet A being supplied from the side of the inlet 51*a*, along the first paper sheet forwarding line 51; an extraction prevention lever 56 for preventing misconduct which prevents the paper sheet A from being pulled out toward the side of the opening portion 22; a sorting shutter 57 which switches and forwards the paper sheet A to one of the sides of the paper sheet forwarding lines 51 and 52; and a feed-out sensor 58 which detects the paper sheet A being carried out. The extraction prevention lever 56 is driven by a solenoid 56*a*. When the paper sheet A is forwarded from front to inside, its front end 56*b* moves up, and it moves down when it passes. The sorting shutter 57 is driven by a solenoid (not shown). When the paper sheet A is forwarded to the collecting unit 30, the second paper sheet forwarding line 52 is shut. On the other hand, the paper sheet B is forwarded to the paying-out unit 40, the first paper sheet forwarding line 51 is shut.

Along the paper sheet forwarding line 21, a pair of rollers 29*a*, a roller 29 band a pair of rollers 29*c* are provided. Along the paper sheet forwarding line 51, a pair of rollers 59*a*, 59*b*, 59*c* and 59*d* are provided. In addition, the paper sheet forwarding line 31 is provided with a pair of rollers 32. Along the second paper sheet forwarding line 52, there are provided a double-ticket detection sensor 61 which detects two paper sheets being sent together, and a pair of rollers 62. Moreover, a pair of rollers 42, a separation roller 43 and a forwarding belt 44 are provided along the paper sheet forwarding line 41.

The above described pair of rollers 29*a*, 29*c*, 59*a*, 59*b*, 59*c*, 59*d*, 32 and 62, and roller 29*b* are driven by a forwarding motor M2 provided in the forwarding unit 50 and a gear mechanism (not shown). On the other hand, the above described pair of rollers 42, the separation roller 43 and forwarding belt 44 are driven by a forwarding motor M4 provided in the forwarding unit 50 and a gear mechanism (not shown). A paper sheet is forwarded by revolving each forwarding motor M2, M4 in the normal or reverse direction. Specifically, if the paper sheet A identified by the identification sensor portion 26 is a regular paper sheet and is not the paper sheet B, the forwarding motor M2 is driven to forward the paper sheet A to the collecting unit 30 for its collection. On the other hand, if the paper sheet A is identical with the paying-out paper sheet B, the forwarding motors M2 and M4 are driven to forward the paper sheet A to the paying-out unit 40 for its paying-out. If the paper sheet A is a counterfeit paper sheet from the result of the identification, the forwarding motor M2 is reversed to return the paper sheet A to the opening portion 22. On the other hand, if the paying-out paper sheet B is paid out, the forwarding motor M4 is reversed to forward the paying-out paper sheet B from the paying-out unit 40 to the forwarding unit 50. In addition, the forwarding motor M2 is reversed to pay out the paying-out paper sheet B to the opening portion 22. Or if the paying-out paper sheet B is not a predetermined paper sheet from the result of the identification by the identification sensor 26*b*, the paying-out paper sheet B is forwarded for its collection to the collecting unit 30. In short, a forwarding device (or each such roller as described above) which corresponds to the paying-out unit 40 is driven by the forwarding motor M4, while the other forwarding device is driven by the forwarding motor M2.

In the collecting unit 30, a publicly-known push-in mechanism 33 is provided, and in the paying-out unit 40, a publicly-known push-in mechanism (not shown) is also provided. The push-in mechanism 33 is driven by a stack motor M1 and a gear mechanism (not shown) which are provided in the forwarding unit 50. And a stack plate 35 is provided which stacks the paper sheet A in the direction of an arrow C. On the other hand, the push-in mechanism provided in the paying-out unit 40 is driven by a stack motor M3 and a gear mechanism (not shown) which are provided in the forwarding unit 50. And a stack plate 45 is provided which stacks the paper sheet B in the direction of an arrow D. The position of each such stack plate 35, 45 as described above is changed by each stack motor M1, M3. Specifically, they are moved in the direction where they are apart from each other, and reach a push-in position in which the stored paper sheet A, paper sheet B are pushed in. Also, they are moved in the direction where they come close to each other, and reach an acceptance position in which each paper sheet can be accepted. The position of each stack plate 35, 45, which is changed in such a way as described above, can be detected. Each such stack plate 35, 45 is kept in the push-in position at an ordinary time (or when each processing mentioned later is not yet executed). This keeps the paper sheet A or B which is stored in the collecting unit 30 or the paying-out unit 40, from being unjustly taken out. Moreover, the stack plate 45 of the paying-out unit 40 is moved to the acceptance position, and in that state, the forwarding belt 44 is configured to forward the paper sheet B stored in the paying-out unit 40 to the side of the opening portion 22 by the drive of the forwarding motor M4. Herein, as the push-in mechanism 33 and the push-in mechanism of the paying-out unit 40, for example, a pusher or the like shown in Japanese Patent Laid-Open No. 9-16829 may be used.

The paper sheet handling apparatus 1 configured in this way includes a controller (not shown) which controls each of the above described component elements. Based on the following steps by the control of this controller, it accepts the paper sheet A inserted from the opening portion 22.

Figure 6:
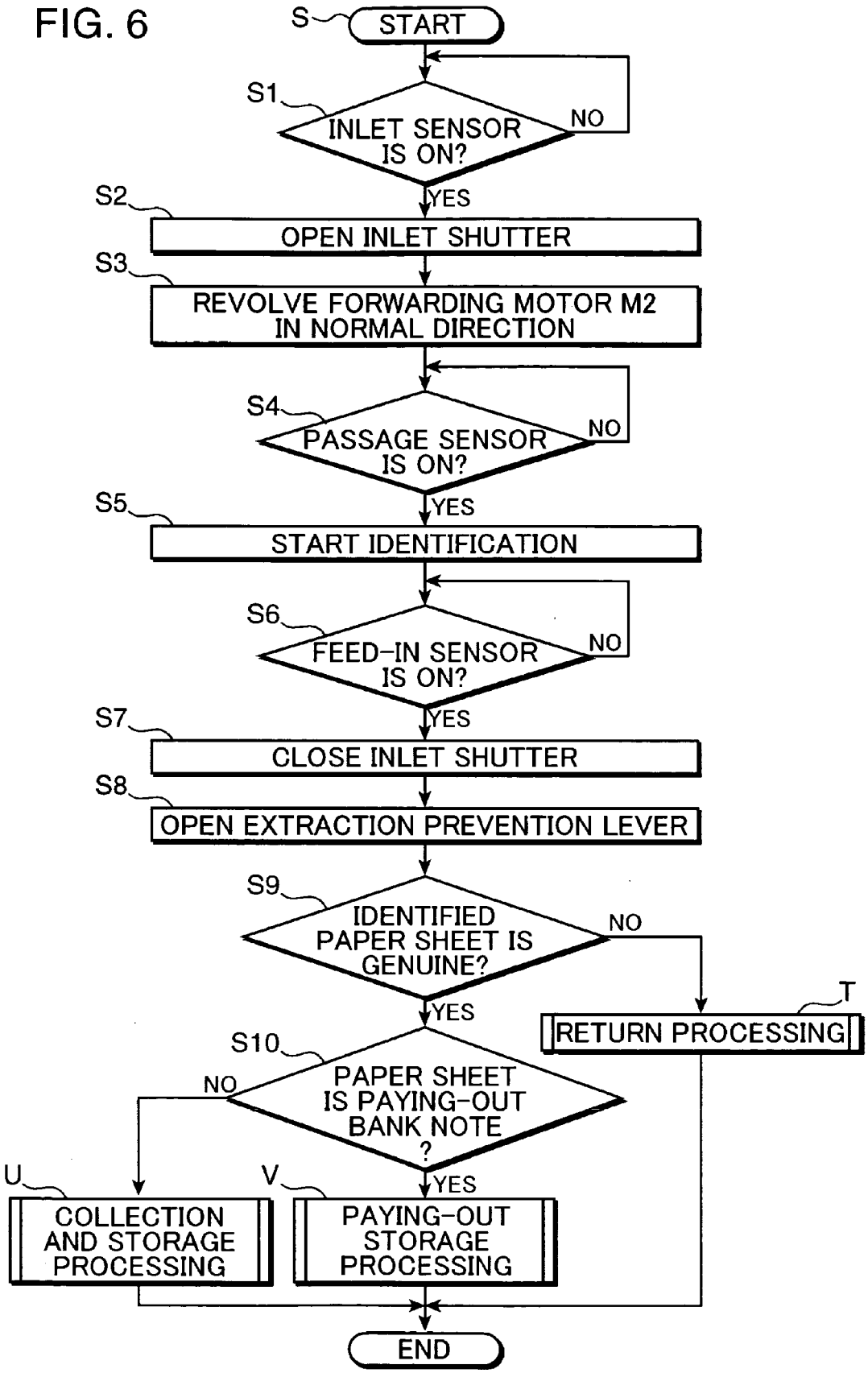
FIG. 6 is a main routine, showing acceptance processing of the paper sheet handling apparatus according to the first embodiment.

FIG. 6 is a main routine, showing acceptance processing of the paper sheet handling apparatus 1 according to the first embodiment.

With reference to FIG. 3 and FIG. 6, an acceptance processing S starts when the inlet sensor 23 detects a paper sheet inserted by a user (hereinafter, the state in which each sensor has detected the paper sheet A in this way is shown as ON). If the inlet sensor 23 is OFF (or NO at Step S1), Step S1 is repeatedly executed. On the other hand, if the inlet sensor 23 is ON (or YES at Step S1), the inlet shutter 24 is opened (in Step S2). If the inlet shutter 24 is opened, normal revolutions of the forwarding motor M2 (or its drive to the direction in which the paper sheet A is forwarded into the paper sheet handling apparatus 1) is started (in Step S3) to forward the paper sheet A along the paper sheet forwarding line 21. Next, judgment is made whether or not the paper sheet A forwarded in this way has turned ON the passage sensor 25 (in Step S4). If the judgment is made that the passage sensor 25 is not ON (or NO at Step S4), Step S4 is repeatedly executed. On the other hand, if the judgment is made that the passage sensor 25 is ON (or YES at Step S4), an identification of the paper sheet A by the identification sensor portion 26 is started (in Step S5). The paper sheet A whose identification has been started continues to be forwarded. Then, judgment is made whether or not its front end has turned ON the feed-in sensor 55 (in Step S6). If the judgment is made that the feed-in sensor 55 is OFF (or NO at Step S6), Step S6 is repeatedly executed. On the other hand, if the judgment is made that the feed-in sensor 55 is ON (or YES at Step S6), the inlet shutter 24 is closed (in Step S7), and the extraction prevention lever 56 is opened (in Step S8). If the extraction prevention lever 56 is opened in this way, the paper sheet A continues to be forwarded, and its identification by the identification sensor 26*b* is completed. From the result of this identification, judgment is made whether or not the paper sheet A is genuine (in Step S9). If the judgment is made that the paper sheet A is not genuine (or NO at Step S9), a return processing T for returning the paper sheet A to the user is executed.

Figure 7:
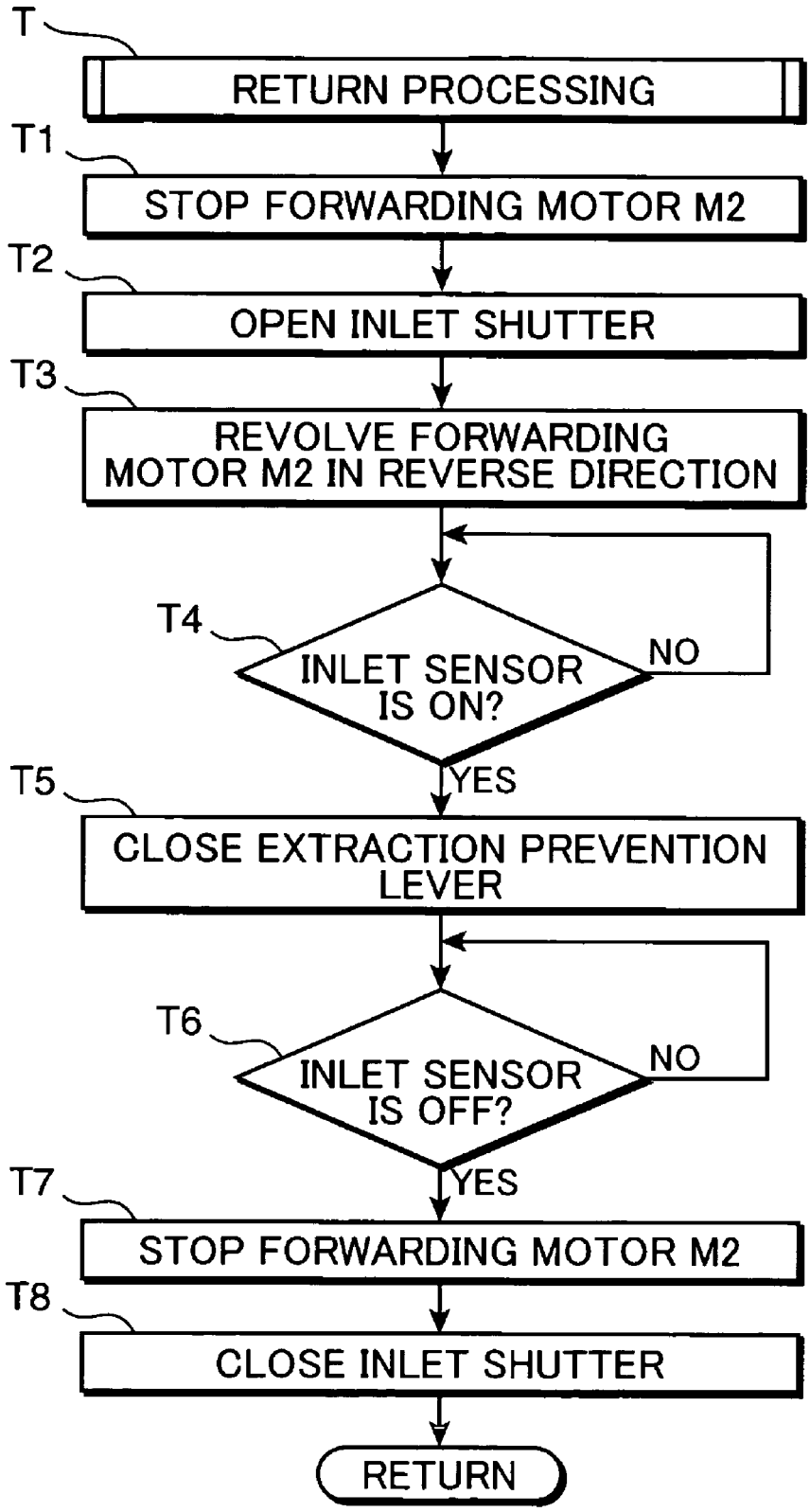
FIG. 7 is a flow chart, showing return processing in the acceptance processing of FIG. 6.

FIG. 7 is a flow chart, showing return processing in the acceptance processing S of FIG. 6.

With reference to FIG. 3 and FIG. 7, when the return processing T is started, the forwarding motor M2 is stopped (in Step T1), and the inlet shutter 24 is opened (in Step T2). Next, reverse revolutions of the forwarding motor M2 (or its drive to the direction in which the paper sheet A is forwarded to the side of the opening portion 22) is started (in Step T3) to forward the paper sheet A to the side of the user. Judgment is made whether or not the paper sheet A forwarded in this way has turned ON the inlet sensor 23 (in Step T4). If the judgment is made that the inlet sensor 23 is OFF (or NO at Step T4), Step T4 is repeatedly executed. On the other hand, if the judgment is made that the inlet sensor 23 is ON (or YES at Step T4), the extraction prevention lever 56 is closed (in Step T5). Next, when the paper sheet A forwarded to the side of the opening portion 22 as described above passes through the inlet sensor 23, judgment is made whether or not the inlet sensor 23 has been turned OFF (in Step T6). If the judgment is made that the inlet sensor 23 is ON (or NO at Step T6), Step T6 is repeatedly executed. On the other hand, if the judgment is made that the inlet sensor 23 is OFF (or YES at Step T6), the forwarding motor M2 is stopped (in Step T7), the inlet shutter 24 is closed (in Step T8), and a return is made to the acceptance processing S (or the processing is completed).

On the other hand, if the judgment is made that the paper sheet A is genuine at Step S9 in the acceptance processing of FIG. 6, judgment is made whether or not the paper sheet A is the paying-out paper sheet B (in Step S10). If the judgment is made that the paper sheet A is not the paying-out paper sheet B (or NO at Step S10), a collection and storage processing U for storing the paper sheet A in the collecting unit 30 is executed.

Figure 8:
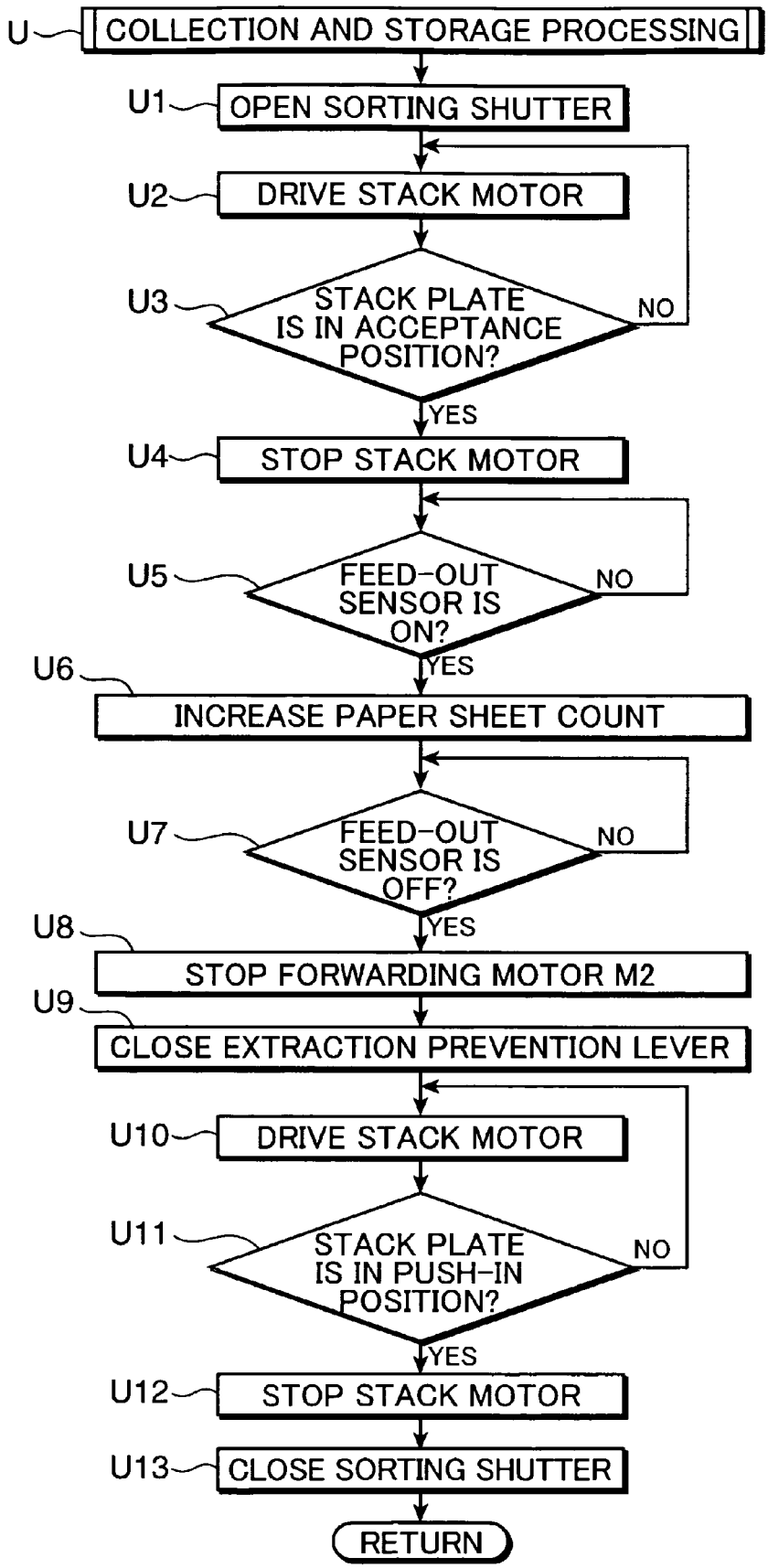
FIG. 8 is a flow chart, showing collection and storage processing in the acceptance processing of FIG. 6.

FIG. 8 is a flow chart, showing the collection and storage processing U in the acceptance processing S of FIG. 6.

With reference to FIG. 3 and FIG. 8, when the collection and storage processing T is started, the above described sorting shutter 57 is opened (in Step U1). Herein, the expression of "opened" shows the state in which the sorting shutter 57 is driven so that the first paper sheet forwarding line 51 leads to the paper sheet forwarding line 31. Oppositely, the state in which the sorting shutter 57 is driven so that the first paper sheet forwarding line 51 leads to the second paper sheet forwarding line 52 will be shown, hereinafter, by the expression of "closed." After the sorting shutter 57 has been opened as described above, the above described stack motor M1 is driven (in Step U2). Then, judgment is made whether or not the stack plate 35 of the collecting unit 30 is in the acceptance position by this drive (in Step U3). If the judgment is made that the stack plate 35 is not in the acceptance position (or NO at Step U3), Step U2 is repeatedly executed. On the other hand, if the judgment is made that the stack plate 35 is in the acceptance position (or YES at Step U3), the stack motor M1 is stopped (in Step U4), and the judgment is made whether or not the feed-out sensor 58 has been turned ON (in Step U5). If the judgment is made that the feed-out sensor 58 is OFF (or NO at Step U5), Step U5 is repeatedly executed. On the other hand, if the judgment is made that the feed-out sensor 58 is ON (or YES at Step U5), a paper sheet count used for the collecting unit 30 increases (in Step U6). Herein, the paper sheet count is a value which shows the number of the paper sheets A that are stored in the collecting unit 30. As described above, every time the feed-out sensor 58 is turned ON, that adds to the paper sheet count. This makes it easy to administer the number of the stored paper sheets A when the collecting unit 30 is collected. After the paper sheet count is increased in this way, the paper sheet A passes through the feed-out sensor 58, and thereby, judgment is made whether or not the feed-out sensor 58 has been turned OFF (in Step U7). If the judgment is made that the feed-out sensor 58 is ON (or NO at Step U7), Step U7 is repeatedly executed. On the other hand, if the judgment is made that the feed-out sensor 58 is OFF (or YES at Step U7), the forwarding motor M2 is stopped (in Step U8), and the extraction prevention lever 56 is closed (in Step U9). Next, the stack motor M1 is driven (in Step U10). Then, judgment is made whether or not the stack plate 35 has been brought to the push-in position by this drive (in Step U11). If the judgment is made that the stack plate 35 is not in the push-in position (or NO at Step U11), Step U10 is repeatedly executed. On the other hand, if the judgment is made that the stack plate 35 is in the push-in position (or YES at Step U11), the stack motor M1 is stopped (in Step U12), the sorting shutter 57 is closed (in Step U13), and a return is made to the acceptance processing S (or the processing is completed).

On the other hand, if the judgment is made that the paper sheet A is not the paying-out paper sheet B at the above described step S10 (refer to FIG. 6), a paying-out storage processing V for storing the paper sheet A in the paying-out unit 40 is executed.

Figure 9:
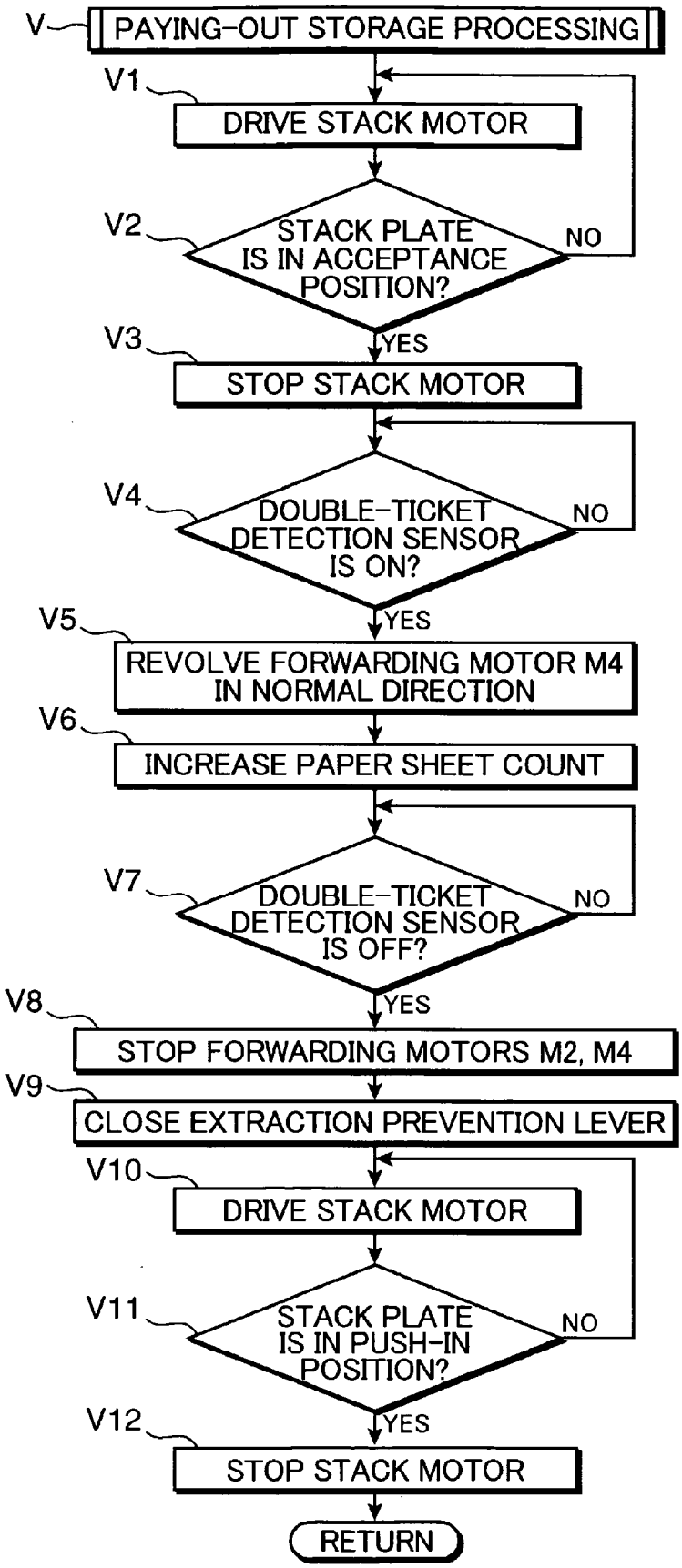
FIG. 9 is a flow chart, showing paying-out storage processing in the acceptance processing of FIG. 6.

FIG. 9 is a flow chart, showing a paying-out storage processing V in the acceptance processing S of FIG. 6.

With reference to FIG. 3 and FIG. 9, when the paying-out storage processing V is executed, the stack motor M3 is driven (in Step V1). Then, judgment is made whether or not the stack plate 45 of the paying-out unit 40 has been brought to the acceptance position by this drive (in Step V2). If the judgment is made that the stack plate 45 is not in the acceptance position (or NO at Step V2), Step V1 is repeatedly executed. On the other hand, if the judgment is made that the stack plate 45 is in the acceptance position (or YES at Step V2), the stack motor M3 is stopped (in Step V3). Then, judgment is made whether or not the above described double-ticket detection sensor 61 has been turned ON (in Step V4). If the judgment is made that the double-ticket detection sensor 61 is OFF (or NO at Step V4), Step V4 is repeatedly executed. On the other hand, if the judgment is made that the double-ticket detection sensor 61 is ON (or YES at Step V4), the forwarding motor M4 is revolved in its normal direction (in Step V5). Then, a paper sheet count used for the paying-out unit 40 increases (in Step V6). Next, the paper sheet B passes through the double-ticket detection sensor 61, and thereby, judgment is made whether or not the double-ticket detection sensor 61 has been turned OFF (in Step V7). If the judgment is made that the double-ticket detection sensor 61 is ON (or NO at Step V7), Step V6 is repeatedly executed. On the other hand, if the judgment is made that the double-ticket detection sensor 61 is OFF (or YES at Step W), the forwarding motors M2 and M4 are stopped (in Step V8), and the extraction prevention lever 56 is closed (in Step V9). Next, the stack motor M3 is driven (in Step V10). Then, judgment is made whether or not the stack plate 45 is has been brought to the push-in position by this drive (in Step V11). If the judgment is made that the stack plate 45 is not in the push-in position (or NO at Step V11), Step V10 is repeatedly executed. On the other hand, if the judgment is made that the stack plate 45 is in the push-in position (or YES at Step V11), the stack motor M3 is stopped (in Step V12), and a return is made to the above described acceptance processing S (or the processing is completed).

As described hereinbefore, the paper sheet handling apparatus 1 is designed to accept the paper sheet A inserted from the opening portion 22 by a user. On the other hand, based on Steps described below, it is designed to pay out the paying-out paper sheet B which is stored in the paying-out unit 40, from the opening portion 22.

Figure 10A:
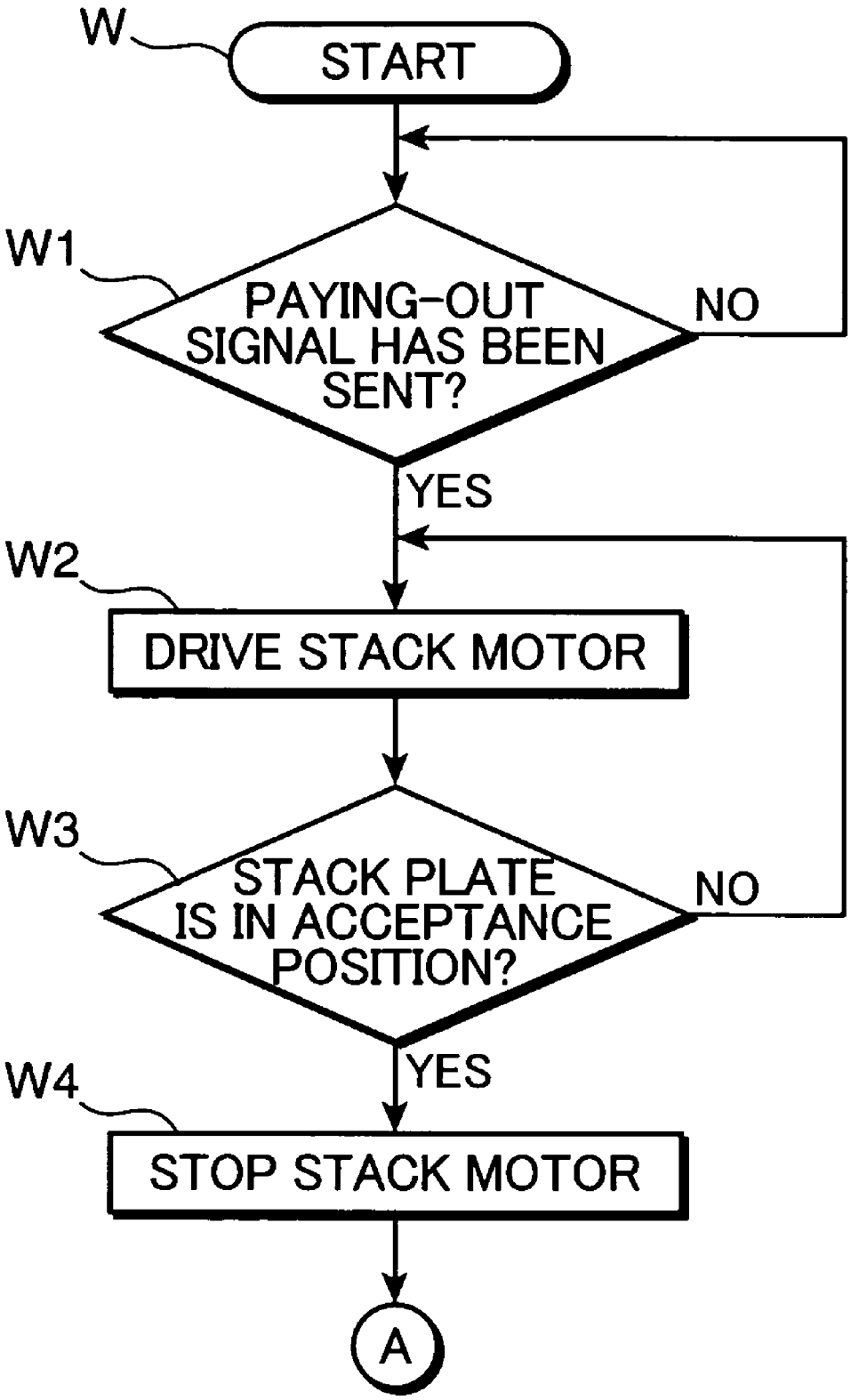
FIG. 10 is a main routine, showing paying-out processing of the paper sheet handling apparatus according to the first embodiment.
Figure 10B:
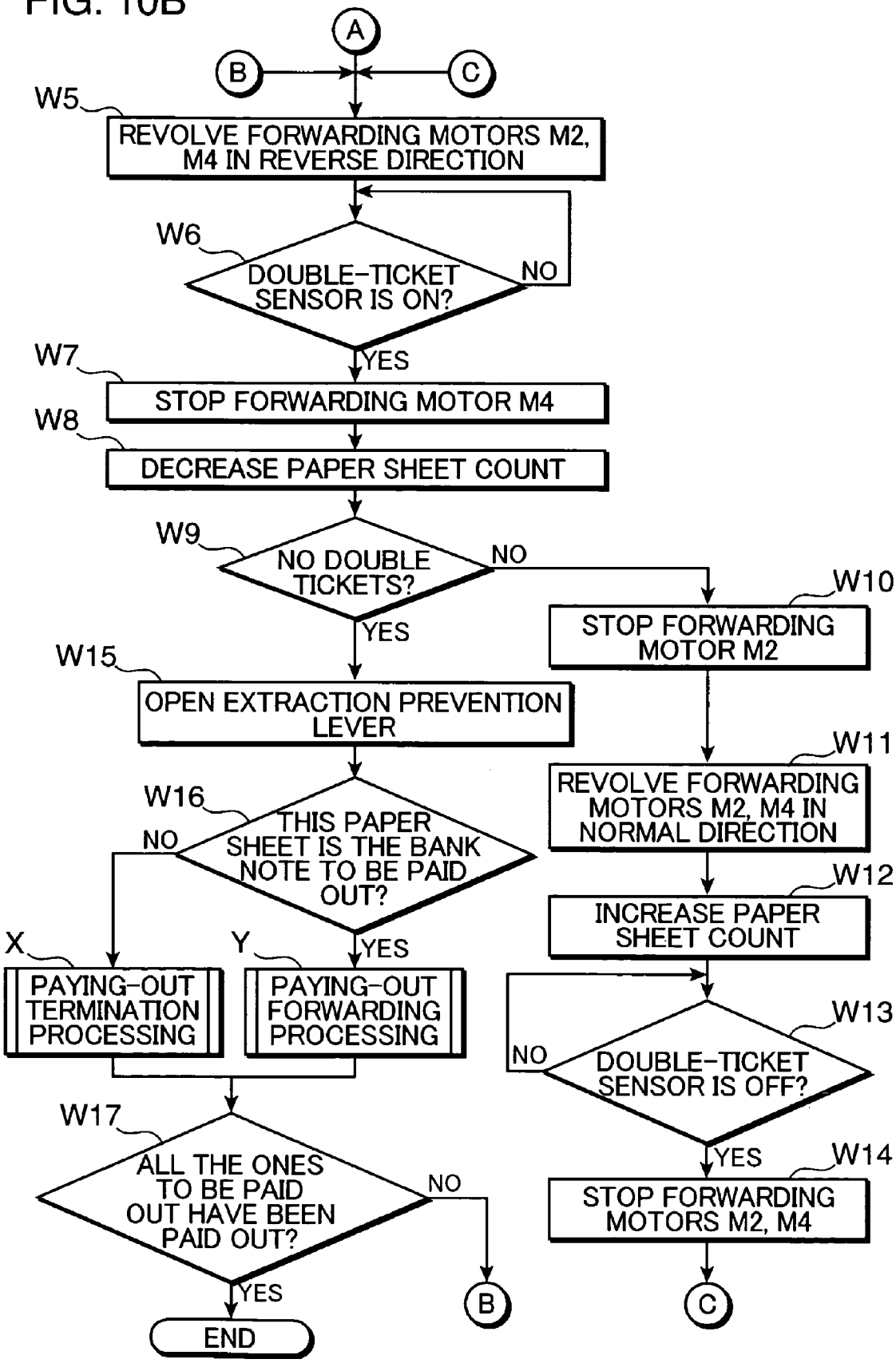

FIG. 10 is a main routine, showing paying-out processing of the paper sheet handling apparatus 1 according to the first embodiment.

With reference to FIG. 3 and FIG. 10, when a predetermined paying-out signal is inputted, a paying-out processing W is started. Herein, the "predetermined paying-out signal" is, for example, in the case where the paper sheet handling apparatus 1 is used for a card-type vending machine, a signal which is generated when a user has inserted a paper sheet required for buying a card, from the opening portion 22. If such a paying-out signal is not inputted (or NO at Step W1), Step W1 is repeatedly executed. On the other hand, If the paying-out signal has been inputted (or YES at Step W1), the stack motor M3 is driven (in Step W2). Then, judgment is made whether or not the stack plate 45 has been brought to the acceptance position by this drive (in Step W3). If the judgment is made that the stack plate 45 is not in the acceptance position (or NO at Step W3), Step W2 is repeatedly executed. On the other hand, if the judgment is made that the stack plate 45 is in the acceptance position (or YES at Step W3), the stack motor M3 is stopped (in Step W4). Next, the forwarding motors M2 and M4 are revolved in their reverse directions (in Step W5), the paying-out paper sheet B starts to be forwarded. Then, judgment is made whether or not this paying-out paper sheet B has turned ON the double-ticket detection sensor 61 (in Step W6). If the judgment is made that the double-ticket detection sensor 61 is OFF (or NO at Step W6), Step W6 is repeatedly executed. On the other hand, if the judgment is made that the double-ticket detection sensor 61 is ON (or YES at Step W6), the forwarding motor M4 is stopped (in Step W7). In addition, the figure of a paper sheet counter used for the paying-out unit 40 decreases (in Step W8). Next, judgment is made by the double-ticket detection sensor 61 whether or not there are double tickets (or paper sheets in layers) among the paying-out paper sheets B (in Step W9). If the judgment is made that there are double tickets among the paying-out paper sheets B (or NO at Step W9), the forwarding motor M2 is stopped (in Step W10). Then, the forwarding motors M2 and M4 are revolved in their normal directions (in Step W11), the figure of the paper sheet counter used for the paying-out unit 40 increases (in Step W12). Next, the paying-out paper sheets B are forwarded to the side of the paying-out unit 40, and pass through the double-ticket detection sensor 61. Thereby, judgment is made whether the double-ticket detection sensor 61 has been turned OFF, or not (in Step W13). If the judgment is made that the double-ticket detection sensor 61 is ON (or NO at Step W13), Step W13 is repeatedly executed. On the other hand, if the judgment is made that the double-ticket detection sensor 61 is OFF (or YES at Step W13), the forwarding motors M2 and M4 are stopped (in Step W14) and Step W5 is repeatedly executed. On the other hand, if the judgment is made that there are not any double tickets among the paying-out paper sheets B in the above described Step W9, the extraction prevention lever 56 is opened (in Step W15). Then, the paying-out paper sheets B are forwarded to the side of the identifying unit 20. Next, judgment is made whether or not the paying-out paper sheet B which has been forwarded to the identifying unit 20 in this way is a paper sheet of the type to be paid out by the identification sensor 26b (in Step W16). If the judgment is made that the paying-out paper sheet B is not a paper sheet of the type to be paid out (or NO at Step W16), a paying-out termination processing X for storing the paying-out paper sheet B in the collecting unit 30 is executed. In other words, the paying-out paper sheet B is treated as the paper sheet A in the following processing.

Figure 11:
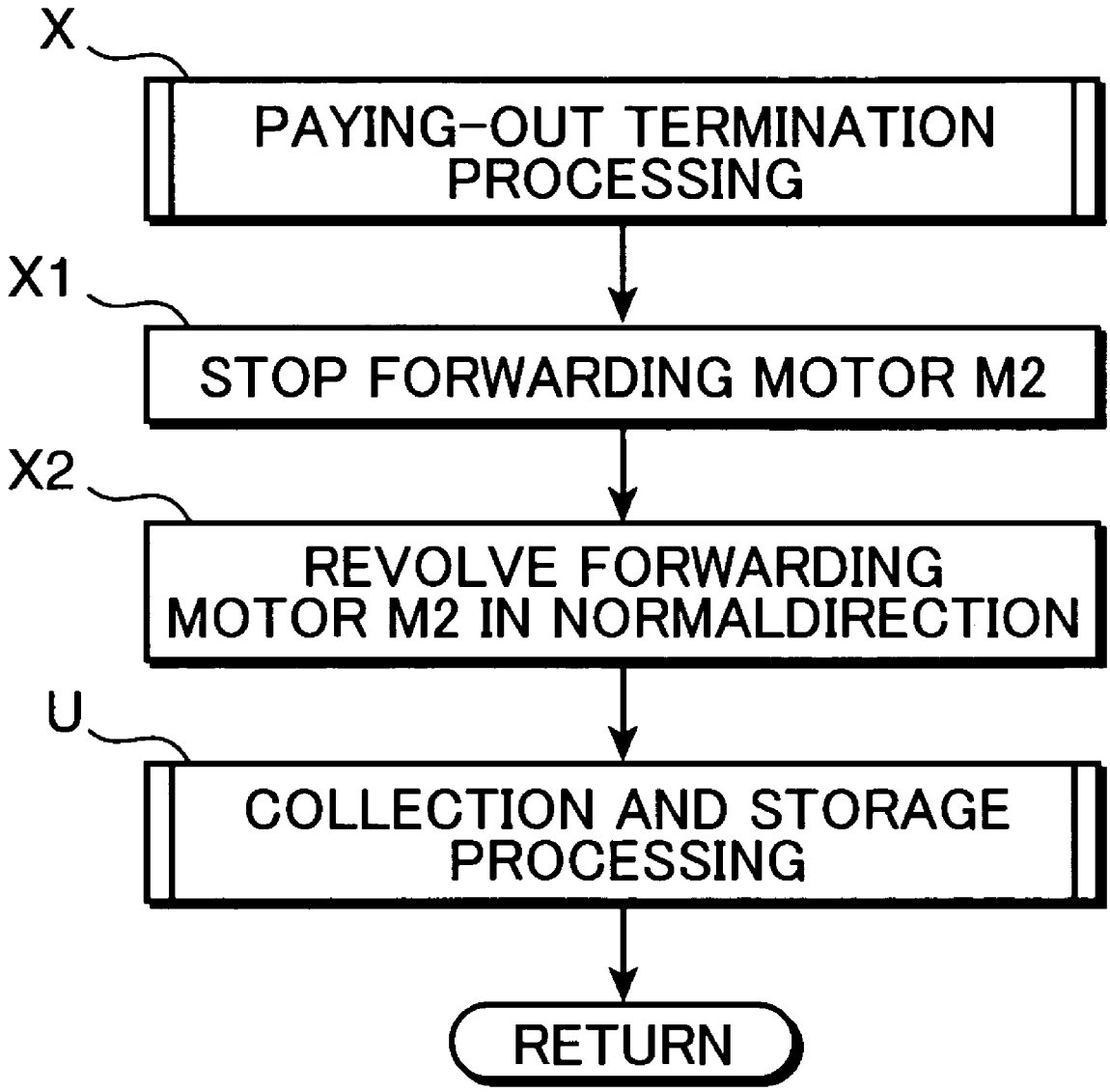
FIG. 11 is a flow chart, showing paying-out termination processing in the paying-out processing of FIG. 10.

FIG. 11 is a flow chart, showing the paying-out termination processing X in the paying-out processing W of FIG. 10.

With reference to FIG. 3 and FIG. 11, when the paying-out termination processing X is executed, the forwarding motor M2 is stopped (in Step X1). Then, the forwarding motor M2 is revolved in its normal direction (in Step X2). The paper sheet A (or the former paper sheet B) forwarded by a normal revolution of the forwarding motor M2 in this way is forwarded to the collecting unit 30. However, this processing is the same as the above described collection and storage processing U, and thus, its description is omitted here. After the collection and storage processing U has been executed, the paying-out termination processing X executes Step W17 of the above described paying-out processing W.

With reference to FIG. 10 again, in Step W17, judgment is made whether or not all the paying-out paper sheets have been paid out in the paying-out processing W (in Step W16). If the judgment is made that the paying-out of all the paper sheets has not been completed (or NO at Step W17), Step W5 is repeatedly executed. On the other hand, if the judgment is made that the paying-out of all the paper sheets has been completed (or YES at Step W17), the paying-out processing is completed.

On the other hand, if the judgment is made that the paper sheet B is a paper sheet of the type to be paid out in Step W16, a paying-out forwarding processing Y for paying out the paying-out paper sheet B to the opening portion 22 is executed.

Figure 12:
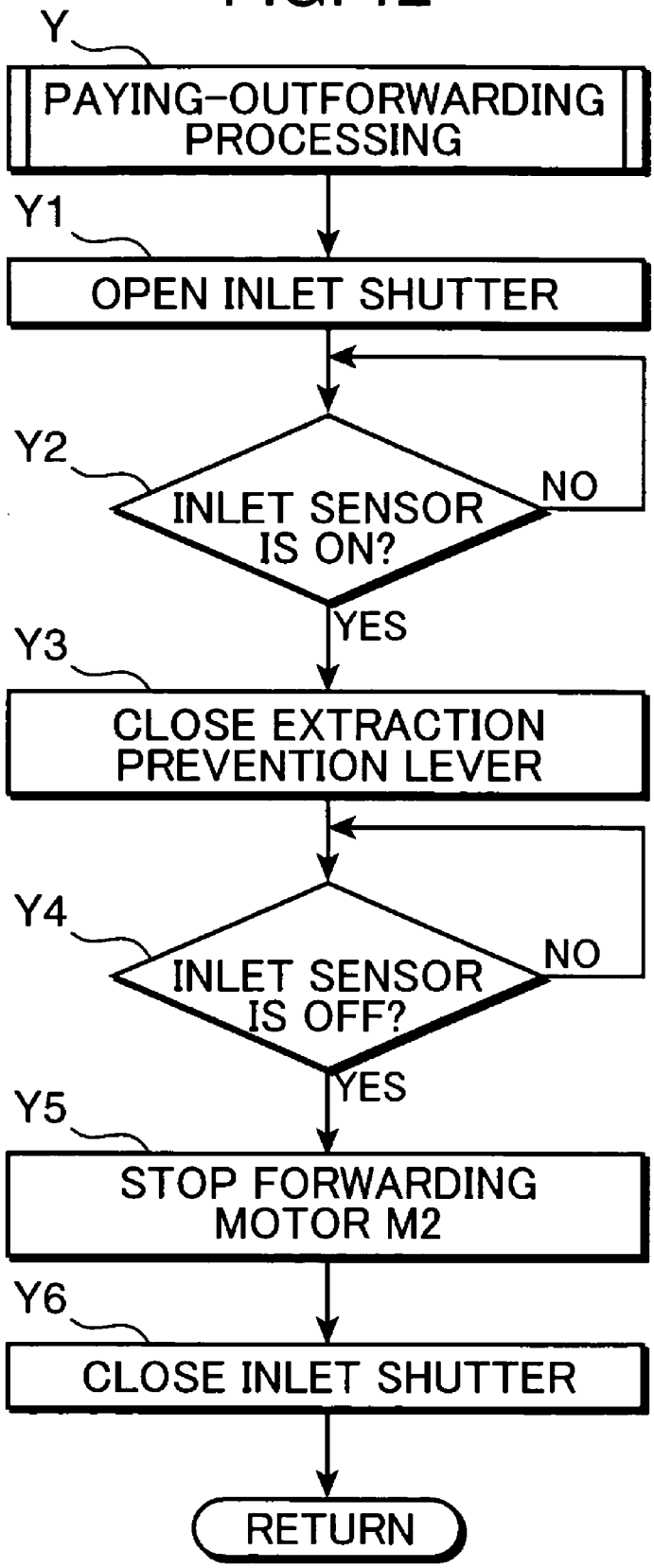
FIG. 12 is a flow chart, showing paying-out forwarding processing in the paying-out processing of FIG. 10.

FIG. 12 is a flow chart, showing the paying-out forwarding processing Y in the paying-out processing W of FIG. 10.

With reference to FIG. 3 and FIG. 12, when the paying-out forwarding processing Y is executed, the above described inlet shutter 24 is opened (in Step Y1), and then, the paper sheet B is forwarded to the opening portion 22. Thereby, judgment is made whether or not the above described inlet sensor 23 have been turned ON (in Step Y2). If the judgment is made that the inlet sensor 23 is OFF (or NO at Step Y2), Step Y2 is repeatedly executed. On the other hand, if the judgment is made that the inlet sensor 23 is ON (or YES at Step Y2), the above described extraction lever 56 is closed (in Step Y3). Next, as described above, the paper sheet B which is forwarded to the side of the opening portion 22 passes through the inlet sensor 23. Thereby, judgment is made whether or not the above described inlet sensor 23 have been turned OFF (in Step Y4). If the judgment is made that the inlet sensor 23 is ON (or NO at Step Y4), Step Y4 is repeatedly executed. On the other hand, if the judgment is made that the inlet sensor 23 is OFF (or YES at Step Y4), the forwarding motor M2 is stopped (in Step Y5), the inlet shutter 24 is closed (in Step Y6), and Step W17 of the above described paying-out processing W is executed.

By the paying-out processing W described above, the paper sheet handling apparatus 1 is designed to pay out the paper sheet B which is stored in the paying-out unit 40, to the side of the opening portion 22.

Accordingly, the following advantages can be obtained according to the first embodiment. The identifying unit 20 and the forwarding unit 50 are disposed in the front-and-rear directions, the collecting unit 30 is disposed below them, and the paying-out unit 40 is disposed on the inner side from the collecting unit 30. This makes the height measurement shorter. On the other hand, the identifying unit 20 and the forwarding unit 50 are disposed in the front-and-rear directions, and the identifying unit 20 forwards and identifies the paper sheet A. Thus, only the identification sensor portion 26 needs to be at least provided for the identifying unit 20. As described earlier, even though the front end of the paper sheet A is located inside of the forwarding unit 50 when identified, that does not constitute any obstacles. This makes it possible to shorten the front-and-rear measurements of the identifying unit 20 and the forwarding unit 50 to their limited measurements, even though there are limitations on the housing space in the front-and-rear directions. In addition, the direction in which a paper sheet is forwarded between the collecting unit 30 and the forwarding unit 50 is set to the up-and-down directions. Thereby, the front-and-rear measurement of the collecting unit 30 can be made as short as possible. This presents ample space on the inner side from the collecting unit 30. In that ample space, the paying-out unit 40 can be placed whose front-and-rear measurement is made shorter by setting the paper sheet forwarding direction between it and the forwarding unit 50 to the up-and-down directions. Therefore, even though the housing space is limited in the front-and-rear directions, the front-and-rear measurements of the collecting unit 30 and the paying-out unit 40 can be made shorter to their limited measurements.

Moreover, to the outer frame 10, the collecting unit 30 and the paying-out unit 40 are attached from its front side so as to be attachable and detachable. Thereby, regardless of the disposition of other units around the place where the paper sheet handling apparatus 1 is housed, the identified paper sheet A that has been stored in the collecting unit 30 can be collected. In addition, the paying-out paper sheet B can be supplied to the paying-out unit 40, thereby making it possible to receive and pay out a paper sheet.

Second Embodiment

Figure 13:
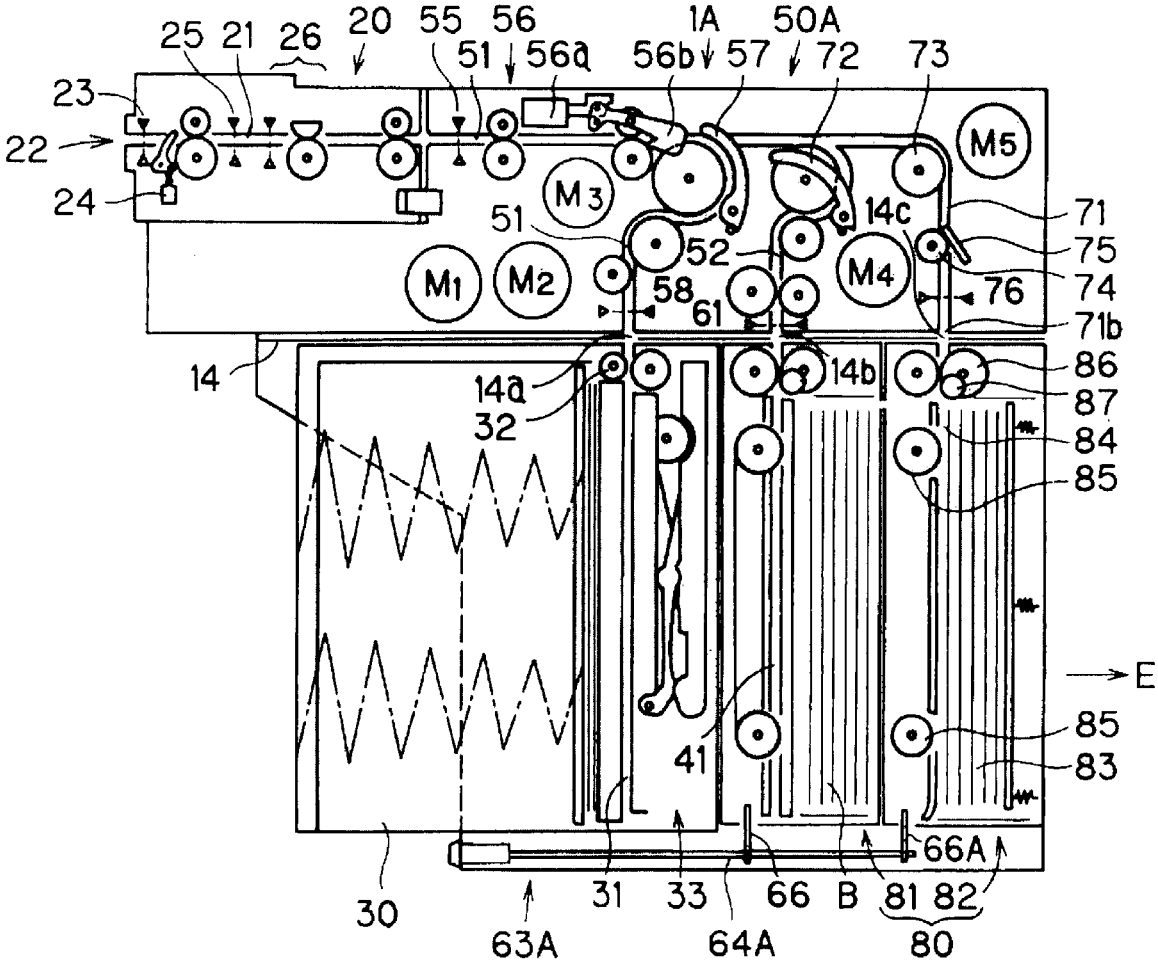
FIG. 13 is a right-side sectional view of a paper sheet handling apparatus according to a second embodiment of the present invention.

FIG. 13 is a right-side sectional view of a paper sheet handling apparatus 1A according to the second embodiment. Herein, its component parts have the same reference numerals as those of those which correspond to FIG. 3.

The paper sheet handling apparatus 1A according to this embodiment is provided with a third paper sheet forwarding line 71, in addition to the above described first paper sheet forwarding line 51 and second paper sheet forwarding line 52, inside of a forwarding unit 50A. A paying-out unit 80 includes two paying-out portions 81, 82. In the third paper sheet forwarding line 71, an outlet 71*b* is formed downward which corresponds to an opening 14*c* behind an opening 14*b* provided in the shelf plate 14. The front paying-out portion 81 is used for paying out a paper sheet, which is configured in the same way as the above described paying-out unit 40. On the other hand, the rear paying-out portion 82 is used for paying out a cut-sheet which undergoes printing when paid out, for example, a blank ticket 83. It can be detached forward, if the collecting unit 30 and the front paying-out portion 81 are removed forward. It is provided inside with a paper sheet forwarding line 84 in the up-and-down directions, a delivery roller 85, a feed roller 86, a separation roller 87, and a push-in mechanism (not shown). This push-in mechanism stacks the blank tickets 83 in the direction of an arrow E. For example, a pusher or the like shown in Japanese Patent Laid-Open No. 9-16829 may be used. Herein, in the state where the paying-out portion 82 is attached to outer frame 10, the paper sheet forwarding line 84 is designed to correspond to the opening 14*c* of the shelf plate 14.

The first paper sheet forwarding line 51 leads to the paper sheet forwarding line 31 of the collecting unit 30. The second paper sheet forwarding line 52 branches off from a midway part of the first paper sheet forwarding line 51, and leads to the paper sheet forwarding line 41 of the front paying-out portion 81. The third paper sheet forwarding line 71 branches off from a midway part of the second paper sheet forwarding line 52, and leads to the paper sheet forwarding line 84 of the rear paying-out portion 82. Herein, a second sorting shutter 72 is provided at the branching part of the second paper sheet forwarding line 52 and the third paper sheet forwarding line 71. The second sorting shutter 72 closes the third paper sheet forwarding line 71 when forwarding the paper sheet B to the paying-out portion 81. It also moves so as to open the third paper sheet forwarding line 71 when forwarding the blank ticket 83 paid out from the paying-out portion 82 to the opening portion 22. Along the third paper sheet forwarding line 71 are provided a roller 73, a platen roller 74, a thermal head 75, and a double-ticket detection sensor 76.

The drive of these roller 73 and platen roller 74, and the above described delivery roller 85, feed roller 86 and separation roller 87, is controlled by a forwarding motor M5. The drive of the above described push-in mechanism is controlled by the stack motor M3 and a gear mechanism (not shown), so that the blank tickets 83 are stacked in the arrow-E direction.

The paying-out portion 82 can be prevented from being, or can be, detached forward by a locking device 63A, in the same operation as the above described locking device 63. Herein, the locking device 63A includes a rod 64*a* which is longer than the locking device 63, and a lock strip 66A which is fixed on its rear end.

The blank ticket 83 stored in the paying-out portion 82 is delivered by the delivery roller 85, is printed at the thermal head 75, and then, is paid out from the opening portion 22.

Accordingly, the following advantages can be obtained according to the second embodiment, in addition to the advantages obtained according to the first embodiment. Two types of paper sheets can be paid out, which are the paying-out paper sheet B and the blank ticket 83. This allows various types of housing equipment to be used, thus increasing the types of housing equipment applicable to the paper sheet handling apparatus 1A. With respect to each paying-out portion 81, 82, the paying-out blank tickets 83 can be supplied to the paying-out portion 82 at their inner part, if the front paying-out portion 81 is detached.

Herein, in the paper sheet handling apparatus 1A according to the second embodiment, three storage portions, such as the collecting unit 30, the paying-out portion 81 and the paying-out portion 82, have to be placed in the front-and-rear directions. Therefore, preferably, it should be used in the case where it has the space that is large enough to place them in the front-and-rear directions.

Figure 14:
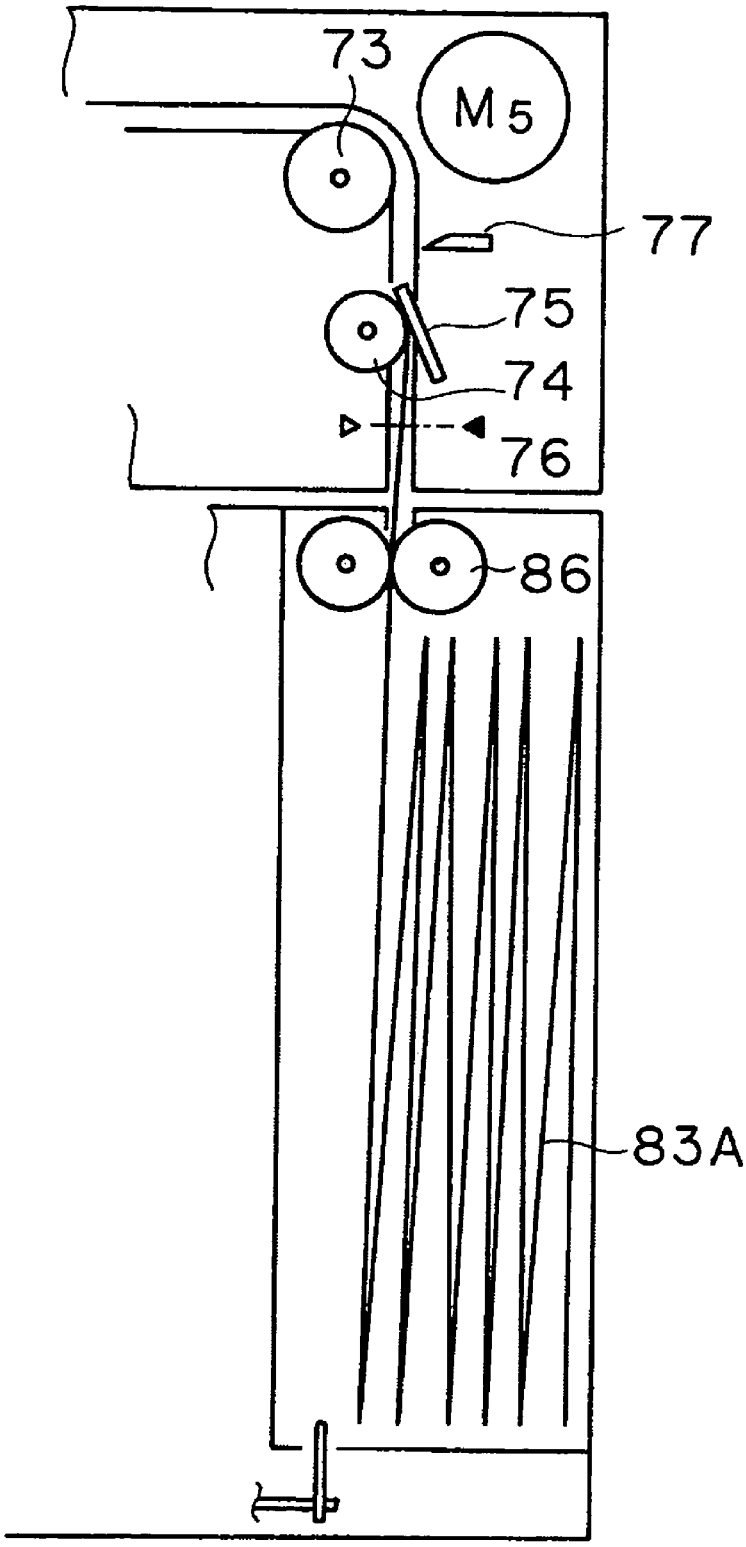
FIG. 14 is a right-side sectional view of the rear part of another paper sheet handling apparatus according to the second embodiment.

Furthermore, according to the above described second embodiment, the blank ticket 83 as a cut-sheet is paid out from the paying-out portion 82. However, the present invention is not limited to this. As shown in FIG. 14, a fan-fold sheet 83A with perforations, or a roll sheet (not shown), which is used as a continuous form, may also be printed at the thermal head 75. In that case, then, it is cut off with a cutter 77 and is paid out from the opening portion 22. At this time, it is preferable that the perforations of the fan-fold sheet 83A, should be monitored, for example, by the double-ticket detection sensor 76, and based on its result, the part of the perforations is cut off, using the cutter 77. With respect to the blank ticket 83, the fan-fold sheet 83A and the roll sheet, various types of them may also be used. For example, a part of it is already printed and only an amount of money is printed at the thermal head 75. Or, a certain kind of design, as well as an amount, is printed on a completely blank sheet of paper.

Third Embodiment

Figure 15:
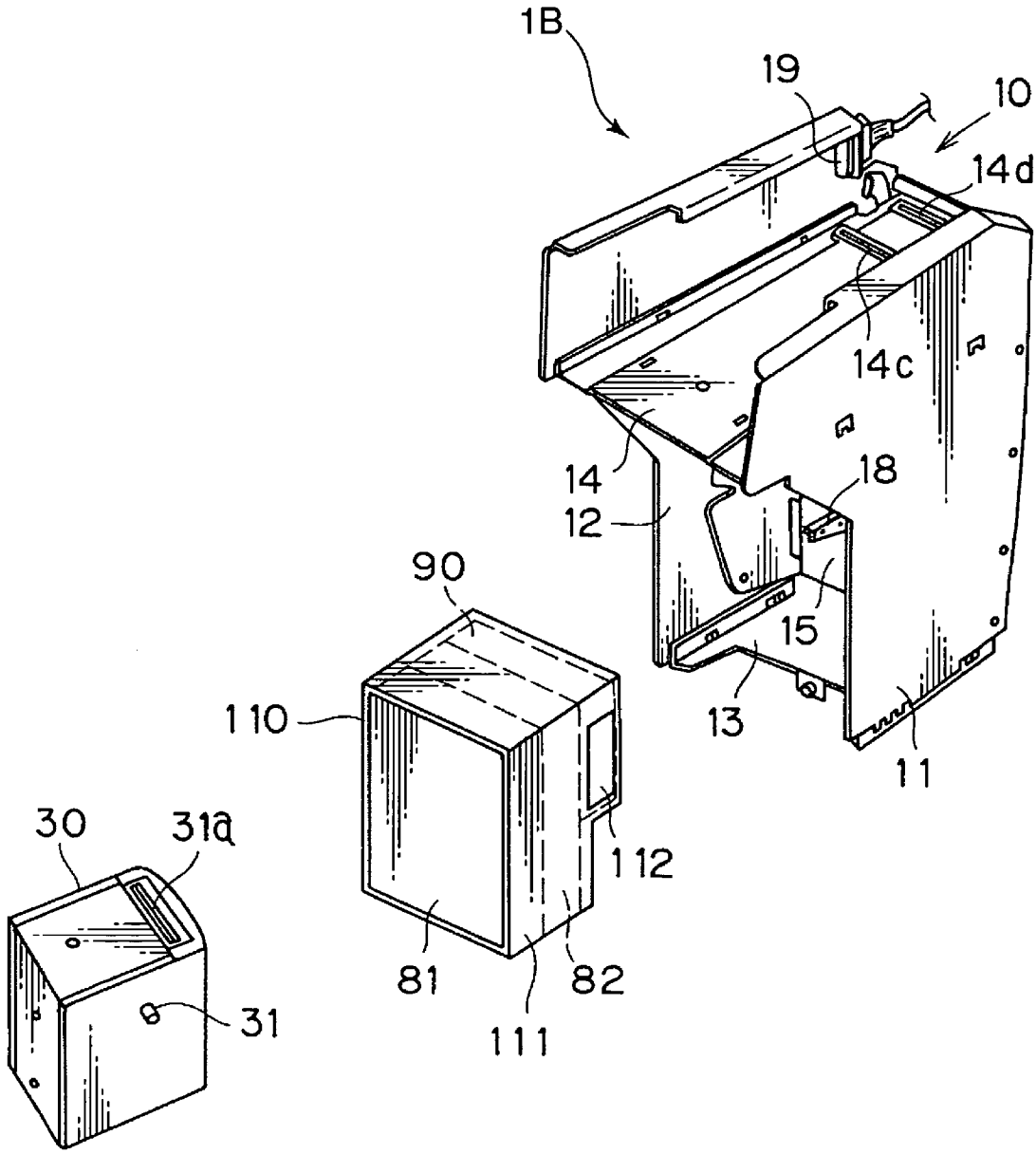
FIG. 15 is a perspective exploded view of a paper sheet handling apparatus according to a third embodiment of the present invention.
Figure 16:
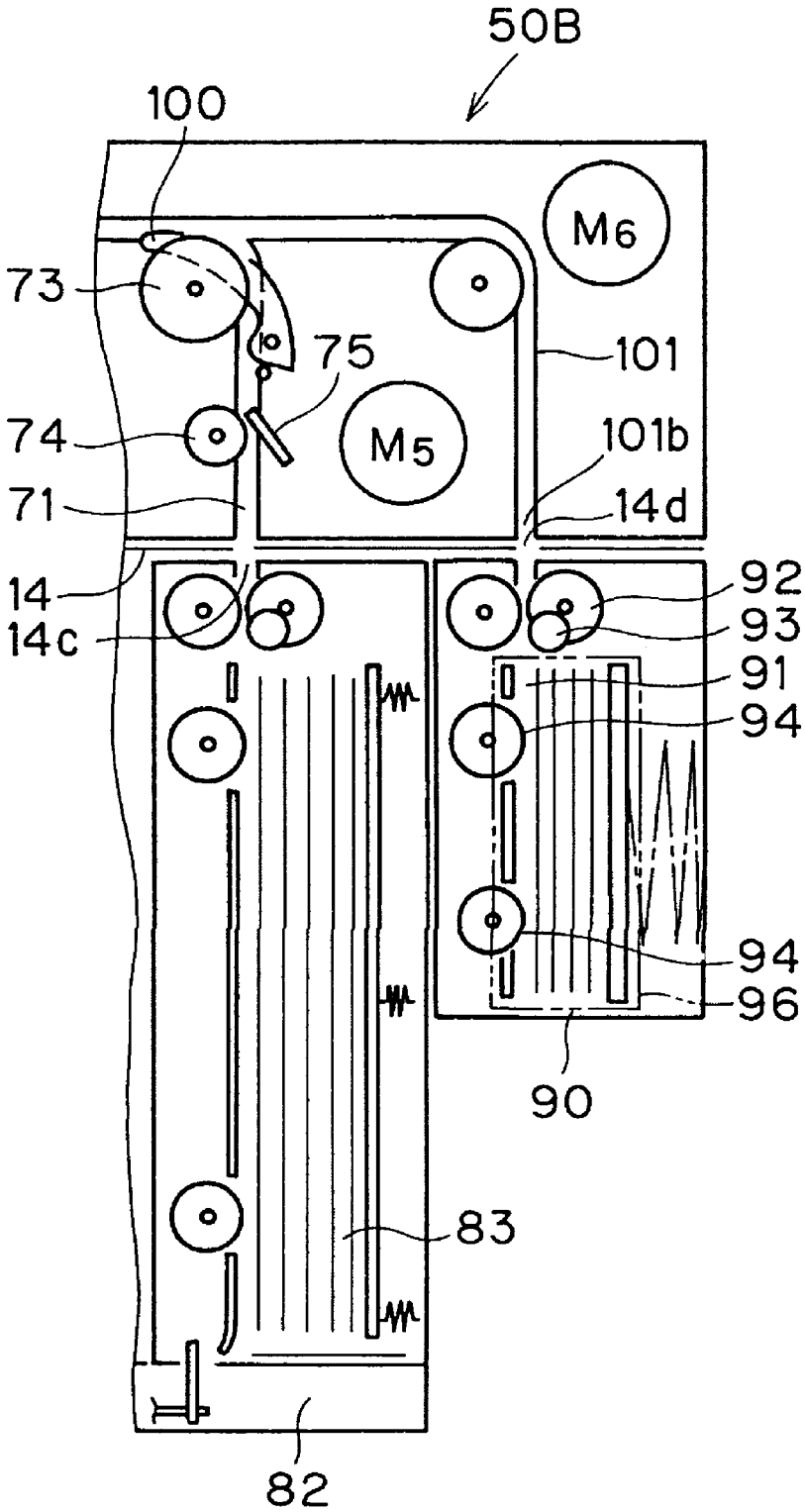
FIG. 16 is a right-side sectional view of the rear-end part of the paper sheet handling apparatus according to the third embodiment.

FIG. 15 is a perspective exploded view of a paper sheet handling apparatus 1B according to a third embodiment. FIG. 16 is a right-side sectional view of the rear-end part of that paper sheet handling apparatus 1B.

According to this third embodiment, behind the paying-out portion 82 for paying out a blank ticket which is provided in the paper sheet handling apparatus 1A according to the second embodiment shown in FIG. 13, moreover, there is provided a card paying-out portion 90 which stores a printed card 91. On the other hand, in a forwarding unit 50B, a fourth paper sheet forwarding line 101 is provided which that branches off from a midway part of the third paper sheet forwarding line 71. A third sorting shutter 100 is provided at the branching point of the third paper sheet forwarding line 71 and the fourth paper sheet forwarding line 101. Reference character and numeral M6 in the figure denotes a forwarding motor for paying out a card. By controlling the drive of this forwarding motor M6, the card 91 stored in the card paying-out portion 90 is paid out from the opening portion 22 through the fourth paper sheet forwarding line 101. An outlet 101*b* which is formed downward in the fourth paper sheet forwarding line 101 corresponds to an opening 14*d* formed behind the opening 14*c* in the shelf plate 14. Herein, the openings 14*a*, 14*b* are omitted in FIG. 15.

In the card paying-out portion 90, a paper sheet forwarding line 91 which leads to the fourth paper sheet forwarding line 101 is formed in the up-and-down directions. Along the paper sheet forwarding line 91, there are provided a pair of rollers 92, a separation roller 93 and a delivery roller 94. In the card paying-out portion 90, an open-and-close portion 96 is provided on the right side of its outside frame. The card 91 can be supplied inside from the open-and-close portion 96.

The above described paying-out portion 82 and card paying-out portion 90, and the paying-out portion 81 provided ahead of the paying-out portion 82, are placed in the front-and-rear directions and are housed in an inside frame 110. Herein, the inside frame 110 can be attached and detached inside between the bottom plate 13 and the shelf plate 14 of the outer frame 10. An opening portion 112 is formed at the part which corresponds to the open-and-close portion 96 of the card paying-out portion 90 in a right-hand side plane 111 of the inside frame 110.

The inside frame 110 can be detached forward after the collecting unit 30 has been removed forward. It can be attached in the opposite way. While the inside frame 110 is attached to the outer frame 10, the paper sheet forwarding line 91 is designed to correspond to the opening 14*d*.

Accordingly, the following advantages can be obtained according to the third embodiment, in addition to the advantages obtained according to the first embodiment. Three types of paper sheets can be paid out, which are the paying-out paper sheet B, the blank ticket 83 and the printed card 91. This allows various types of housing equipment to be used, thus increasing the types of housing equipment applicable to the paper sheet handling apparatus 1B. In addition, the inside frame 110 is detached as described earlier, and thus, the paying-out card 91 can be supplied to the inmost card paying-out portion 90, by opening the open-and-close portion 96 exposed to the opening portion 112, without detaching the front paying-out portions 81, 82. This offers an advantage in that the feeding operation can be improved.

According to the third embodiment, a printed card is paid out, but the present invention is not limited to this. For example, a magnetic card may also be paid out from the card paying-out portion 90. In that case, magnetic recording is executed on the magnetic card by a magnetic recording device provided in advance in the forwarding unit 50B.

Fourth Embodiment

Figure 17:
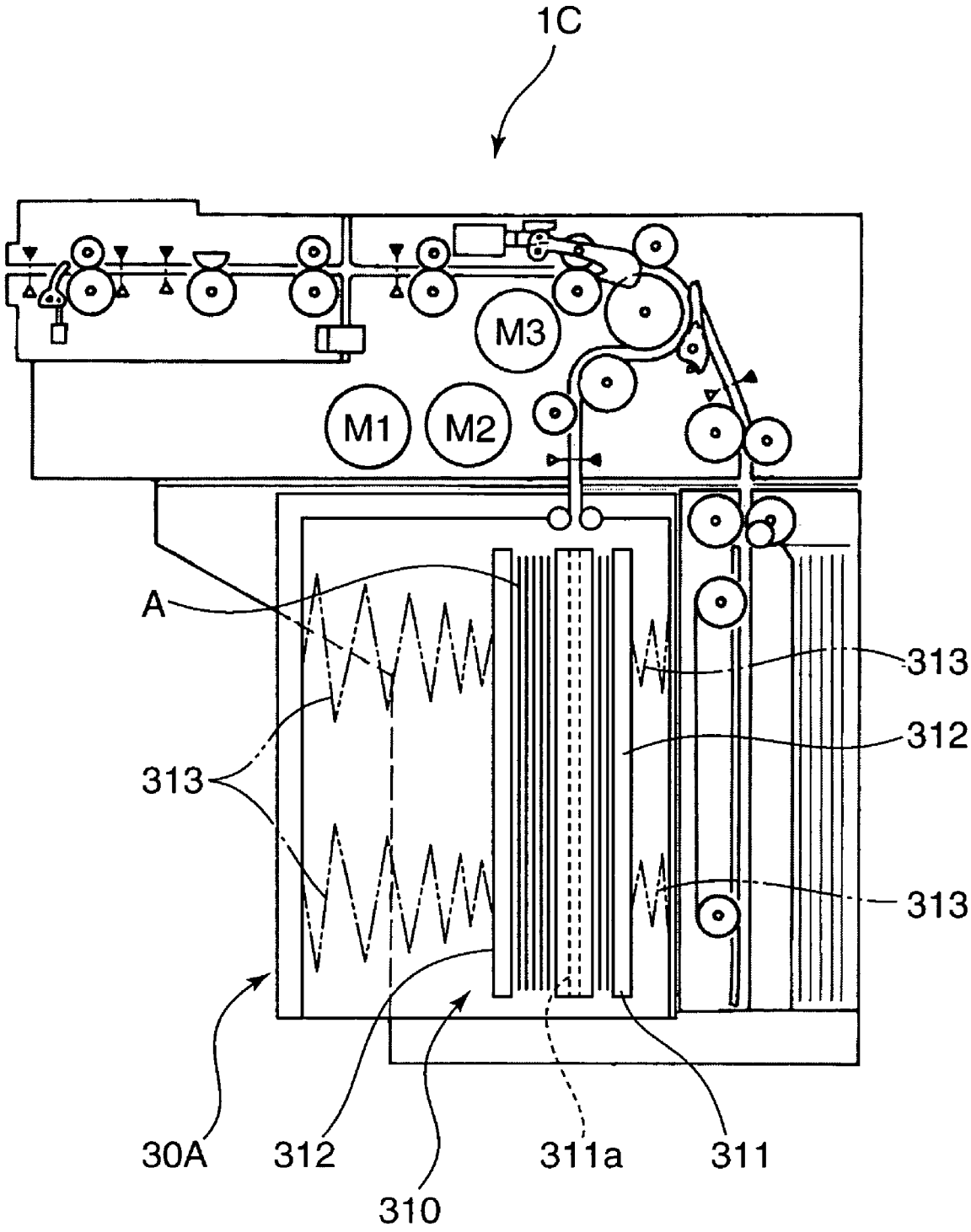
FIG. 17 is a right-side sectional view of a paper sheet handling apparatus according to a fourth embodiment of the present invention.
Figure 18C:
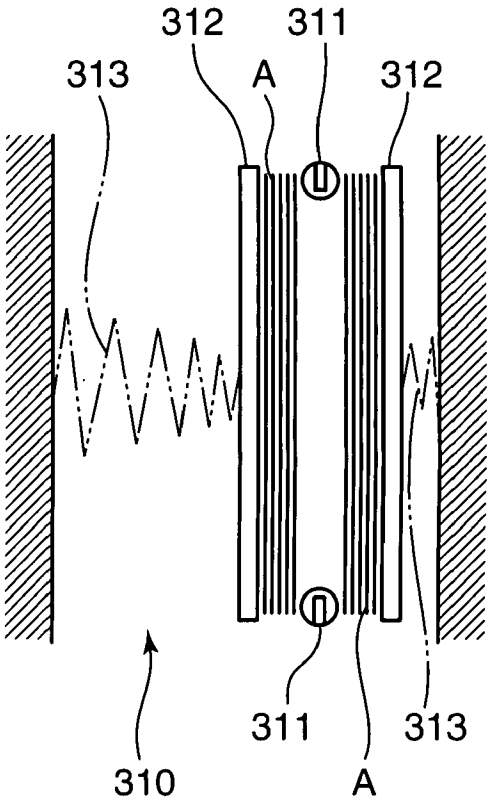
FIG. 18C shows a state in which the paper sheet has been sorted out by the acceptance bar.
Figure 18B:
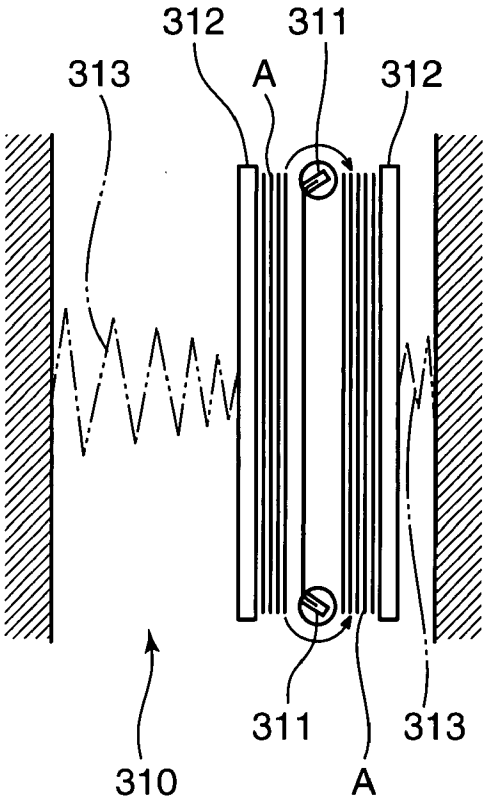
FIG. 18B shows a state in which the acceptance bar is being driven.
Figure 18A:
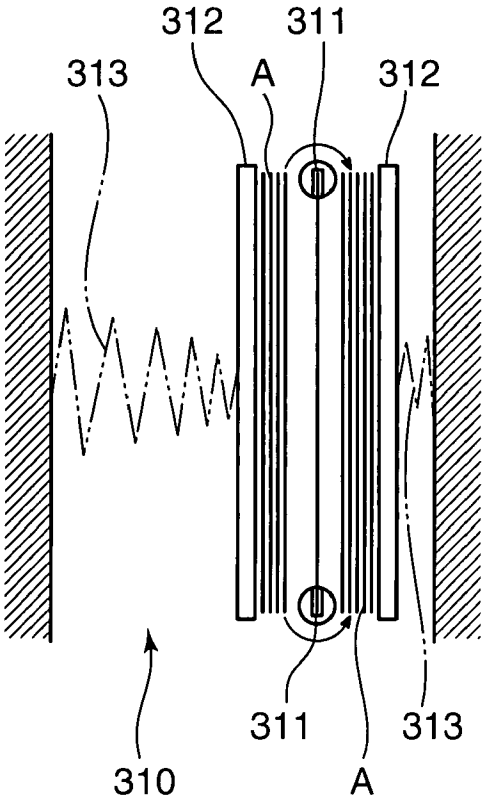
FIG. 18A shows a state in which an acceptance bar has accepted a paper sheet.

FIG. 17 is a right-side sectional view of a paper sheet handling apparatus 1C according to a fourth embodiment. FIG. 18 is a plan, partially sectional view of a collecting unit 30A in FIG. 17. FIG. 18A shows a state in which an acceptance bar has accepted a paper sheet A, FIG. 18B shows a state in which the acceptance bar is being driven, and FIG. 18C shows a state in which the paper sheet A has been sorted out by the acceptance bar. Herein, the reference numerals and characters of the same component parts as those in FIG. 3 are omitted, and only the reference numerals and characters of the component parts which are different from those of FIG. 3 are given in the following description.

In the paper sheet handling apparatus 1C according to this embodiment, the collecting unit 30A is provided which includes a sorting and storage portion 310 that can sort and store two types of paper sheets according to their types. In this collecting unit 30A, a pair of right and left acceptance bars 311 are provided which are configured to accept the paper sheet A forwarded from the above described first paper sheet forwarding line 51. These acceptance bars 311 are substantially cylindrical members which extend in the up-and-down directions. They are opened in one circumferential direction and are provided with a slit 311*a* which extends in the axial-center direction. According to this embodiment, these slits 311*a* face each other, and thus, the slits 311*a* configures a paper sheet forwarding line for accepting the paper sheet A. Each acceptance bar 311 is supported with the collecting unit 30A, so that they can be rotated around each axial center. They are designed to be rotated in the directions opposite to each other by the drive of the above described stack motors M1, M3. Ahead of and behind each acceptance bar 311 configured in this way, the paper sheets A of different types from each other are designed to be stored. The paper sheets A of two types are stacked in the directions apart from each other and are stored in the collecting unit 30A. The paper sheets A stacked in this way are each supported with a pair of press plates 312 which are provided ahead of and behind the acceptance bars 311. In that state, they are stored in the collecting unit 30A. These press plates 312 are pressed in the directions where they come close to each other by the force of elastic members 313 which are provided so as to face each other in the front-and-rear directions of the collecting unit 30A. The acceptance bars 311 of the sorting and storage portion 310 configured in this way are driven by the above described stack motor M1. Then, the paper sheets are sorted out and stored in the collecting unit 30A, as described below.

For example, in the case where the paper sheets A are stored in the front part of the sorting and storage portion 310, the collecting unit 30A operates as described below. First, as shown in FIG. 18A, the drive of the stack motors M1, M3 allows the slit 311*a* of each acceptance bar 311 to face each other, so that the paper sheet A forwarded from the first forwarding line is accepted at each slit 311*a*. In this state, the paper sheet A are supported at both its right-and-left end parts with each acceptance bar 311. Next, as shown in FIG. 18B, the drive of the stack motor M1 allows the acceptance bar 311 on the upper side of this paper (or the left side) to rotate clockwise on the paper, while it allows the other acceptance bar 311 to rotate counterclockwise on the paper. When the acceptance bars 311 are rotated in this way, the paper sheet A is gradually led ahead of each acceptance bar 311, with both its right-and-left end parts kept supported with the acceptance bars 311. When each acceptance bar 311 is rotated further, as shown in FIG. 18C, the paper sheet A is led further ahead of each acceptance bar 311. Then, both its right-and-left end parts of the paper sheet A slip from the slits 311*a*. As a result, the paper sheet A is stored in the front part of the sorting and storage portion 310.

Accordingly, the following advantages can be obtained according to the fourth embodiment, in addition to the advantages obtained according to the above described embodiments. If two types of paper sheets A have to be sorted out according to their types to the above described collecting unit 30, there is no need for new storage space. This makes it possible to omit the space for essential storage space. As a result, each paper sheet A can be stored, with the whole paper sheet handling apparatus 1C keeping its front-and-rear measurement at a small space.

Herein, when two types of paper sheets A are sorted out and stored as described above, that is not limited to the method in which they are sorted out and stored by the acceptance bars 311. For example, another method may also be used, such as using a large-domination bank-note storage portion disclosed in Japanese Patent Laid-Open No. 8-153230.

In addition, the fact that the paper sheets A inside of the collecting unit 30 are sorted out and stored has been described above. However, such a method is not limited to that. For example, the paper sheets B inside of the paying-out unit 40 can also be sorted out and stored.

Figure 19:
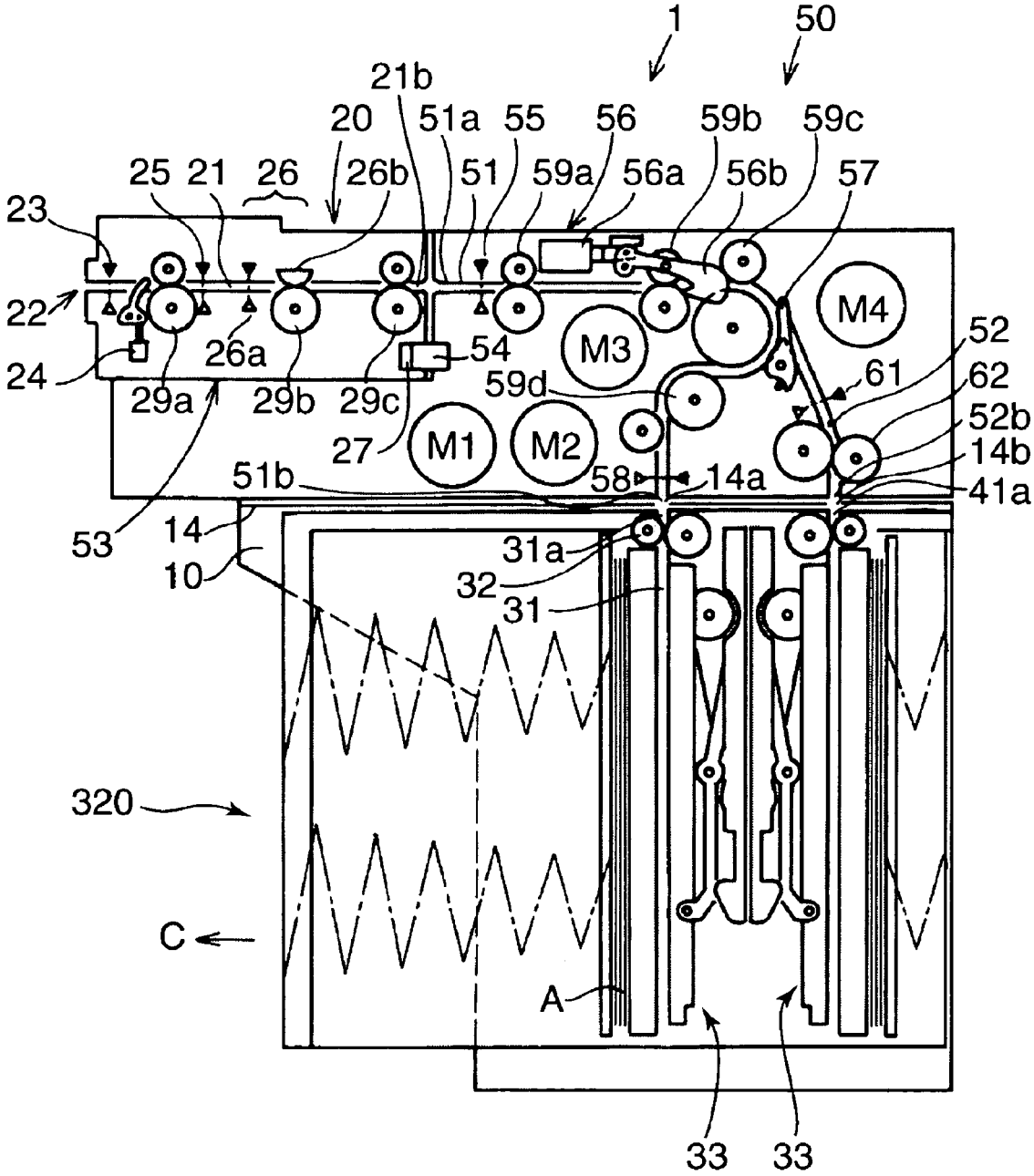
FIG. 19 is a right-side sectional view of a paper sheet handling apparatus according to another fourth embodiment.

Moreover, as shown in FIG. 19, a storage unit 320 is provided which is configured by uniting the collecting unit 30 and the paying-out unit 40. The above described push-in mechanism 33 is provided in the position which corresponds to each of the collecting unit 30 and the paying-out unit 40. Thereby, although it is a single unit, the storage unit 320 can sort and store the paper sheets A or the paper sheets B which correspond to collection or paying-out. This makes its housing space smaller than in the case where the collecting unit 30 and the paying-out unit 40 are separately provided.

Fifth Embodiment

Figure 20:
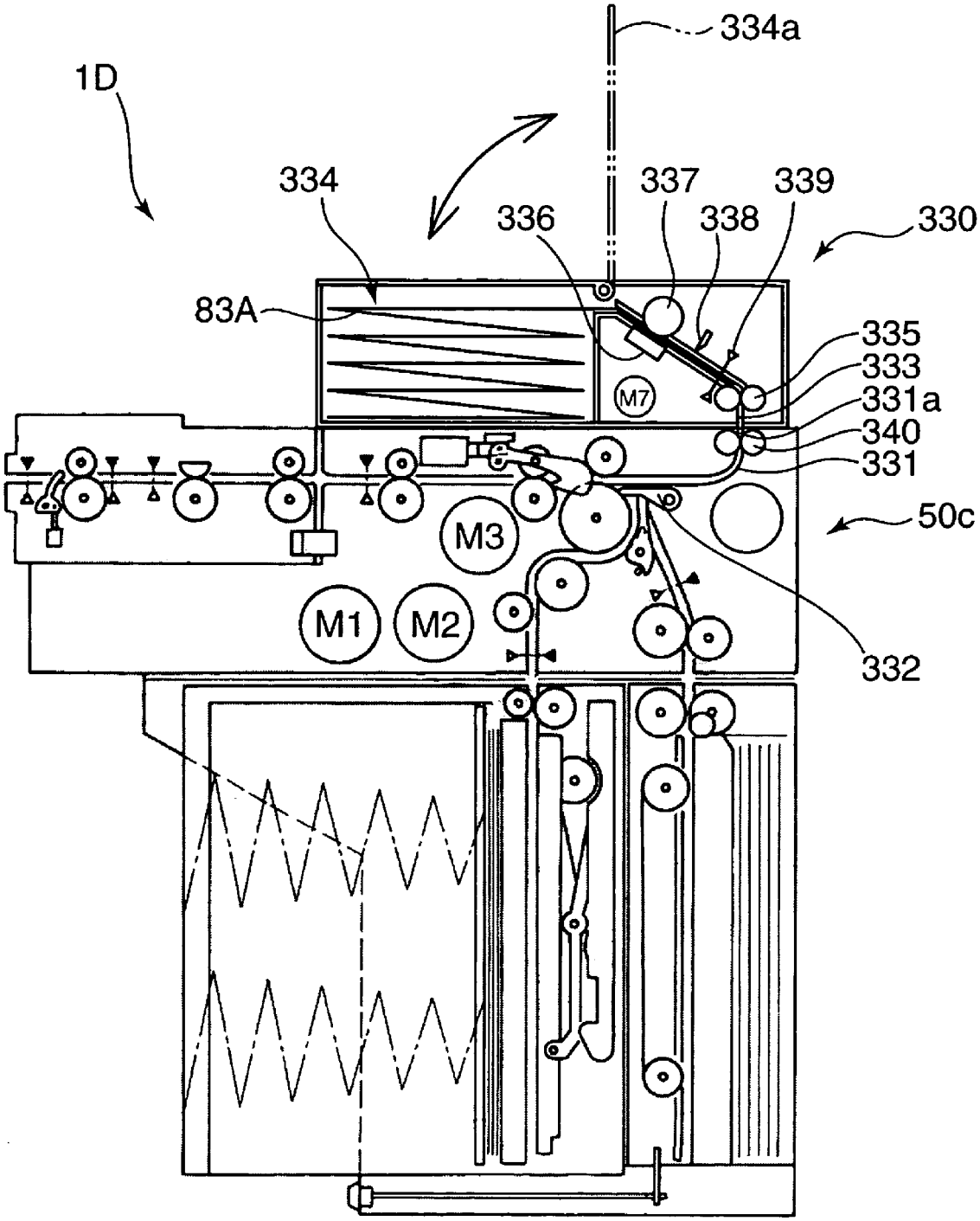
FIG. 20 is a right-side sectional view of a paper sheet handling apparatus according to a fifth embodiment of the present invention.
Figure 21A:
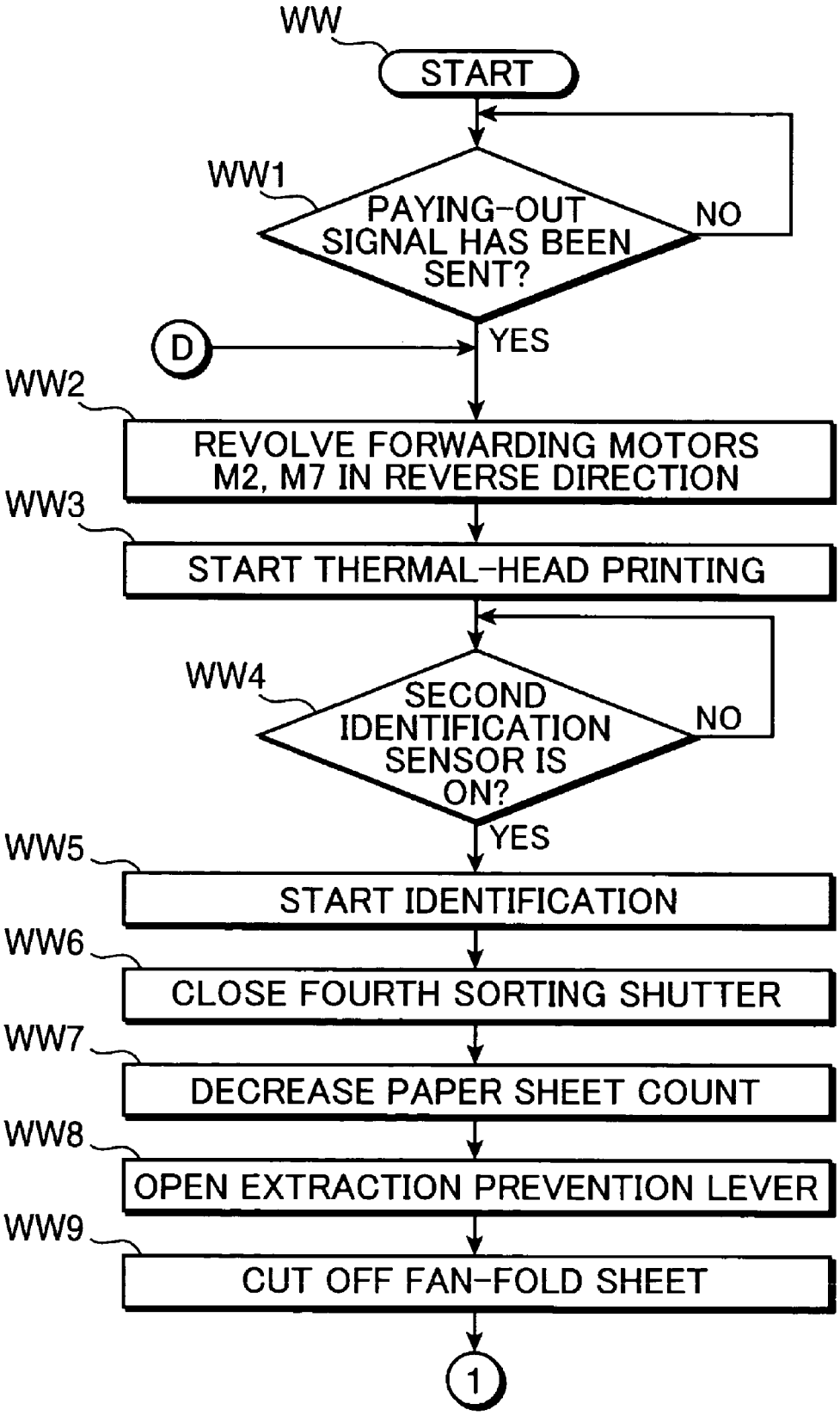
FIG. 21 is a flow chart, showing paying-out processing of the paper sheet handling apparatus in FIG. 20.
Figure 21B:
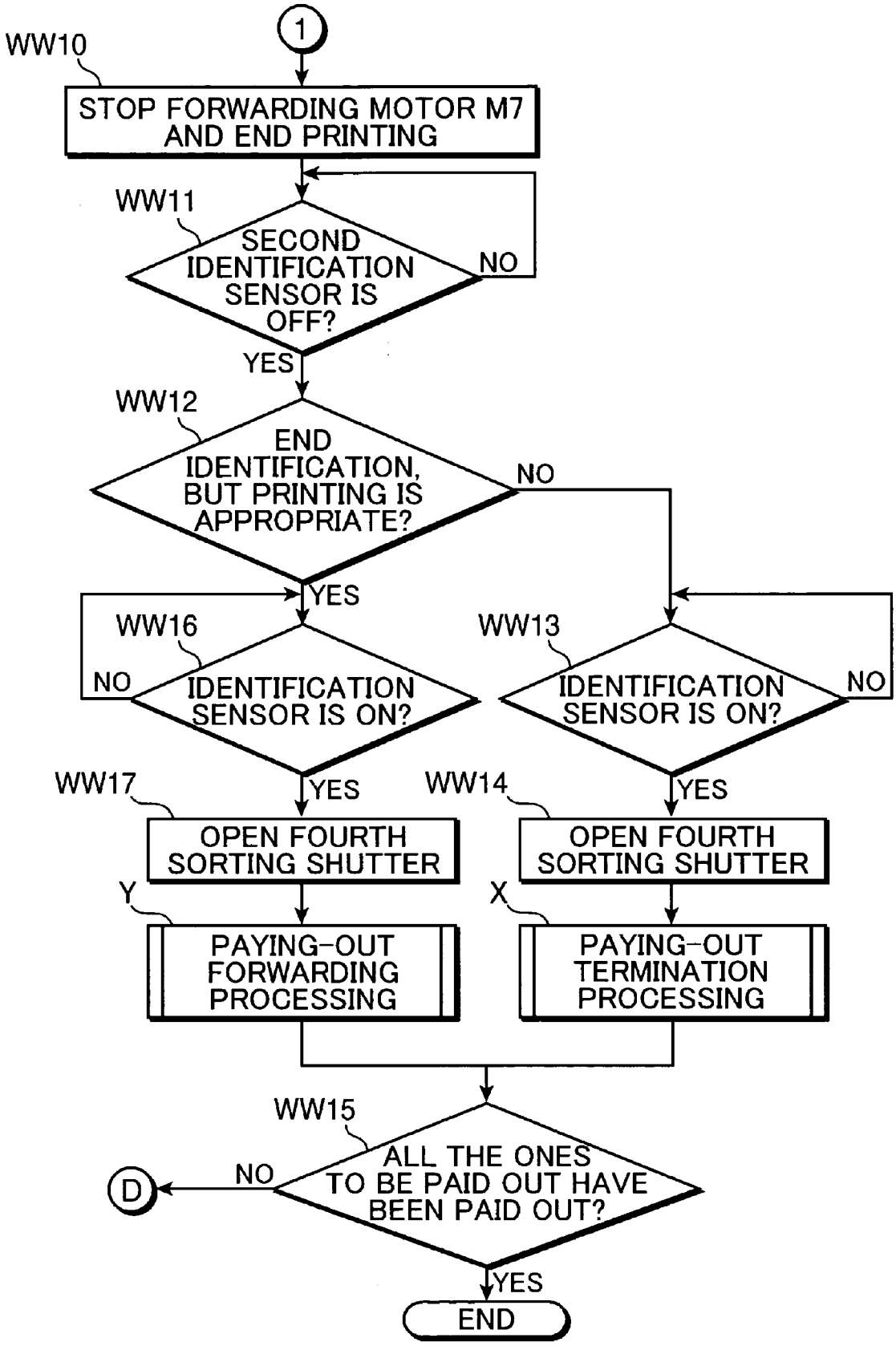

FIG. 20 is a right-side sectional view of a paper sheet handling apparatus 1D according to a fifth embodiment. FIG. 21 is a flow chart, showing a paying-out processing WW of the paper sheet handling apparatus 1D in FIG. 20. Herein, the reference numerals and characters of the same component parts as those in FIG. 3 are omitted, and only the reference numerals and characters of the component parts which are different from those of FIG. 3 are given in the following description.

The paper sheet handling apparatus 1D according to this embodiment includes a second paying-out unit 330 which is disposed at the upper and rear part of the outer frame 10. The paper sheet handling apparatus 1D also includes a forwarding unit 50C. Inside of this forwarding unit 50C, a fifth forwarding line 331 is provided, in addition to the above described first paper sheet forwarding line 51 and second paper sheet forwarding line 52. The fifth forwarding line 331 extends rearward on the extended line from a midway part of the first paper sheet forwarding line 51 which is placed in a straight line from the opening portion 22. It bends upward at the rear part of the paper sheet handling apparatus 1D, and leads to an outlet 331*a* which is formed in the upper and rear part of the outer frame 10. In the second paying-out unit 330, an opening 333 is formed which corresponds to this outlet 331*a*. Since this opening 333 corresponds to the outlet 331*a*, the fifth forwarding line 331 is introduced into the second paying-out unit 330. The fifth forwarding line 331 introduced into the second paying-out unit 330 in this way configures a route which extends inclined and upward. Its front-end faces a paying-out storage portion 334 which is provided in the front-end part of the second paying-out unit 330, so that the fan-fold sheet 83A inside of the paying-out storage portion 334 can be introduced. As described above, this paying-out storage portion 334 is configured to store each paying-out paper sheet such as the fan-fold sheet 83A. In addition, it is provided with a lid body 334*a* for inserting and extracting from forward the paying-out paper sheet stored in this way. This lid body 334*a* is fixed on a hinge to the upper plane of the second paying-out unit 330 at its rear-end part. Its front-end part is turned on this hinge, so that it can cover and open the paying-out storage portion 334. This enables an administrator to open and close it, as the need arises.

Furthermore, a fourth sorting shutter 332 is provided at the branching part of the fifth forwarding line 331 and the first forwarding line 51. This fourth sorting shutter 332 can be moved between the shutting position in which the fifth forwarding line 331 leads to the first forwarding line 51, and the opening position in which the fifth forwarding line 331 is shut off from the first forwarding line 51.

The fan-fold sheet 83A is forwarded along the fifth forwarding line 331 described above. To do this, the fifth forwarding line 331 is provided with a pair of delivery rollers 335 disposed in the second paying-out unit 330, and a pair of feed rollers 340 disposed in the forwarding unit 50C. The fifth forwarding line 331 are provided with a thermal head 336 for printing the fan-fold sheet 83A, a platen roller 337, a cutter 338 for cutting off the fan-fold sheet 83A, and a second identification sensor 339 (or an identifying device) for identifying a printing level of the fan-fold sheet 83A. The delivery rollers 335 and the platen roller 337 are driven by a forwarding motor M7 provided in the second paying-out unit 330, while the feed roller 340 is driven by the above described forwarding motor M2.

The paper sheet handling apparatus 1D configured as described above, based on the paying-out processing WW described later, prints the fan-fold sheet 83A stored in the second paying-out unit 330, and cuts off the fan-fold sheet 83A at a predetermined size. Then, if its printing level is appropriate, the fan-fold sheet 83A is paid out to the opening portion 22.

With reference to FIG. 20 and FIG. 21, when the above described paying-out signal is inputted, the paying-out processing WW is started. If this paying-out signal is not inputted (or NO at Step WW1), Step WW1 is repeatedly executed. On the other hand, if this paying-out signal has been inputted (or YES at Step WW1), the forwarding motors M2 and M7 are revolved in their reverse directions (in Step WW2). In the state where the forwarding motors M2 and M7 are revolved in the reverse directions and the fan-fold sheet 83A has begun to be forwarded, a printing is started by the thermal head 336 (in Step WW3). Then, judgment is made whether or not the fan-fold sheet 83A has turned ON the second identification sensor 339 (in Step WW4). If the judgment is made that the second identification sensor 339 is OFF (or NO at Step WW4), Step WW4 is repeatedly executed. On the other hand, if the judgment is made that the second identification sensor 339 is ON (or YES at Step WW4), an identification is started by the second identification sensor 339 (in Step WW5). Next, the fourth sorting shutter 332 is closed (or the state in which the fifth forwarding line 331 leads to the first paper sheet forwarding line 51) (in Step WW6). Then, the paper sheet count of the second paying-out unit 330 decreases (in Step WW7). Next, the extraction prevention lever 56 is opened (in Step WW8). Then, after a predetermined time has passed from the time when the second identification sensor 339 has been turned ON at Step WW4, the fan-fold sheet 83A is cut off with the cutter 338 (in Step WW9). Then, the forwarding motor M7 is stopped, and the printing is completed at the same time (in Step WW10). Next, the end part of the fan-fold sheet 83A cut off as described above passes through the second identification sensor 339. Then, judgment is made whether or not the second identification sensor 339 has been turned OFF (in Step WW11). If the judgment is made that the second identification sensor 339 is ON (or NO at Step WW11), Step WW11 is repeatedly executed. On the other hand, if the judgment is made that the second identification sensor 339 is OFF (or YES at Step WW11), the identification is completed. Then, judgment is made whether or not the printing level is good (in Step WW12). If the judgment is made that the printing level is not good, judgment is made whether or not the identification sensor 26*b* has been turned ON (in Step WW13). If the judgment is made that the identification sensor 26*b* is OFF (or NO at Step WW13), Step WW13 is repeatedly executed. On the other hand, if the judgment is made that the identification sensor 26*b* is ON (or YES at Step WW13), the fourth sorting shutter is opened (in Step WW14). Then, the above described paying-out termination processing X is executed. If the paying-out termination processing X is executed and the fan-fold sheet 83A is forwarded to the collecting unit 30, judgment is made whether or not the paying-out has been entirely completed after this paying-out (in Step WW15). If the judgment is made that the paying-out has not been entirely completed (or NO at Step WW15), Step WW2 is executed. On the other hand, if the judgment is made that the paying-out has been entirely completed (or YES at Step WW15), this processing is completed.

On the other hand, if the judgment is made that the printing level is good at Step WW12 (or YES at Step WW12), judgment is made whether or not the identification sensor 26*b* has been turned ON (in Step WW16). If the judgment is made that the identification sensor 26*b* is OFF (or NO at Step WW16), Step WW16 is repeatedly executed. On the other hand, if the judgment is made that the identification sensor 26*b* is ON (or YES at Step WW16), the fourth sorting shutter is opened (in Step WW17). Then, the above described paying-out forwarding processing Y is executed. After the paying-out forwarding processing Y is executed and the fan-fold sheet 83A is paid out to the user, Step WW15 is executed. If the judgment is made that the paying-out has been entirely completed (or YES at Step WW15), this processing is completed.

Accordingly, the following advantages can be obtained according to the fifth embodiment, in addition to the advantages obtained according to the above described embodiments. The paper sheet handling apparatus ID includes the second paying-out unit 330, and the second paying-out unit 330 is provided with the lid body 334*a*. Therefore, by opening the lid body 334*a*, an administrator can easily supply the fan-fold sheet 83A or the like from ahead of the paper sheet handling apparatus ID. In addition, the paper sheet handling apparatus ID is provided with the second identification sensor 339 for identifying a printing level of the fan-fold sheet 83A. Based on the identification by the second identification sensor 339, the fan-fold sheet 83A whose printing level is not good is forwarded to the collecting unit 30, and then, the fan-fold sheet 83A is paid out again. This allows only the ones which have good printing-levels to be paid out to the user.

Herein, the paper sheet handling apparatus ID includes the second paying-out unit 330 in the upper part of the outer frame 10. Hence, preferably, it should be used in the case where it has the housing space which is large enough in the up-and-down directions.

Furthermore, the second paying-out unit 330 of the paper sheet handling apparatus 1D stores the fan-fold sheet 83A. However, a magnetic card or the like as described above may also be stored. In that case, the thermal head 336 is replaced with a magnetic recording device, and a magnetic-recording level of the magnetic card is judged by the second identification sensor 339.

Sixth Embodiment

According to the fifth embodiment, the second identification sensor 339 is provided to identify printing levels. However, instead of it, printing levels can also be identified by the above described identification sensor 26*b*.

Figure 22:
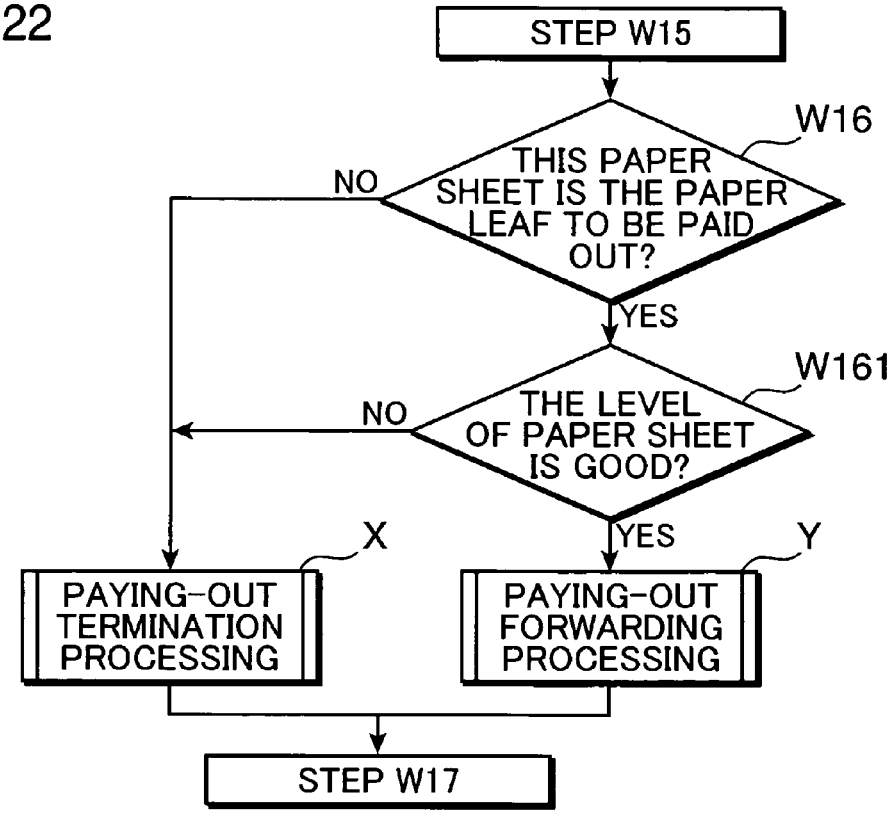
FIG. 22 is a flow chart, showing a part of another embodiment of the paying-out processing shown in FIG. 10.

FIG. 22 is a flow chart, showing a part of another embodiment of the paying-out processing W shown in FIG. 10.

As shown in FIG. 22, after the judgment is made that the paying-out paper sheet B is the one to be paid out at Step W16 (or YES at Step W16), in this paying-out processing W, an identification is made by the identification sensor 26*b* whether or not the paying-out paper sheet B has a good level (in Step W161). If the identification is made that the paying-out paper sheet B has a good level (or YES at Step W161), the paying-out forwarding processing Y is executed. On the other hand, if the identification is made that the paying-out paper sheet B does not have a good level (or NO at Step W161), the above described paying-out termination processing X is executed. Herein, "the paying-out paper sheet B's level" represents a printing level including bar-code information, or a magnetic-recording level. If the above described processing is executed, the same advantages as in the fifth embodiment can be obtained, without providing the additional identification sensor 339 as described above.

Seventh Embodiment

On the other hand, identifying the level of a paper sheet by the identification sensor 26*b* as described above is not limited to the time when the paying-out processing W is executed. For example, the paper sheet A can be efficiently accepted by executing the following processing.

Figure 23:
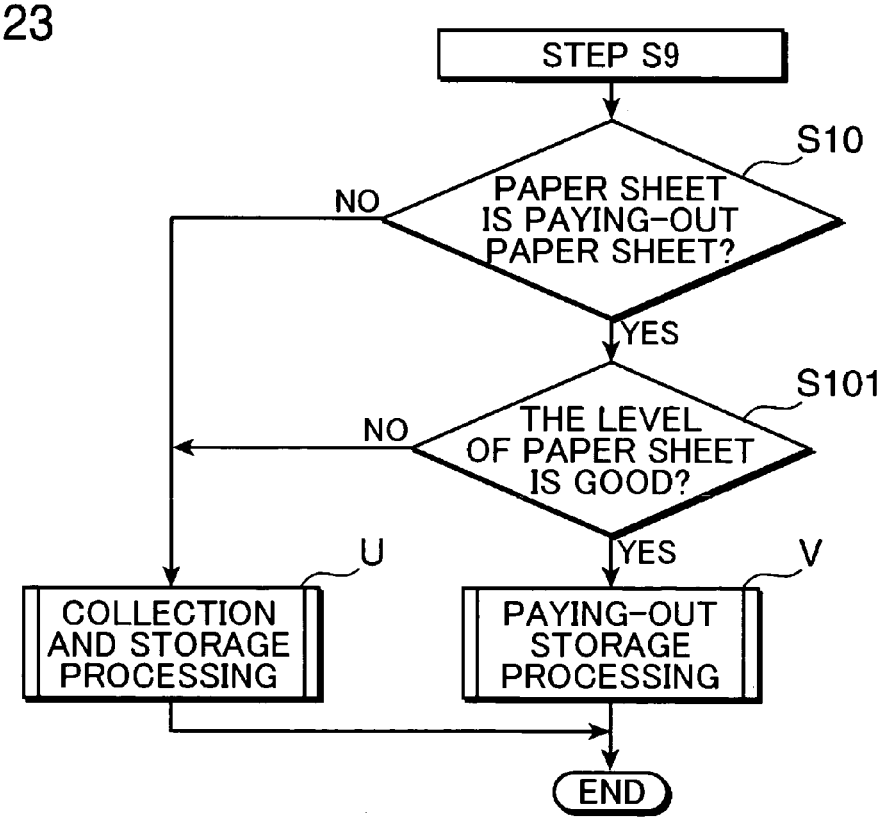
FIG. 23 is a flow chart, showing a part of another embodiment of the acceptance processing shown in FIG. 6.

FIG. 23 is a flow chart, showing a part of another embodiment of the acceptance processing S shown in FIG. 6.

As shown in FIG. 23, after the judgment is made that the paper sheet A is the paying-out paper sheet B at Step S10 (or YES at Step S10), in this acceptance processing S, an identification is made by the identification sensor 26*b* whether or not the paper sheet A has a good level (in Step S101). If the identification is made that the paper sheet A has a good level (or YES at Step S101), the paying-out storage processing V is executed. On the other hand, if the identification is made that the paper sheet A does not have a good level (or NO at Step S101), the above described collection and storage processing U is executed. Herein, "the paper sheet A's level" represents, for example, the state of the bent or ripped paper sheet A. If such a paper sheet A is forwarded to the paying-out unit 40, then, when paid out, some trouble may be caused in the process of its forwarding. Hence, in the acceptance processing S, even though it can be identified as genuine only at a certain possible level, the damaged paper sheet A is designed to be forwarded to the collecting unit 30. This prevents the above described trouble from being caused.

Eighth Embodiment

Furthermore, in the acceptance processing S, the direction in which the paper sheet A is inserted from the opening portion 22 is judged by the identification sensor 26*b*. This allows the paper sheet A to be more efficiently accepted.

Figure 24:
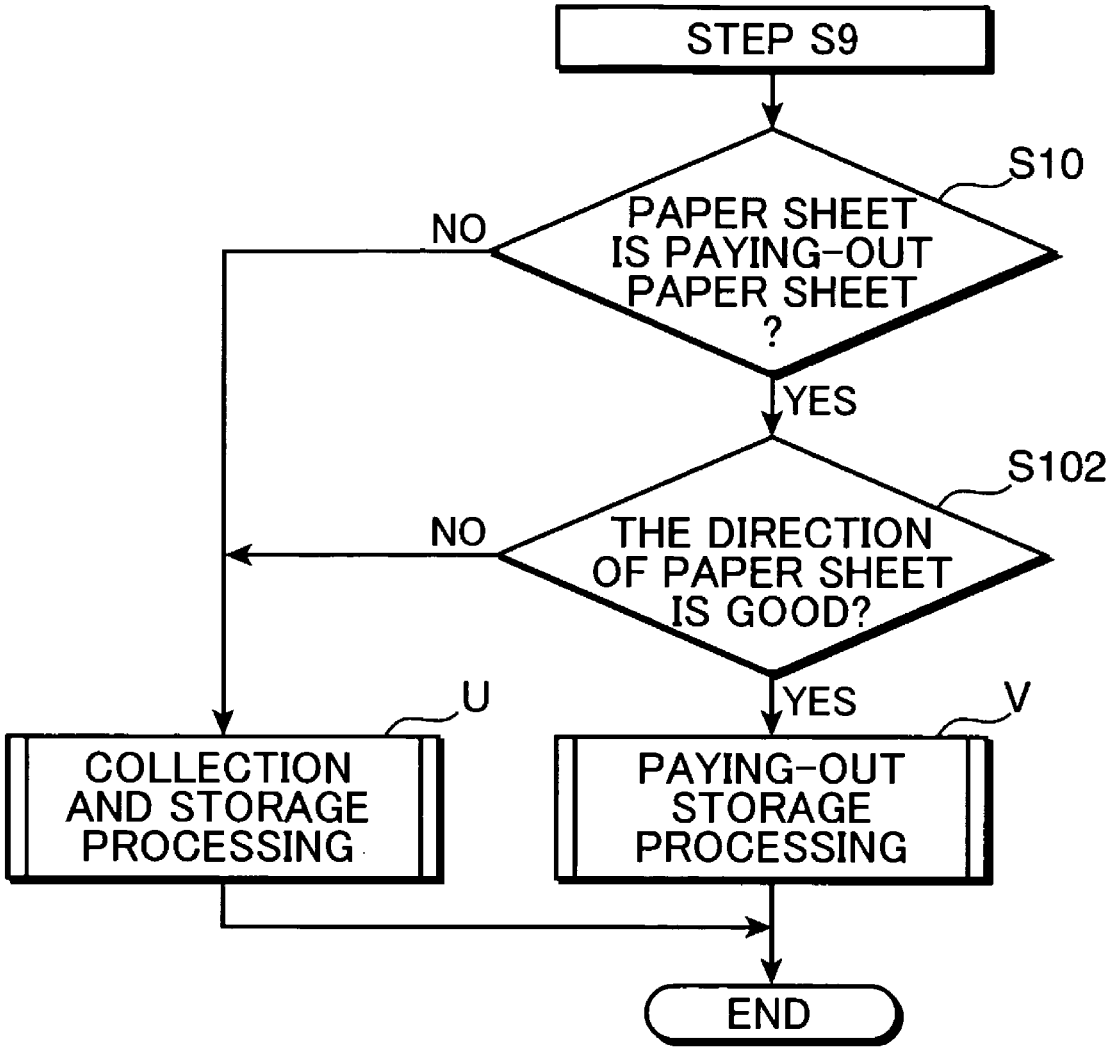
FIG. 24 is a flow chart, showing a part of still another embodiment of the acceptance processing shown in FIG. 6.

FIG. 24 is a flow chart, showing a part of still another embodiment of the acceptance processing S shown in FIG. 6.

As shown in FIG. 24, after the judgment is made that the paper sheet A is the paying-out paper sheet B at Step S10 (or YES at Step S10), in this acceptance processing S, an identification is made by the identification sensor 26*b* whether or not the direction of the paper sheet A is good (in Step S102). If the identification is made that the direction of the paper sheet A is good (or YES at Step S102), the paying-out storage processing V is executed. On the other hand, if the identification is made that the direction of the paper sheet A is not good (or NO at Step S102), the collection and storage processing U is executed. Herein, "the direction in which the paper sheet A is good" represents, for example, the direction in which the right side of the paper sheet A is placed up and the printed figure of the paper sheet A is on its front side, which is a preset paper sheet direction. In other words, only the paper sheet A that has been judged to be such a preset direction is forwarded to the paying-out unit 40. Thereby, the direction of the paper sheet B paid out later is unified, thus allowing the direction of the paper sheet B paid out to the user to become uniform, every time it is paid out.

Ninth Embodiment

As described above, the identification sensor 26*b* can be used for various kinds of identifications. Hence, a reference reading paper sheet can be used for managing the identification sensor 26*b* used with high frequency. On this reference reading paper sheet, specific identification information is recorded which can be read by the identification sensor 26*b*. This identification information is stored in advance in the above described controller. Such a reference reading paper sheet is stored in the collecting unit 30, and in addition, the following steps are added to the paying-out processing W. Therefore, the precision of the identification sensor 26*b* can be adjusted when the paying-out processing W is executed.

Figure 25:
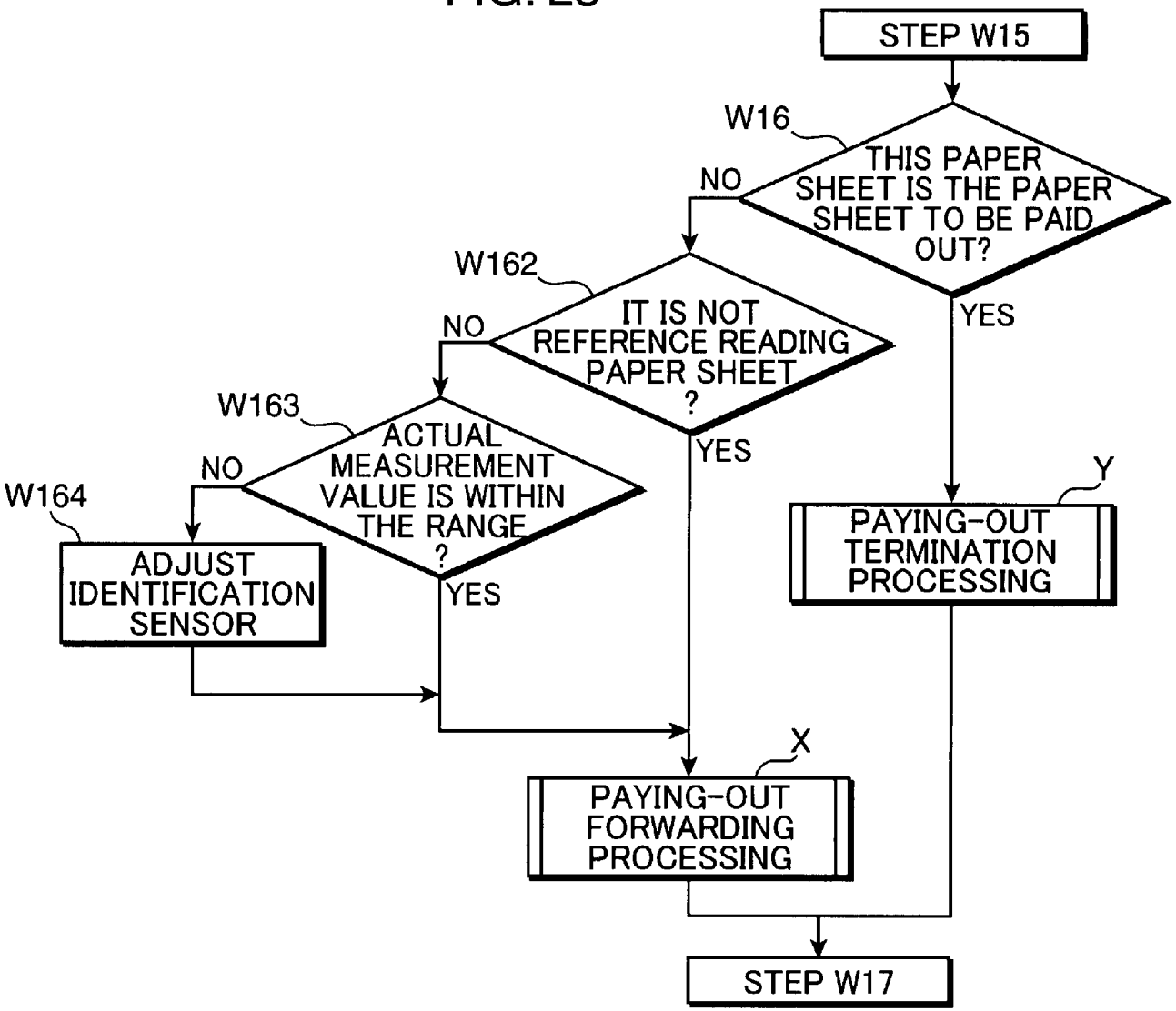
FIG. 25 is a flow chart, showing a part of another embodiment of the paying-out processing shown in FIG. 10.

FIG. 25 is a flow chart, showing a part of another embodiment of the paying-out processing W shown in FIG. 10.

As shown in FIG. 25, after the judgment is made that the paying-out paper sheet B is not the paper sheet to be paid out at Step W16 (or NO at Step W16), in this paying-out processing W, judgment is made by the identification sensor 26*b* whether or not the paying-out paper sheet B is not the reference reading paper sheet (in Step W162). If the judgment is made that the paying-out paper sheet B is not the reference reading paper sheet (or YES at Step W162), the paying-out termination processing X is executed. On the other hand, if the judgment is made that the paying-out paper sheet B is the reference reading paper sheet (or NO at Step W162), judgment is made whether or not an actual measurement value by the identification sensor 26*b* over the reference reading paper sheet is within the range of identification which are recorded in the controller (or the range which is set by adding or subtracting, the identification error of the identification sensor 26*b*, to or from, the identification information) (in Step W163). If the judgment is made that the actual measurement value is within the range of identification (or YES at Step W164), the paying-out termination processing X is executed. On the other hand, if the judgment is made that the actual measurement value is not within the range of identification (or NO at Step W164), the sensor level of the identification sensor 26*b* is adjusted so that the actual measurement value becomes an appropriate value within the range of identification (in Step W164). Then, the paying-out termination processing X is executed.

In this way, the reference reading paper sheet is stored in the collecting unit 30. This makes it possible to adjust the precision of the identification sensor 26*b* when the paying-out processing W is executed. Herein, as described above, the identification sensor 26*b* is adjusted when the paying-out processing W is executed. However, instead of this configuration, for example, an administrator can also insert the reference reading paper sheet from the opening portion 22, so that the precision of the identification sensor 26*b* can be adjusted (i.e., the precision of the identification sensor 26*b* can be adjusted when the acceptance processing S is executed).

Moreover, the precision of the identification sensor 26*b* is adjusted, as described above, using the reference reading paper sheet. This allows the precision of the identification sensor 26*b* to be maintained as much as possible when each processing is executed. However, for example, in the case where dust or the like adheres to the identification sensor 26*b*, the precision of the identification sensor 26*b* may not be kept when each processing is executed. In such a case, dust or the like can be wiped off by allowing a cleaning paper sheet to pass through the identification sensor 26*b*, when the acceptance processing S or the paying-out processing W is executed. This cleaning paper sheet includes a wipe portion which is made of an material such as felt on its whole surface or a part of it. This wipe portion is designed to wipe off the dust or the like which adheres to the identification sensor 26*b*. In the same way as the reference reading paper sheet, such a cleaning paper sheet can be used when the paying-out processing W or the acceptance processing S is executed.

Tenth Embodiment

Figure 26:
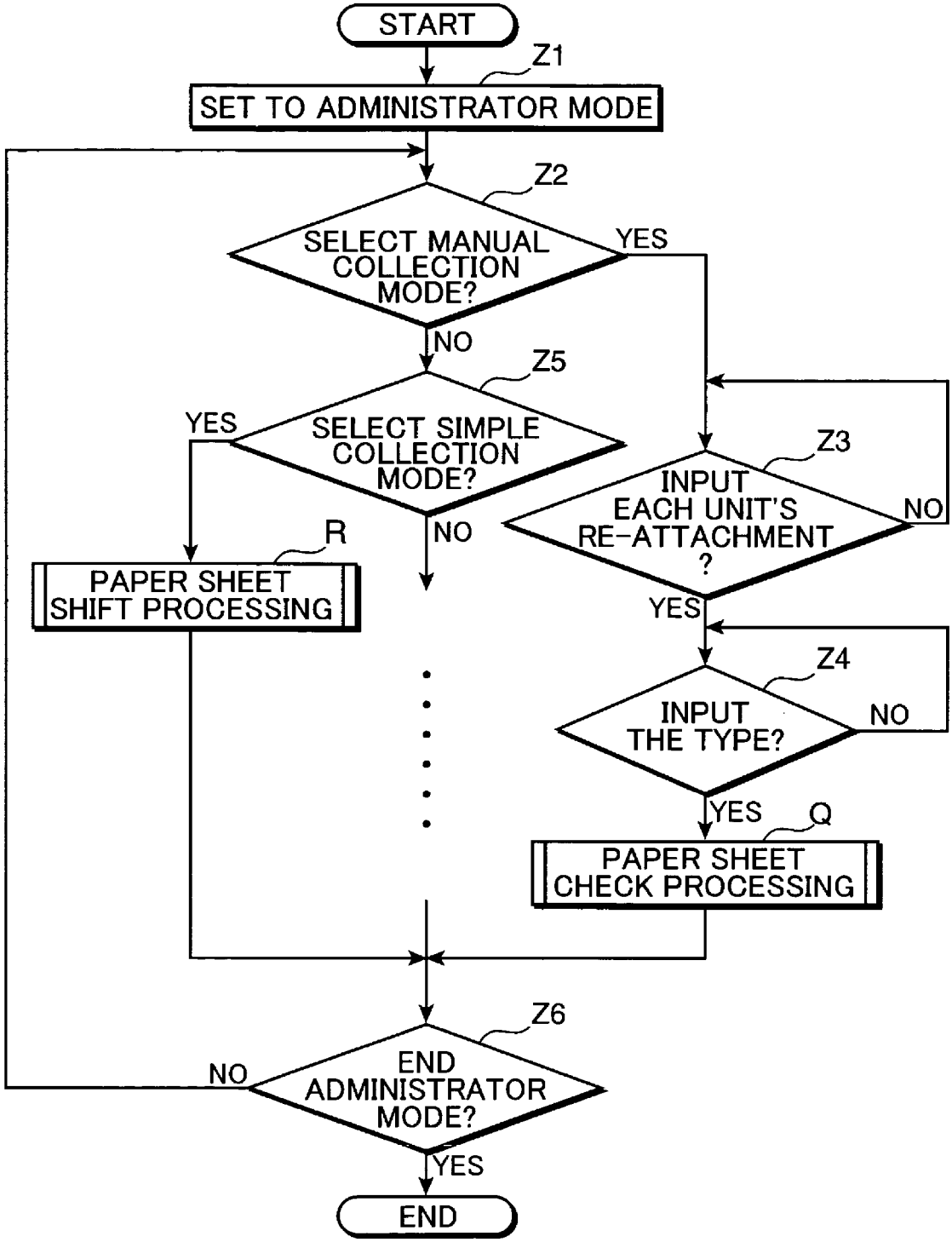
FIG. 26 is a main routine, showing processing by a controller in an administrator mode.

According to each embodiment described above, for example, when an administrator collects the paper sheet A from the collecting unit 30, each processing (i.e., the acceptance processing S, and the paying-out processing W or WW) by the above described controller has to be once kept stopped (hereinafter, this state is mentioned as the administrator mode). There are a number of methods for shifting the processing of the controller to this administrator mode. For example, one of the methods is the one in which a key owned by the administrator is inserted into a key hole which is formed in each paper sheet handling apparatus 1, 1A, 1B, 1C, 1D, and then, the key is turned to a predetermined turning angle. In another method, a magnetic-recording card on which information for shifting to the administrator mode is recorded, or a coupon ticket on which bar-code information for shifting to the administrator mode is printed, is inserted from the opening portion 22. And other well-known methods can also be used. As shown in FIG. 26, the administrator can select each mode by shifting to the administrator mode, as described above.

FIG. 26 is a main routine, showing processing by the controller in the administrator mode.

With reference to FIG. 26, as described above, when the administrator mode is set by the administrator (in Step Z1), a shift can be made to each mode preset in the administrator mode. If the administrator-mode end is selected by the administrator (or YES at Step Z6), the administrator-mode is designed to be completed.

With reference to the same figure, for example, when the administrator supplies the paying-out paper sheet B to the paying-out unit 40, the administrator selects a manual collection mode (or YES at Step Z2). If the manual collection mode has been selected, judgment is made whether or not the collecting unit 30 or the paying-out unit 40 has been attached again to the outer frame 10 by the administrator (in Step Z3). If the judgment is made that the collecting unit 30 or the paying-out unit 40 is not attached again (or NO at Step Z3), Step Z3 is repeatedly executed. On the other hand, if the judgment is made that the collecting unit 30 or the paying-out unit 40 is attached again (or YES at Step Z3), judgment is made whether or not money-type information of the paying-out paper sheet B supplied to the paying-out unit 40 has been inputted (in Step Z4). Herein, the "money-type information"

represents information, such as if the supplied paying-out paper sheet B is a ticket used as money, what type of money ticket it is, and which the paying-out paper sheet B is, the above described blank ticket 83 or magnetic-recording card. These pieces of information are inputted by the administrator in an inputting device (now shown). Herein, if the paper sheet to be stored in the paying-out unit 40 is preset, there is no need for the processing of Step Z4. If the judgment is made that the money-type information of the paying-out paper sheet B is not inputted (or NO at Step Z4), Step Z4 is repeatedly executed. On the other hand, if the judgment is made that the money-type information of the paying-out paper sheet B is inputted (or YES at Step Z4), a paper sheet check processing Q is executed.

Figure 27:
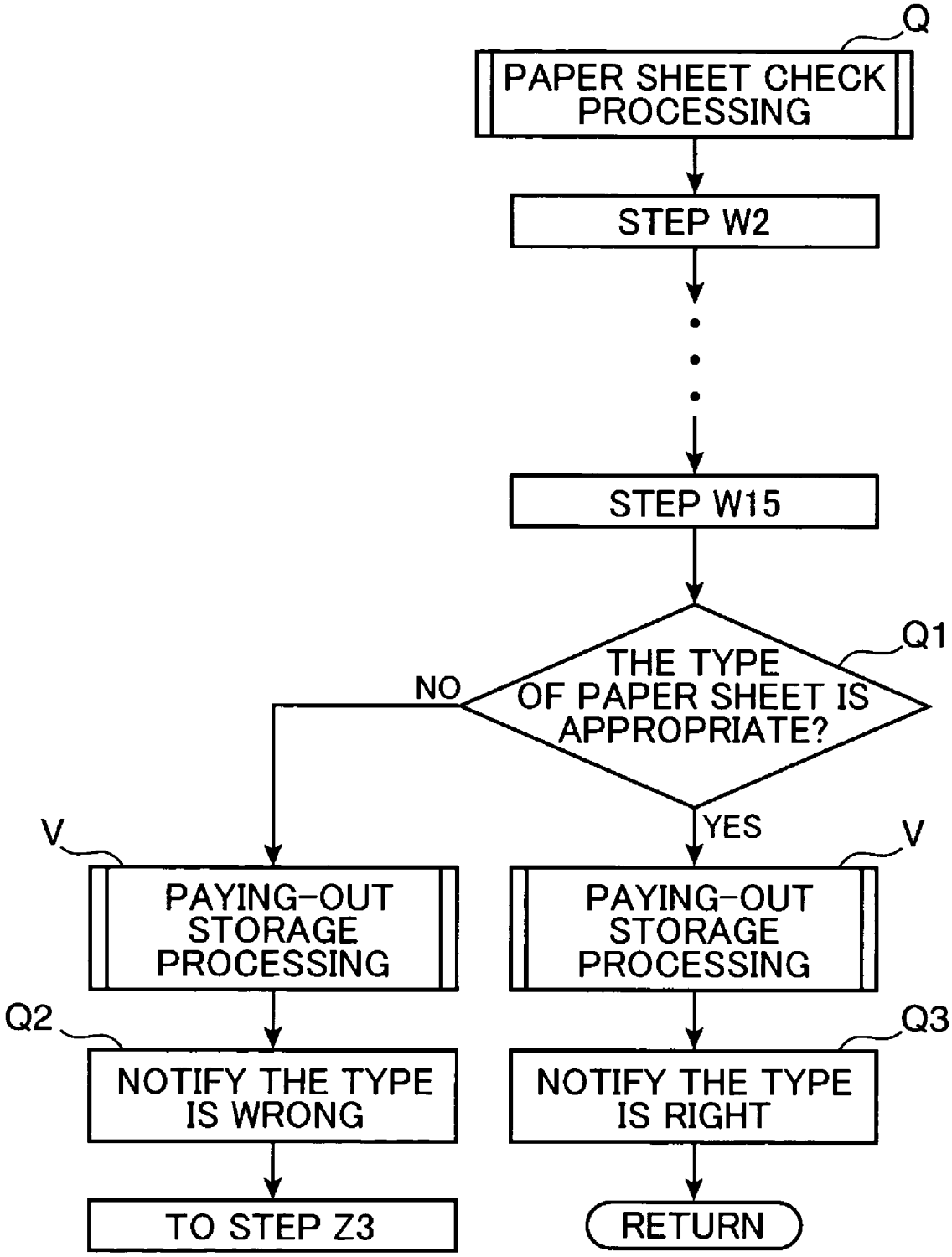
FIG. 27 is a flow chart, showing paper sheet check processing in FIG. 26.

FIG. 27 is a flow chart, showing the paper sheet check processing Q in FIG. 26.

With reference to FIG. 3, FIG. 10 and FIG. 27, when the paper sheet check processing Q is executed, Steps W2 to W15 of the paying-out processing W are executed. Specifically, the paying-out paper sheet B stored in the paying-out unit 40 is forwarded to the identification sensor 26*b*, along the first paper sheet forwarding line 51. When the paying-out paper sheet B is forwarded to the identification sensor 26*b*, judgment is made whether or not the paying-out paper sheet B corresponds to the type of the paying-out paper sheet B inputted (or preset) by the administrator in Step Z4 (in Step Q1). If the judgment is made that the paying-out paper sheet B is different from the inputted type (or NO at Step Q1), the above described paying-out storage processing V is executed, and a notifying device (not shown) notifies the administrator that the type of the paying-out paper sheet B is wrong (in Step Q2). Then, Step Z3 is repeatedly executed (refer to FIG. 26). On the other hand, if the judgment is made that the paying-out paper sheet B corresponds to the inputted type at Step Q1, the paying-out storage processing V is executed, and the notifying device notifies the administrator that the type of the paying-out paper sheet B is right (in Step Q3). Then, a return is made to the above described administrator-mode processing.

Accordingly, the paper sheet check processing Q is used as described above. Therefore, the administrator can certainly supply the suitable paying-out paper sheet B to be supplied to the paying-out unit 40 to the paying-out unit 40.

Eleventh Embodiment

Again, with reference to FIG. 26, for example, if the administrator has to collect in a lump all the paper sheets stored in both the paying-out unit 40 and the collecting unit 30, the administrator selects a simple collection mode (or YES at Step Z5). If this simple collection mode has been selected, a paper sheet shift processing R is executed.

Figure 28:
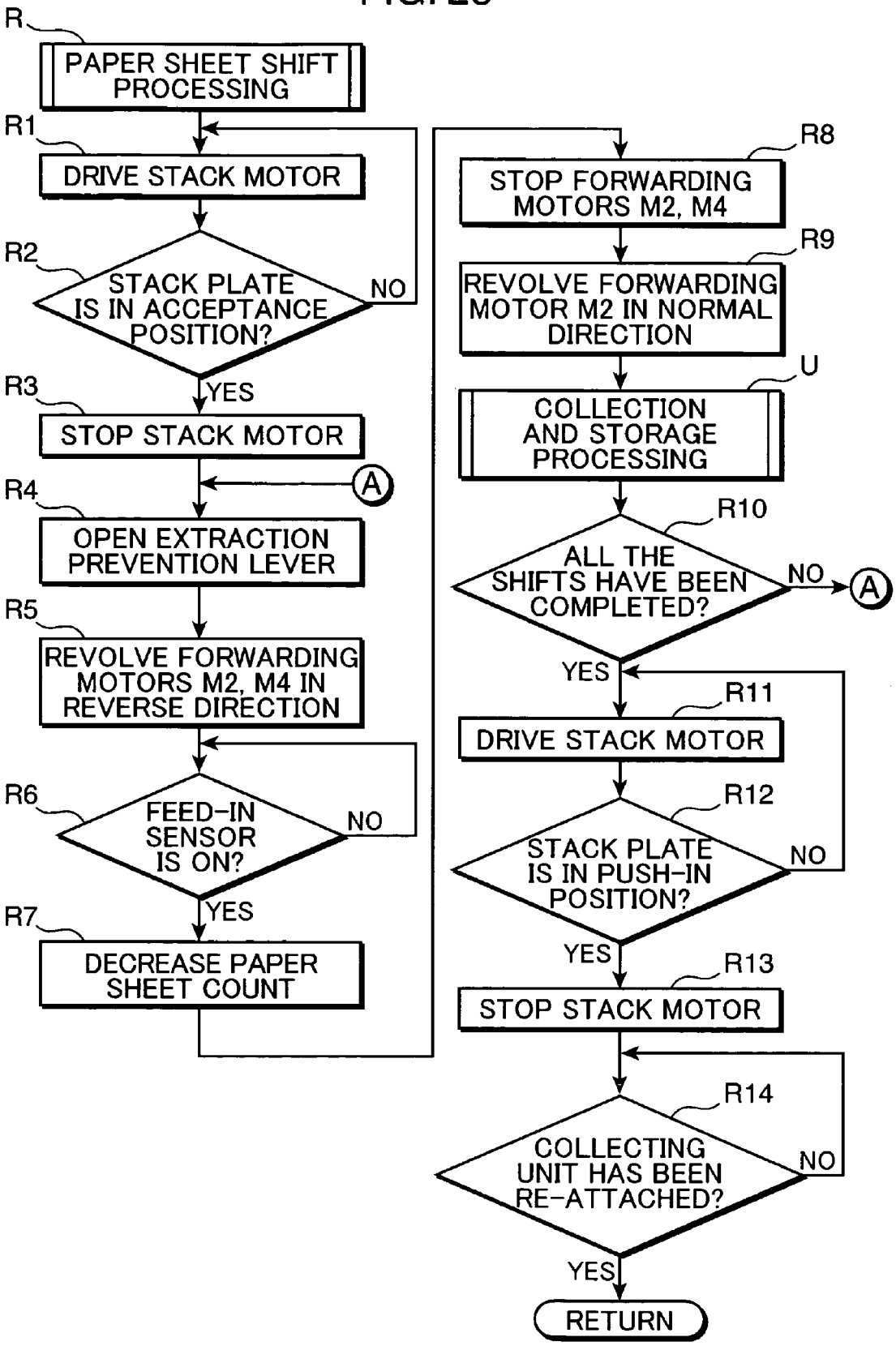
FIG. 28 is a flow chart, showing paper sheet shift processing in FIG. 26.
Figure 29:
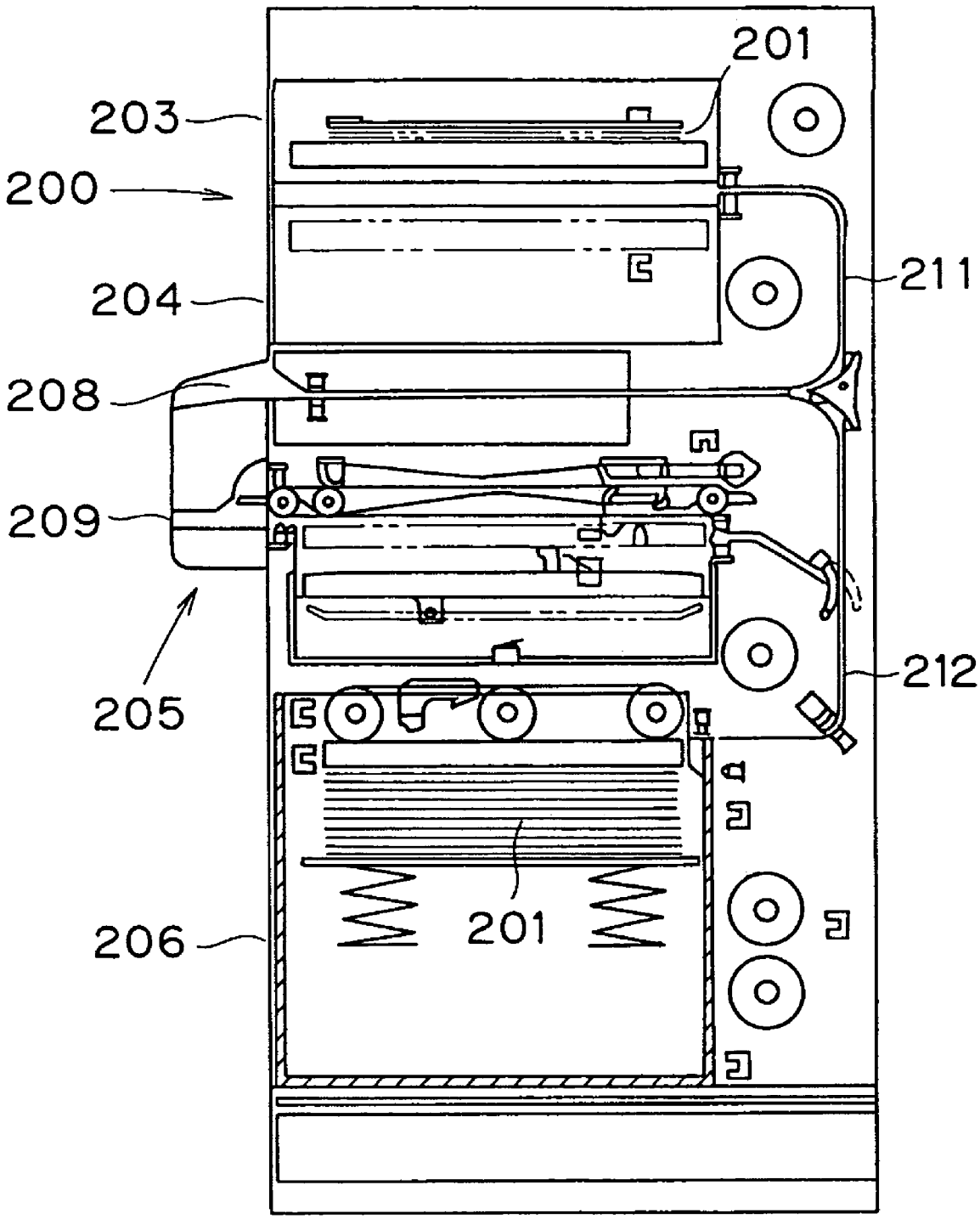
FIG. 29 is a right-side sectional view of a conventional paper sheet handling apparatus.
Figure 30:
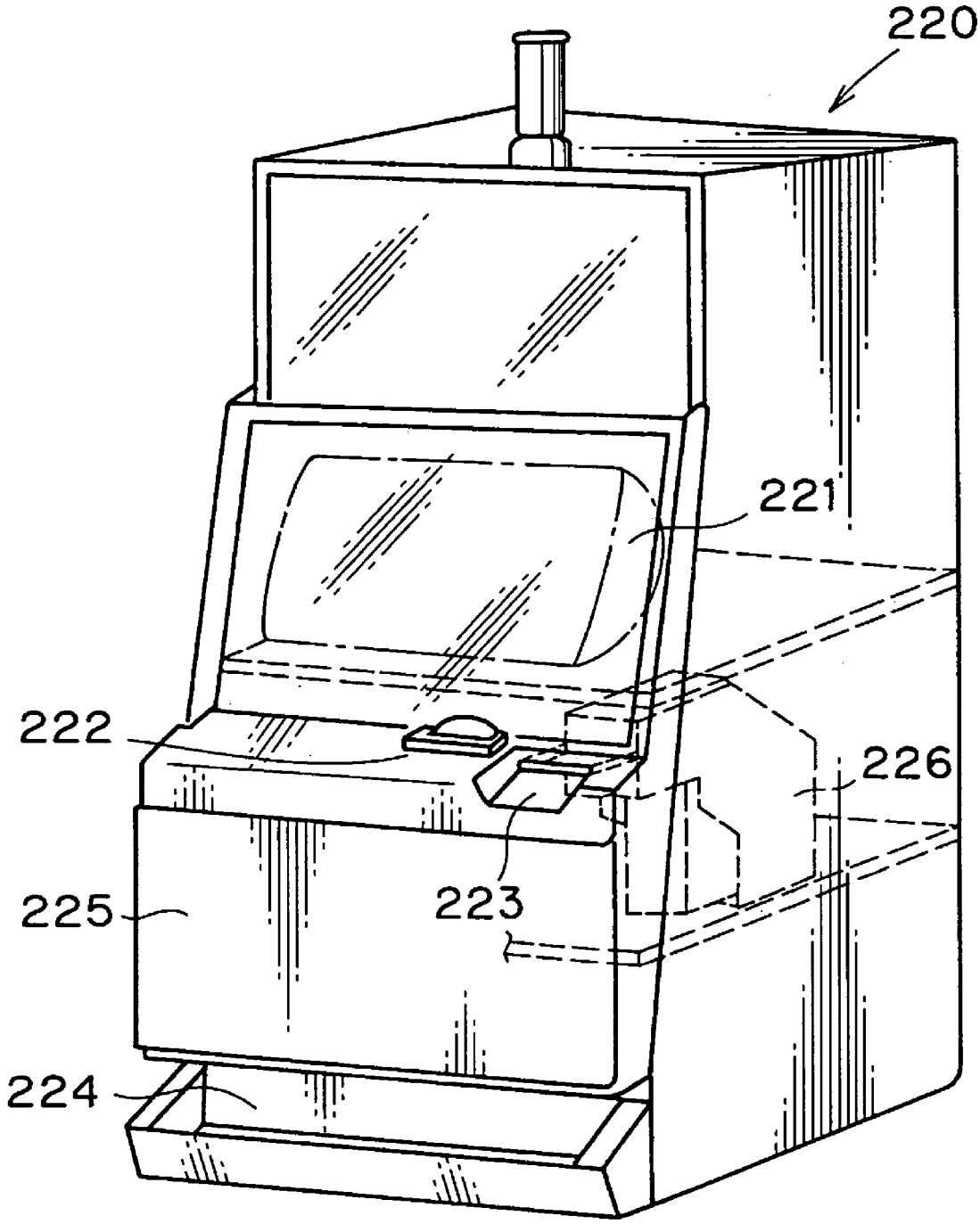
FIG. 30 is a perspective view of recreational equipment for amusements which houses a paper sheet handling apparatus.

FIG. 28 is a flow chart, showing the paper sheet shift processing R in FIG. 26.

With reference to FIG. 3, FIG. 26 and FIG. 28, when the paper sheet shift processing R is executed, the stack motor M3 is driven (in Step R1). Then, judgment is made whether or not the stack plate 45 has been brought in the acceptance position by this drive (in Step R2). If the judgment is made that the stack plate 45 is not in the acceptance position (or NO at Step R2), Step R1 is repeatedly executed. On the other hand, if the judgment is made that the stack plate 45 is in the acceptance position (or YES at Step R2), the stack motor M3 is stopped (in Step R3). Next, the extraction prevention lever 56 is opened (in Step R4), the forwarding motors M2 and M4 are revolved in their reverse directions (in Step R5), the paying-out paper sheet B starts to be forwarded. Then, when the paying-out paper sheet B is forwarded, judgment is made whether or not the feed-in sensor 55 has been turned ON by the paying-out paper sheet B (in Step R6). If the judgment is made that the feed-in sensor 55 is OFF (or NO at Step R6), Step R6 is repeatedly executed. On the other hand, if the judgment is made that the feed-in sensor 55 is ON (or YES at Step R6), the figure of the paper sheet counter used for the paying-out unit 40 decreases (in Step R7). Next, the forwarding motors M2 and M4 are stopped (in Step R8). Thereafter, the forwarding motor is revolved in its normal direction (in Step R9), and the collection and storage processing U is executed. The paying-out paper sheet B is forwarded to the collecting unit 30 by executing the collection and storage processing U. After the paying-out paper sheet B has been forwarded in this way, as a result, judgment is made whether or not all the paying-out paper sheets B inside of the paying-out unit 40 have been shifted to the collecting unit 30 (in Step R10). If the judgment is made that all the paying-out paper sheets B inside of the paying-out unit 40 is not shifted (or NO at Step R10), Step R4 is repeatedly executed. On the other hand, if the judgment is made that all the paying-out paper sheets B inside of the paying-out unit 40 is shifted (or YES at Step R10), the stack motor M3 is driven (in Step R11). Next, judgment is made whether or not the stack plate 45 has been brought to the push-in position by the drive of the stack motor M3 (in Step R12). If the judgment is made that the stack plate 45 is not in the push-in position (or NO at Step R12), Step R11 is repeatedly executed. On the other hand, if the judgment is made that the stack plate 45 is in the push-in position (or YES at Step R12), the stack motor M3 is stopped (in Step R13). In this state, the administrator detaches the collecting unit 30 from the outer frame 10, collects the paper sheets inside of the collecting unit 30 (i.e., all the paper sheets stored in the collecting unit 30 and the paying-out unit 40), and again, attaches it to the outer frame 10. In addition, if the fact that the collecting unit 30 has been attached again is inputted by the above described inputting device (or YES at Step R14), the processing of the above described controller is shifted to the processing of the above described administrator mode.

As described above, the paper sheet shift processing R is used. Therefore, if the administrator has to collect the paper sheets A and B stored in both the paying-out unit 40 and the collecting unit 30, the administrator can collect the paper sheets A and B in a lump from the collecting unit 30.

Herein, in each embodiment described above, the paying-out paper sheet B which is paid out by the paying-out unit is not limited to the one described above. If necessary, there may also be used a cut-sheet or a continuous form, a card which undergoes printing or magnetic recording, or another paying-out paper sheet.

Furthermore, according to the above described second embodiment, the paying-out unit is configured by including two paying-out portions. However, the present invention is not limited to this. It may also be configured by including three or more paying-out portions. In addition, among the above described bank note, cut-sheet, continuous form and card, and another paper sheet, any one may also be paid out from each paying-out portion.

Furthermore, according to the above described third embodiment, three paying-out portions are configured to be stored in the inside frame. However, the present invention is not limited to this. Any two, one behind another in the front-and-rear directions, of the three paying-out portions may also be configured to be stored in the inside frame. In that case, the opening portion is formed which corresponds to the rear paying-out portion of them. In addition, the number of paying-out portions stored in the inside frame may also be four or more. Moreover, instead of the opening portion formed in the inside frame, an open-and-close portion may also be formed.

INDUSTRIAL APPLICABILITY

As described above, in the paper sheet handling apparatus according to the present invention, the identifying unit and the forwarding unit are disposed in the front-and-rear directions. Below these, the collecting unit is disposed, and the paying-out unit is disposed at least on the inner side from the collecting unit. This allows its up-and-down measurement to become shorter. In addition, the identifying unit and the forwarding unit are disposed in the front-and-rear directions, and the identifying unit forwards and identifies a paper sheet. This saves the identifying unit from having to include more than an identifying mechanism. Thus, no obstacle can be constituted, even if the front end of a paper sheet is located inside of the forwarding unit when an identification is executed. This allows its front-and-rear measurement to become shorter, even though the housing space is limited in the front-and-rear directions, to that limited measurement.

Moreover, to the outer frame, the collecting unit and the paying-out unit are attached from its front side so as to be attachable and detachable. Thereby, regardless of the disposition of other units around the place where the paper sheet handling apparatus is housed, the identified paper sheet that has been stored in the collecting unit can be collected. In addition, the paying-out paper sheet can be supplied to the paying-out unit, thereby making it possible to receive and pay out a paper sheet.

In the paper sheet handling apparatus according to the present invention, the paying-out paper sheet is one, or two or more, of a bank note, a cut-sheet which undergoes printing when paid out, a continuous form which undergoes printing when paid out, and a card which undergoes printing or magnetic recording when paid out. According to this configuration, the paying-out paper sheet can be paid out according to the type of housing equipment which houses the paper sheet handling apparatus. In addition, the usage of the paying-out paper sheet which has been paid out can be made various types.

In the paper sheet handling apparatus according to the present invention, the directions in which a paper sheet is forwarded between the collecting unit and the forwarding unit and between the paying-out unit and the forwarding unit are set to the up-and-down directions. According to this configuration, the direction in which a paper sheet is forwarded between the collecting unit and the forwarding unit is set to the up-and-down directions. Thereby, the front-and-rear measurement of the collecting unit can be made as short as possible. This presents ample space on the inner side from the collecting unit. In that ample space, the paying-out unit can be placed whose front-and-rear measurement is made shorter by setting the paper sheet forwarding direction between it and the forwarding unit to the up-and-down directions. Therefore, even though the housing space is limited in the front-and-rear directions, the front-and-rear measurements of the collecting unit and the paying-out unit can be made shorter to their limited measurements.

In the paper sheet handling apparatus according to the present invention, the collecting unit or the paying-out unit, or these two, include a sorting and storage portion which sorts and stores two types of paper sheets according to their types. According to this configuration, even if the necessity occurs of storing two types of paper sheets, there is no need for new storage space for the collecting unit or the paying-out unit, or these two. This makes it possible to omit the space for essential storage space, and thus, to store each paper sheet, with the whole paper sheet handling apparatus keeping its measurements at a small space.

In the paper sheet handling apparatus according to the present invention, the outer frame is provided with a second paying-out unit at the upper part thereof, this second paying-out unit stores the paying-out paper sheet so that it is inserted into and extracted from the front side of the outer frame. According to this configuration, if the paying-out paper sheet (such as a cut-sheet on which printing is conducted at the time of paying-out) is treated to which an administrator has access more frequently than to the paper sheet stored in the collecting unit, the second paying-out unit is configured so that the paying-out paper sheet can be inserted into and extracted from the front side of the outer frame. Therefore, the administrator can easily supply or take out the paying-out paper sheet from the second paying-out unit, without removing the collecting unit from the outer frame. In other words, this configuration allows the supply or extraction of the paying-out paper sheet which has high access frequency to be simply operated, with the paper sheet handling apparatus maintaining its front-and-rear measurement as much as possible.

In the paper sheet handling apparatus according to the present invention, the second paying-out unit is provided with an identifying device which identifies the type or the like of the paying-out paper sheet which is forwarded from the second paying-out unit to the opening portion; this identifying device is configured to identify a printing level or a magnetic-recording level of the paying-out paper sheet; and if each level of the paying-out paper sheet which is identified by this identifying device is identified as lower than a predetermined level, the paying-out paper sheet is forwarded to the collecting unit by the forwarding unit. According to this configuration, if a printing level or a magnetic-recording level of the paying-out paper sheet to be paid out from the second paying-out unit to the opening portion is a level at which identification could not be conducted later (e.g., in the case of a light print, a magnetic fault or the like), the paying-out paper sheet is forwarded to the collecting unit by the forwarding unit. In that case, another paying-out paper sheet is issued again, thereby preventing the one that could not be identified from being issued.

In the paper sheet handling apparatus according to the present invention, the paying-out unit includes a plurality of paying-out portions which store, as the paying-out paper sheet, a plurality of types of paper sheets according to their types; and each of these plurality of paying-out portions is individually detachably attached from the front side of the outer frame. According to this configuration, a plurality of types of paying-out paper sheets can be paid out. This allows various types of housing equipment to be used, thus increasing the types of housing equipment applicable to the paper sheet handling apparatus. With respect to each paying-out portion, the paying-out paper sheets can be supplied to the paying-out portion at their inmost part, if they are detached one after another from the forefront.

In the paper sheet handling apparatus according to the present invention, the plurality of paying-out portions include at least two paying-out portions which are disposed below the identifying unit and the forwarding unit; those paying-out portions are inside of the outer frame, and are united and housed in an inside frame which is detachably attached below the identifying unit and the forwarding unit; and the inside frame is provided with an opening portion or an open-and-close portion through which the paying-out paper sheet is fed to a paying-out portion located in the inner part. According to this configuration, the plurality of paying-out portions are united and housed in the inside frame. If the inside frame is detached forward from the outer frame, the paying-out paper sheets can be supplied to a paying-out portion located at their inner part, through the opening portion or the open-and-close portion. Thus, there is no need to remove paying-out portions one by one which are placed ahead of the paying-out portion located in the inner part, thereby making it convenient.

In the paper sheet handling apparatus according to the present invention, the identifying unit is configured to identify a damage level of a paper sheet which is inserted from the opening portion, and a printing level or a magnetic-recording level of the paying-out paper sheet to be paid out to the opening portion; and if each level of the paper sheet which is identified by this identifying unit is identified as lower than a predetermined level, the paper sheet is forwarded to the collecting unit by the forwarding unit. According to this configuration, if the damage level of a paper sheet which has been inserted from the opening portion is a level at which it can be identified as genuine or counterfeit by the identifying unit, but a level at which its forwarding by the forwarding unit may have a harmful influence (which corresponds to the damage level of, for example, a bent or ripped paper sheet), then the paper sheet is forwarded to the collecting unit by the forwarding unit. This prevents the paper sheet from being forwarded to the paying-out unit at all, thereby avoiding the trouble at the time of forwarding which may be caused when it is paid out later. In the same way, if the printing level or magnetic-storage level of the paying-out paper sheet to be paid out to the opening portion is a level at which it could not be identified later, then the paying-out paper sheet is forwarded to the collecting unit by the forwarding unit. In that case, another paying-out paper sheet is issued again, thereby preventing the one, as described above, that could not be identified from being issued.

In the paper sheet handling apparatus according to the present invention, the identifying unit is configured to identify the insertion direction of a paper sheet which is inserted from the opening portion; and the paper sheet which is identified as a specific insertion direction by this identifying unit is forwarded to the paying-out unit by the forwarding unit. According to this configuration, the insertion direction (or the front-and-rear direction and the obverse-and-reverse direction) of a paper sheet which has been inserted from the opening portion by the identifying is identified. As a result, the paper sheet which has been identified as a specific insertion direction is forwarded to the paying-out unit. This unifies the storage direction of the paper sheet to be stored in the paying-out unit. Therefore, the direction in which a paper sheet is paid out to a user can be unified for each paying-out operation.

In the paper sheet handling apparatus according to the present invention, the forwarding unit is configured to forward the paying-out paper sheet which is stored in the paying-out unit to the collecting unit, according to an external request. According to this configuration, the forwarding unit forwards the paying-out paper sheet which has been stored in the paying-out unit to the collecting unit, according to an external request. Thus, if there is the need to collect the paper sheets which have been stored in both the paying-out unit and the collecting unit, then an administrator once forwards the paper sheet in the paying-out unit to the collecting unit. Thereafter, the administrator can collect the paper sheets in a lump from the collecting unit. Herein, "the external request" is realized by a predetermined starting operation. As this kind of starting operation, operation can be used, such as the operation of a predetermined switch provided in the paper sheet handling apparatus, and the operation of allowing the identifying unit to read a magnetic card which stores a command for starting in advance, or a coupon ticket on which a command for starting is printed as bar-code information beforehand.

In the paper sheet handling apparatus according to the present invention, the identifying unit is detachably attached to the forwarding unit, and is replaced and used according to the paper sheet to be identified. According to this configuration, the identifying unit is replaced and used, thereby making it possible to identify the paper sheet to be identified, even though it is varied.

In the paper sheet handling apparatus according to the present invention, the opening portion of the identifying unit is used both for inserting and paying out a paper sheet. According to this configuration, there is no need to separately provide an opening portion for paying-out, or a forwarding line which leads to it. This shortens its height measurement and decreases the number of parts.

In the paper sheet handling apparatus according to the present invention, the paying-out paper sheet includes a reference reading paper sheet which is used for adjusting identification precision of the identifying unit; and the precision of the identifying unit is adjusted so that an actual measurement value by the identifying unit which identifies this reference reading paper sheet becomes a value that is preset for the reference reading paper sheet. According to this configuration, the precision of the identifying unit can be adjusted by allowing it to identify the reference reading paper sheet. Hence, if this reference reading paper sheet is stored in the paying-out unit, the precision of the identifying unit can be easily adjusted.

In the paper sheet handling apparatus according to the present invention, the paying-out paper sheet includes a cleaning paper sheet which is used for cleaning the identifying unit; and the identifying unit is cleaned when identifying the cleaning paper sheet. According to this configuration, cleaning of the identifying unit can be conducted by allowing it to identify the cleaning paper sheet. Hence, if this cleaning paper sheet is stored in the paying-out unit, cleaning of the identifying unit can be easily conducted.

In the paper sheet handling apparatus according to the present invention, the identifying unit is configured to identify whether the paying-out paper sheet in the paying-out unit which is supplied by an administrator, is a predetermined one, or not. According to this configuration, the identifying unit is configured to identify whether the paying-out paper sheet in the paying-out unit which has been supplied by an administrator, is a predetermined one, or not. Thus, the administrator can certainly supply the paying-out paper sheet into the paying-out unit.

The invention claimed is:

1. A paper sheet handling apparatus, comprising:

an outer frame having opposite front and rear ends, a bottom and a top, opposite right and left side plates extending between the front and rear ends, a bottom plate extending between the right and left side plates at the bottom of the outer frame and a shelf plate extending between the right and left side plates at a position between the bottom plate and the top of the outer frame, an upper space being defined in the outer frame above the shelf plate and being open at the front end of the outer frame, a lower space being defined in the outer frame below the shelf plate and being open at the front end of the outer frame;

an identifying unit disposed in the upper space at a position adjacent the front end of the outer frame, the identifying unit having an opening in a front portion thereof and in proximity to the front end of the outer frame, the identifying unit identifying a paper sheet that is inserted from the opening formed in the identifying unit;

a collecting unit which stores the identified paper sheet, the collecting unit being in the lower space of the outer frame at a position adjacent the open front end thereof and having a paper sheet conveying line therein, an inlet of the paper sheet conveying line being at a top portion of the collecting unit and facing towards the top of the outer frame;

a paying-out unit which stores a paying-out paper sheet to be discharged out to the opening of the identifying unit when a predetermined condition is satisfied, the paying-out unit being in the lower space of the outer frame between the collecting unit and the rear end of the outer frame and having a paper sheet conveying line therein, an inlet of the paper sheet conveying line being at a top portion of the paying-out unit rearward of the inlet in the collecting unit and facing towards the top of the outer frame; and a conveying unit disposed in the upper space of the outer frame adjacent the rear end of the outer frame, the conveying unit being operative for conveying the identified paper sheet and the paying-out paper sheet between the identifying unit, the collecting unit and the paying-out unit, the conveying unit having a first paper sheet conveying line extending from the identifying unit to a first outlet at a bottom portion of the conveying unit, the first outlet facing towards the bottom of the outer frame and aligned with the inlet of the paper sheet conveying line of the collecting unit, and a second paper sheet conveying line branching off from the first paper sheet conveying line in the conveying unit and extending to a second outlet at a bottom portion of the conveying unit, the second outlet of the conveying unit facing towards the bottom of the outer frame and being aligned with the inlet of the paper sheet conveying line of the paying-out unit;

wherein:

the collecting unit and the paying-out unit are configured for being inserted in the open front end of the lower space of the outer frame and are detachably attached to the outer frame.

2. The paper sheet handling apparatus according to claim 1, wherein the paying-out paper sheet is at least one of a bank note, a cut-sheet when being paid out, a continuous sheet to be printed when being paid out, and a card to be printed or magnetically recorded when being paid out.

3. The paper sheet handling apparatus according to claim 1, wherein a conveyance of a paper sheet between the collecting unit and the conveying unit and a conveyance between the paying-out unit and the conveying unit are in the up-and-down directions.

4. The paper sheet handling apparatus according to claim 1, wherein one or both of the collecting unit and the paying-out unit include a sorting and storage portion which sorts and stores two types of paper sheets according to their types.

5. The paper sheet handling apparatus according to claim 1, further comprising a second paying-out unit supported on an upper part of the outer frame, wherein paying-out paper sheets stored in the second paying-out unit are inserted into and extracted from the front of the outer frame.

6. The paper sheet handling apparatus according to claim 5, wherein: the second paying-out unit is provided with an identifying device which identifies a type of a paying-out paper sheet which is conveyed from the second paying-out unit to the opening portion; the identifying device identifies a printing level or a magnetic-recording level of the paying-out paper sheet; and if each level of the paying-out paper sheet is identified to be lower than a predetermined level by the identifying device, the paying-out paper sheet is conveyed to the collecting unit by the conveying unit.

7. The paper sheet handling apparatus according to claim 1, wherein: the paying-out unit includes a plurality of paying-out portions which store a plurality of types of paying-out paper sheets according to their types; and the plurality of paying-out portions are individually detachably attached from the front of the outer frame.

8. The paper sheet handling apparatus according to claim 7, wherein: two or more of the plurality of paying-out portions are disposed below the identifying unit and the conveying unit, and are supported integrally on an inside frame detachably attached on an inside of the outer frame and below the identifying unit and the conveying unit; and the inside frame is provided with an opening portion or an open-and-close portion through which a paying-out paper sheet is fed to a certain one of the paying-out portions located in an inner part.

9. The paper sheet handling apparatus according to claim 1, wherein: the identifying unit identifies a damage level of a paper sheet inserted from the opening portion, and a printing level or a magnetic-recording level of a paying-out paper sheet to be paid out to the opening portion; and if each level of the paper sheet is identified to be lower than a predetermined level by the identifying unit, the paper sheet is forwarded to the collecting unit by the forwarding unit.

10. The paper sheet handling apparatus according to claim 1, wherein: the identifying unit identifies the insertion direction of a paper sheet inserted from the opening portion; and a paper sheet which is identified to have a specific insertion direction by the identifying unit is conveyed to the paying-out unit by the conveying unit.

11. The paper sheet handling apparatus according to claim 1, wherein the conveying unit conveys a paying-out paper sheet which is stored in the paying-out unit to the collecting unit, according to an external request.

12. The paper sheet handling apparatus according to claim 1, wherein the identifying unit is detachably attached to the conveying unit, and is replaced with another according to a paper sheet to be identified.

13. The paper sheet handling apparatus according to claim 1, wherein the opening of the identifying unit is adapted for inserting and paying out a paper sheet.

14. The paper sheet handling apparatus according to claim 1, wherein: the paying-out paper sheet includes a reference reading paper sheet which is used to adjust identification precision of the identifying unit so that an actual measurement value of the reference reading paper sheet by the identifying unit becomes a value that is preset for the reference reading paper sheet.

15. The paper sheet handling apparatus according to claim 1, wherein: the paying-out paper sheet includes a cleaning paper sheet which is used to clean the identifying unit when identifying the cleaning paper sheet.

16. The paper sheet handling apparatus according to claim 1, wherein the identifying unit identifies whether a paying-out paper sheet supplied in the paying-out unit by an administrator, is a predetermined one or not.

17. The paper sheet handling apparatus according to claim 1, wherein a dimension of the identifying unit in an anterior/posterior direction is smaller than a dimension of a regular paper sheet in a direction parallel to a direction in which the regular paper sheet is inserted in the identifying unit.

18. The paper sheet handling apparatus according to claim 17, wherein a front end of the paper sheet is located inside of the conveying unit when the paper sheet is identified.

19. A paper sheet handling apparatus, comprising:

an outer frame having opposite top and bottom ends, an open front end and a rear end opposite the front end, an intermediate plate between the top and bottom ends of the outer frame, an upper space being defined between the intermediate plate and the top end and a forwardly-open lower space being defined between the intermediate plate and the bottom end;

an identifying unit supported in the upper space of the outer frame in proximity to the top end and the front end of the outer frame, the identifying unit having a front portion at the front end of the outer frame and an opening formed in the front portion, the identifying unit being operable for identifying a paper sheet that is inserted into the opening in the front portion of the identifying unit;

a collecting unit mounted in the lower space of the outer frame and adjacent the open front end of the outer frame, the collecting unit having a paper sheet conveying line therein, an inlet of the paper sheet conveying line being disposed at a top portion of the collecting unit and facing towards the top end of the outer frame, the collecting unit being operative for storing the identified paper sheet;

a paying-out unit supported in the lower space of the outer frame between the collecting unit and the rear end of the outer frame, the paying-out unit having a paper sheet conveying line therein, an inlet of the paper sheet conveying line of the paying-out unit being disposed at a top portion of the paying-out unit rearward of the inlet of the collecting unit and facing towards the top end of the outer frame, the paying-out unit being operative for storing a paying-out paper sheet to be discharged out of the opening of the identifying unit when a predetermined condition is satisfied; and a conveying unit mounted in the upper space of the outer frame between the identifying unit and the rear end of the frame, the conveying unit having a first paper sheet conveying line, extending from the identifying unit to a first outlet at a bottom portion of the conveying unit and facing towards the bottom end of the outer frame, the first outlet being aligned with and facing the inlet of the paper sheet conveying line of the connecting unit, a second paper sheet conveying line branching off from the first paper sheet conveying line in the conveying unit and extending to a second outlet at a bottom portion of the conveying unit and facing toward the bottom end of the outer frame, the second outlet of the conveying unit being aligned with the inlet of the paper sheet conveying line of the paying-out unit, the conveying unit being operative for conveying the identified paper sheet and the paying-out paper sheet between the identifying unit, the collecting unit and the paying-out unit, the collecting unit and the paying-out unit being configured for being inserted in the lower space of the outer frame from the open front end of the outer frame and detachably attached to the outer frame.

20. The paper sheet handling apparatus according to claim 1, wherein the collecting unit has a hook pin, and the outer frame has a hook portion capable of hooking the hook pin for releasably keeping the collecting unit attached to the outer frame and a lever to detach the collecting unit from the outer frame.

* * * * *